US008894898B2

(12) United States Patent
Stolte et al.

(10) Patent No.: US 8,894,898 B2
(45) Date of Patent: Nov. 25, 2014

(54) PRESSED, WAXY, SOLID CLEANING COMPOSITIONS AND METHODS OF MAKING THEM

(75) Inventors: Roger L. Stolte, Maplewood, MN (US); Michael P. Dziuk, Oakdale, MN (US); Melissa C. Meinke, Minneapolis, MN (US); Matthew C. Porter, West St. Paul, MN (US)

(73) Assignee: Ecolab USA Inc., St. Paul, MN (US)

( * ) Notice: Subject to any disclaimer, the term of this patent is extended or adjusted under 35 U.S.C. 154(b) by 670 days.

(21) Appl. No.: 12/288,356

(22) Filed: Oct. 17, 2008

(65) Prior Publication Data

US 2009/0105111 A1 Apr. 23, 2009

Related U.S. Application Data

(60) Provisional application No. 60/980,919, filed on Oct. 18, 2007.

(51) Int. Cl.

| | |
|---|---|
| ***B28B 1/087*** | (2006.01) |
| ***C11D 3/37*** | (2006.01) |
| ***C11D 17/00*** | (2006.01) |
| ***C11D 1/22*** | (2006.01) |
| *C11D 1/66* | (2006.01) |
| *C11D 1/29* | (2006.01) |

(52) U.S. Cl.

CPC ..... *C11D 17/0047* (2013.01); *C11D 3/3707* (2013.01); *C11D 1/662* (2013.01); *C11D 1/22* (2013.01); *C11D 1/29* (2013.01)

USPC ..... 264/71; 264/77; 264/297.9

(58) Field of Classification Search

USPC ..... 264/71, 77, 297.8, 297.9; 425/260

See application file for complete search history.

(56) References Cited

U.S. PATENT DOCUMENTS

| | | | | |
|---|---|---|---|---|
| 930,455 | A | 8/1909 | Besser | |
| 2,556,754 | A | 6/1951 | Geist | |
| 3,274,660 | A | 9/1966 | Mizer et al. | |
| 3,698,843 | A | 10/1972 | Bowles et al. | |
| 4,158,537 | A | 6/1979 | Cuff et al. | |
| 4,704,233 | A | 11/1987 | Hartman et al. | |
| 4,802,836 | A | 2/1989 | Whissell | |
| 5,360,567 | A * | 11/1994 | Fry et al. | 510/298 |
| 5,578,559 | A * | 11/1996 | Dolan et al. | 510/192 |
| 5,589,124 | A | 12/1996 | Woolford et al. | |
| 5,593,707 | A | 1/1997 | Goe et al. | |
| 6,176,920 | B1 | 1/2001 | Murphy et al. | |

(Continued)

FOREIGN PATENT DOCUMENTS

| | | |
|---|---|---|
| CA | 2317030 | * 11/2000 |
| JP | 2002-505372 | 2/2002 |

(Continued)

*Primary Examiner* — Richard Crispino
*Assistant Examiner* — Robert Dye
(74) *Attorney, Agent, or Firm* — Amy J. Hoffman

(57) ABSTRACT

The present invention relates to a method of making a solid cleaning composition. The method can include pressing and/or vibrating flowable waxy particles of a waxy cleaning composition. For a waxy cleaning composition, pressing and/or vibrating flowable waxy particles determines the shape and density of the solid but is not required for forming a solid. The method can employ a concrete block machine for pressing and/or vibrating. The present invention also relates to a solid cleaning composition made by the method and to solid cleaning compositions including particles bound together by a binding agent.

23 Claims, 2 Drawing Sheets

(56) References Cited

U.S. PATENT DOCUMENTS

| | | | | |
|---|---|---|---|---|
| 6,213,754 | B1 | 4/2001 | Doty et al. | |
| 6,425,751 | B1 | 7/2002 | Bergeron et al. | |
| 6,814,906 | B2 | 11/2004 | Bergeron et al. | |
| 6,924,257 | B2 * | 8/2005 | Klos et al. | 510/189 |
| 7,041,244 | B2 | 5/2006 | Schmiedel | |
| 2002/0125593 | A1 | 9/2002 | Bergeron et al. | |
| 2004/0072715 | A1 | 4/2004 | Griese et al. | |
| 2004/0157761 | A1 | 8/2004 | Man et al. | |
| 2005/0113278 | A1 | 5/2005 | Stolte et al. | |
| 2005/0119149 | A1 | 6/2005 | Lentsch et al. | |
| 2005/0121830 | A1 | 6/2005 | Ness et al. | |
| 2005/0200042 | A1 * | 9/2005 | Chiba et al. | 264/109 |
| 2006/0293212 | A1 * | 12/2006 | Griese et al. | 510/446 |
| 2008/0174041 | A1 | 7/2008 | Firedman et al. | |
| 2009/0102085 | A1 | 4/2009 | Stolte et al. | |
| 2009/0105114 | A1 | 4/2009 | Stolte et al. | |

FOREIGN PATENT DOCUMENTS

| | | |
|---|---|---|
| JP | 2002-080900 | 3/2002 |
| WO | WO01-68794 | 9/2001 |
| WO | WO04-000982 | 12/2003 |

* cited by examiner

PRESSED, WAXY, SOLID CLEANING COMPOSITIONS AND METHODS OF MAKING THEM

CROSS REFERENCE TO RELATED APPLICATIONS

This application claims priority to U.S. Provisional Patent Application No. 60/980,919 filed on Oct. 18, 2007. The entire contents of this patent application are hereby expressly incorporated herein by reference including, without limitation, the specification, claims and abstract, as well as any figures, tables or drawings thereof.

This application is also related to U.S. patent application Ser. No. 12/115,094, filed on May 5, 2008, and to U.S. patent application Ser. No. 12/288,355, entitled "PRESSED, SELF-SOLIDIFYING, SOLID CLEANING COMPOSITIONS AND METHODS OF MAKING THEM", filed concurrently herewith, the entire contents of which are hereby incorporated by reference.

FIELD OF THE INVENTION

The present invention relates to a method of making a solid cleaning composition. The method can include pressing and/or vibrating flowable waxy particles of a waxy cleaning composition. For a waxy cleaning composition, pressing and/or vibrating flowable waxy particles determines the shape and density of the solid. The method can employ a concrete block machine and/or a turntable press for pressing and/or vibrating. The present invention also relates to a solid cleaning composition made by the method and to solid cleaning compositions including waxy particles bound together.

BACKGROUND OF THE INVENTION

The use of solidification technology and solid block detergents in institutional and industrial operations was pioneered in the SOLID POWER® brand technology claimed in Fernholz et al., U.S. Reissue Pat. Nos. 32,762 and 32,818. Similar advances have not been achieved for waxy solid cleaning compositions.

Conventional waxy solid compositions can be made by casting a melted composition and by extrusion. An expensive tablet press can apply its high pressures only to form tablet or puck sized solids. A tablet press is not suitable for making solid blocks. Casting requires melting the composition to form a liquid. Melting consumes energy and can destroy certain desirable ingredients in some cleaning products. Extruding requires expensive equipment and advanced technical know how.

There remains a need for additional methods for making waxy solid cleaning compositions and for compositions that can be made by these methods.

SUMMARY OF THE INVENTION

The present invention relates to a method of making a solid cleaning composition. The method can include pressing and/or vibrating flowable waxy particles of a waxy cleaning composition. For a waxy cleaning composition, pressing and/or vibrating flowable waxy particles determines the shape and density of the solid. The method can employ a concrete block machine for pressing and/or vibrating. The present invention also relates to a solid cleaning composition made by the method and to solid cleaning compositions including waxy particles bound together.

The present method relates to a method of making a solid cleaning composition. This method includes providing flowable waxy particles comprising a waxy solidification agent, alkalinity source, sequestrant, or mixture thereof. The method can include mixing the desired ingredients to form the flowable waxy particles. The method also includes placing the flowable waxy particles into a form. The method can include gently pressing, vibrating, or a combination thereof, the flowable waxy particles in the form to produce the solid cleaning composition.

Gently pressing, vibrating, or a combination thereof can be done by a concrete block machine, also known as a concrete products machine or masonry product machine, or by a turntable press. The method of making a solid cleaning composition can include providing flowable waxy particles comprising waxy solidification agent, sequestrant, or mixture thereof. This embodiment of the method includes putting the flowable waxy particles in a hopper or a drawer of a concrete block machine and operating the concrete block machine to produce solid cleaning composition.

In some embodiments, the method includes putting the flowable waxy particles in a drawer of a concrete block machine and vibrating the flowable waxy particles in the drawer. The method also includes transferring the flowable waxy particles from the drawer into a form. Once in the form, the method includes gently pressing the flowable waxy particles in the form to produce the solid cleaning composition, vibrating the flowable waxy particles to produce the solid cleaning composition, or combination thereof. The method then includes removing the solid cleaning composition from the form.

Gently pressing can include applying pressures of about 1 to about 1000 psi to the flowable waxy particles. Vibrating can occur at about 3000 to about 6000 rpm. Vibrating can occur at about 1500 to about 3000 rpm. Vibrating can occur for about 1 to about 10 sec.

The present invention also relates to a solid cleaning composition. The solid cleaning composition can include waxy solidification agent, alkalinity source, sequestrant, or mixture thereof. The solid cleaning composition can include particles of cleaning composition including an interior and a surface. In the solid cleaning composition, the surfaces of adjacent particles can contact one another just enough to provide sufficient contact of the adjacent particles to provide a stable solid cleaning composition. The solid cleaning composition can be made by the method of the present invention.

DETAILED DESCRIPTION OF THE INVENTION

Definitions

Figure 1:
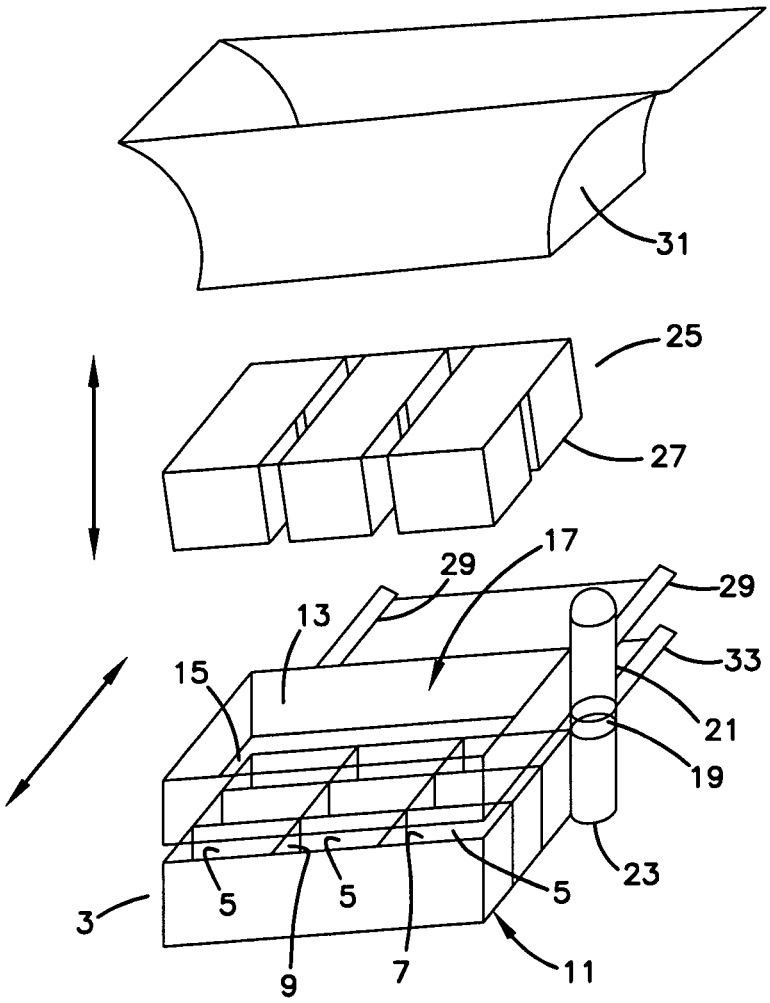
FIG. 1 schematically illustrates an apparatus suitable for gently pressing the present compositions, a concrete block machine.

As used herein, the phrase "concrete block machine" refers to a machine that forms concrete products (e.g., blocks or pavers) from concrete and that includes apparatus for pressing, vibrating, or combination thereof concrete (or the present flowable waxy particles) in a form or mold. Such a machine is known in the product literature as a concrete product machine, concrete block machine, a masonry product machine, and the like.

Unless stated otherwise, as used herein, the term "psi" or "pounds per square inch" refers to the actual pressure applied to the material (e.g., the present flowable waxy particles) being pressed (e.g., gently pressed) or applied to the material in a plurality of forms. As used herein, psi or pounds per square inch does not refer to the gauge or hydraulic pressure measured at a point in the apparatus doing the pressing. Gauge or hydraulic pressure measured at a point in an apparatus is referred to herein as "gauge pressure".

As used herein, the term "phosphate-free" refers to a composition, mixture, or ingredients that do not contain a phosphate or phosphate-containing compound or to which a phosphate or phosphate-containing compound has not been added. Should a phosphate or phosphate-containing compound be present through contamination of a phosphate-free composition, mixture, or ingredients, the level of phosphate shall be less than 0.5 wt %, may be less then 0.1 wt %, and can be less than 0.01 wt %.

As used herein, the term "phosphorus-free" refers to a composition, mixture, or ingredients that do not contain phosphorus or a phosphorus-containing compound or to which phosphorus or a phosphorus-containing compound has not been added. Should phosphorus or a phosphorus-containing compound be present through contamination of a phosphorus-free composition, mixture, or ingredients, the level of phosphorus shall be less than 0.5 wt %, may be less then 0.1 wt %, and can be less than 0.01 wt %.

The term "functional material" or "functional additives" refers to an active compound or material that affords desirable properties to the solid or dissolved composition. For example, the functional material can afford desirable properties to the solid composition such as enhancing solidification characteristics or dilution rate. The functional material can also, when dissolved or dispersed in an aqueous phase, provide a beneficial property to the aqueous material when used. Examples of functional materials include chelating/sequestering agent, alkalinity source, surfactant, cleaning agent, softening agent, buffer, anti-corrosion agent, bleach activators secondary hardening agent or solubility modifier, detergent filler, defoamer, anti-redeposition agent, antimicrobials, rinse aid compositions, a threshold agent or system, aesthetic enhancing agent (i.e., dye, perfume), lubricant compositions, additional bleaching agents, functional salts, hardening agents, solubility modifiers, enzymes, other such additives or functional ingredients, and the like, and mixtures thereof. Functional materials added to a composition will vary according to the type of composition being manufactured, and the intended end use of the composition.

"Cleaning" means to perform or aid in soil removal, bleaching, microbial population reduction, or combination thereof.

As used herein, a solid cleaning composition refers to a cleaning composition in the form of a solid, including, but not limited to a waxy powder, a flake, a granule, a pellet, a tablet, a lozenge, a puck, a briquette, a brick, a solid block, or a unit dose. In addition, the term "solid" refers to the state of the cleaning composition under the expected conditions of storage and use of the solid cleaning composition. In general, it is expected that the cleaning composition will remain in solid form when exposed to temperatures of up to about 100° F. and greater than about 120° F.

As used herein, microbial preparation refers to a composition including one or more of spores (bacterial or fungal), vegetative bacteria, or fungi, which can be provided in a preservative. As used herein, bacteria preparation refers to a composition including bacterial spores and/or vegetative bacteria, which can be provided in a preservative. The preservative can include, for example, any or a variety of preservative compositions used in commercially supplied preparations of spores (bacterial or fungal), vegetative bacteria, or fungi. Such preservatives can include, for example, chelator, surfactant, buffer, water, or the like. The microbial preparation can, for example, digest or degrade soils such as fat, oil, grease, sugar, protein, carbohydrate, or the like.

As used herein, boric acid salt and borate salt are used interchangeably to refer to a salt such as potassium borate, monoethanolamine borate, or another salt obtained by or that can be visualized as being obtained by neutralization of boric acid. The weight percent of a boric acid salt or borate salt in a composition of the present invention can be expressed either as the weight percent of either the negatively charged boron containing ion, e.g. the borate and/or boric acid moieties, or as the weight percent of the entire boric acid salt, e.g. both the negatively charged moiety and the positively charged moiety. Preferably, the weight percent refers to the entire boric acid salt. Weight percents of citric acid salts, or other acid salts, can also be expressed in these ways, preferably with reference to the entire acid salt. As used herein, the term "total boron compound" refers to the sum of borate and boric acid moieties.

As used herein, basic or alkaline pH refers to pH greater than 7, greater than or equal to 8, about 8 to about 9.5, about 8 to about 11, greater than about 9, or about 9 to about 10.5.

As used herein, the terms "flooring" or "floor" refer to any horizontal surface on which a person might walk. Flooring or a floor can be made of an inorganic material, such as ceramic tile or natural stone (e.g., quarry tile), or an organic material, such as an epoxy, a polymer, a rubber, or a resilient material. The flooring or floor can be in any of a variety of environments such as a restaurant (e.g., a fast food restaurant), a food processing and/or preparation establishment, a slaughter house, a packing plant, a shortening production plant, a kitchen, or the like.

As used herein, the phrases "coefficient of friction" and "slip resistance" can be defined with respect to any of a variety of standard publications, such as ASTM Standard D-2047, "Static Coefficient of Friction of Polish Coated Floor Surfaces as Measured by the James Machine" and a report by ASTM Committee D-21 which indicated that a floor having a coefficient of static friction of not less than 0.5 as measured by this test is recognized as providing a non-hazardous walkway surface. This value is qualified in NBS Technical Note 895 "An Overview of Floor Slip-Resistance, With Annotated Bibliography" by Robert J. Brungraber, wherein it is indicated that the value of 0.5 provides a factor of safety and that most people, taking normal strides, would be unlikely to slip on surfaces for which the value is greater than 0.3-0.35. Other relevant and similar standards include ANSI 1264.2-2001, ASTM C1028-89, ASTM D2047-93, ASTM F1679-00 (which relates to the English XL Tribometer), ASTM Test Method F1677-96, and UL 410 (1992). Each of the standards in this paragraph is incorporated herein by reference.

As used herein, weight percent (wt-%), percent by weight, % by weight, and the like are synonyms that refer to the concentration of a substance as the weight of that substance divided by the total weight of the composition and multiplied by 100.

As used herein, the term "about" modifying the quantity of an ingredient in the compositions of the invention or employed in the methods of the invention refers to variation in the numerical quantity that can occur, for example, through typical measuring and liquid handling procedures used for making concentrates or use solutions in the real world; through inadvertent error in these procedures; through differences in the manufacture, source, or purity of the ingredients employed to make the compositions or carry out the methods; and the like. The term about also encompasses amounts that differ due to different equilibrium conditions for a composition resulting from a particular initial mixture. Whether or not modified by the term "about", the claims include equivalents to the quantities.

Compositions

The present invention relates to solid cleaning compositions and methods of making them. The present method can include pressing, vibrating, or a combination thereof (pressing and vibrating) flowable waxy particles of a waxy cleaning composition to produce a solid, such as a block or puck. As used herein, the term "waxy" when used with respect to particles, compounds or compositions (e.g., waxy particles, waxy solidification agents) refers to particles or compounds or compositions that stick, e.g., bind, together when a sufficient amount of particles are in contact with each other. If just placed in a form or mold without having pressure or vibration applied to it, flowable waxy particles of a waxy cleaning composition forms a crumbly (friable) solid. Gently pressing and/or vibrating the flowable waxy particles in a mold or form produces a stable solid. A stable solid composition retains its shape under conditions in which the composition may be stored or handled. For a waxy cleaning composition, pressing and/or vibrating flowable waxy particles determines the shape and density of the stable solid.

The waxy solid compositions include waxy solidification agent and any of a variety of cleaning agents. For example, the present solid compositions can include acidulant, antimicrobial agent (e.g., quaternary ammonium compound), alkalinity source, chelating agent, or combination thereof and water. Mixing of waxy solidification agent, alkalinity source, chelating agent, or combination thereof with water and other desired cleaning agents produces flowable waxy particles (e.g., a flowable waxy powder). Placing the flowable waxy particles into a form (e.g., a mold or container) and gently pressing and/or vibrating the waxy powder produces a stable solid.

Gently pressing refers to compressing the flowable waxy particles in a container in a manner that is effective to bring a sufficient quantity of particles (e.g., granules) of the flowable waxy particles into contact with one another. Vibrating refers to moving or imparting vibrational energy to the flowable waxy particles in a container in a manner that is effective to bring a sufficient quantity of particles (e.g., granules) of the flowable waxy particles into contact with one another. In the present method, pressing and vibrating refers to moving or imparting vibrational energy to and compressing the flowable waxy particles in a container in a manner that is effective to bring a sufficient quantity of particles (e.g., granules) of the flowable waxy particles into contact with one another. A sufficient quantity of particles (e.g. granules) in contact with one another provides binding of particles to one another effective for making a stable solid composition.

The method of the present invention can produce a stable solid without the high pressure compression employed in conventional tableting. A conventional tableting press applies pressures of at least about 5000 psi and even about 30,000-100,000 psi or more to a solid to produce a tablet. In contrast, the present method employs pressures on the solid of only less than or equal to about 1000 psi. In certain embodiments, the present method employs pressures of less than or equal to about 300 psi, less than or equal to about 200 psi, or less than or equal to about 100 psi. In certain embodiments, the present method can employ pressures as low as greater than or equal to about 1 psi, greater than or equal to about 2, greater than or equal to about 5 psi, or greater than or equal to about 10 psi.

The method of the present invention can produce a stable solid in any of a variety of sizes, including sizes larger than can be produced in a tableting press. A conventional tableting press can make only smaller solid products, for example, those smaller than a hockey puck (or smaller than about 600 g). The present method has been employed to produce a solid block weighing about 3 kg to about 6 kg, with a volume of, for example, 5 gal, or having dimensions of, for example, 6×6 inches or a paver-like slab 12 inches square. The present method employs a binding agent, not pressure, to provide a large stable solid.

The method of the present invention can produce a stable solid without employing a melt and solidification of the melt as in conventional casting. Forming a melt requires heating a composition to melt it. The heat can be applied externally or can be produced by a chemical exotherm (e.g., from mixing caustic (sodium hydroxide) and water). Heating a composition consumes energy. Handling a hot melt requires safety precautions and equipment. Further, solidification of a melt requires cooling the melt in a container to solidify the melt and form the cast solid. Cooling requires time and/or energy. In contrast, the present method can employ ambient temperature and humidity during solidification or curing of the present compositions. Caustic compositions made according to the present method produce only a slight temperature increase due to the exotherm. The solids of the present invention are held together not by solidification from a melt but by a binding agent produced in the flowable waxy particles and that is effective for producing a stable solid.

The method of the present invention can produce a stable solid without extruding to compress the mixture through a die. Conventional processes for extruding a mixture through a die to produce a solid cleaning composition apply high pressures to a solid or paste to produce the extruded solid. In contrast, the present method employs pressures on the solid of only less than or equal to about 1000 psi or even as little as 1 psi. The solids of the present invention are held together not by mere compression but by a binding agent produced in the flowable waxy particles and that is effective for producing a stable solid.

Any of a variety of flowable waxy particles can be used in the method of the present invention. For example, in an embodiment, the flowable waxy particles have a consistency similar to wet sand.

Methods of Making the Solid Cleaning Compositions

In some aspects, the present compositions can be vibrated and gently pressed in an apparatus that can form a concrete block, concrete paver, or other shaped concrete product. Such apparatus are known variously as a concrete block machine, a concrete product machine, a masonry product machine, or the like. Another configuration of such an apparatus is known variously as a hermetic press, tamping machine, brick press, turntable press, hydraulic press, or the like.

The method can include employing a concrete block machine to form the solid cleaning composition. The method can include providing the present flowable waxy particles. The flowable waxy particles are placed or provided in a drawer of the machine. The flowable waxy particles can be vibrated in the drawer. The flowable waxy particles are then transferred from the drawer into a form. Once in the form, the flowable waxy particles can be subjected to gently pressing, vibrating, or a combination thereof, in the form to produce the solid cleaning composition. The stable solid composition can then be removed from the form.

The concrete block machine can vibrate the composition in the mold or form at about 200 to about 6000 rpm, about 200 to about 300 rpm, about 2500 to about 3000 (e.g., 3100) rpm, about 1500 to about 3000 rpm, or about 3000 to about 6000 rpm.

The concrete block machine can vibrate the composition in the mold for about 1 to about 10 sec or about 1 to about 6 sec.

The concrete block machine can press the content of the mold or form with a force of about 1 to about 1000 psi, about 2 to about 300 psi, about 5 psi to about 200 psi, or about 10 psi to about 100 psi. In certain embodiments, the present method employs pressures of less than or equal to about 300 psi, less than or equal to about 200 psi, or less than or equal to about 100 psi. In certain embodiments, the present method can employ pressures as low as greater than or equal to about 1 psi, greater than or equal to about 2, greater than or equal to about 5 psi, or greater than or equal to about 10 psi.

The concrete block machine can vibrate the composition in the mold (and including the vibrating the form) at an excitation force (i.e., amplitude, centrifugal force) of, for example, about 2000 to about 6,500 lb, about 3000 to about 9000 lb, about 4000 to about 13,000 lb, or about 5000 to about 15,000 lb. In certain embodiments, the vibrational force can be about 2,000 lb, about 3,000 lb, about 4,000 lb, about 5,000 lb, about 6,000 lb, about 7,000 lb, about 8,000 lb, about 9,000 lb, about 10,000 lb, about 11,000 lb, about 12,000 lb, about 13,000 lb, about 14,000 lb, or about 15,000 lb.

In an embodiment, the method can include vibrating the drawer containing flowable waxy particles for about 1 to about 10 sec at about 200 to about 6,000 rpm. In an embodiment, the method can include vibrating the form containing flowable waxy particles for about 1 to about 10 sec at about 200 to about 6,000 rpm. In an embodiment, the method can include such vibrating and also include pressing on the flowable waxy particles in the form with a weight of about 100 to about 2000 lb.

The method employing the concrete products machine can include any of a variety of additional manipulations useful for forming the solid cleaning composition. For example, the method can include putting the flowable waxy particles into a hopper, and/or flowing or transporting the flowable waxy particles from the hopper into the drawer. The flowable waxy particles can flow from the hopper under the force of gravity into the drawer, or by being pushed into the hopper. If the hopper is positioned directly above the drawer, opening a portal on the bottom of the hopper can allow flowable waxy particles to drop into the drawer. Alternatively, the hopper can be positioned above a ramp and the flowable waxy particles can flow down the ramp and into the drawer.

The method can include vibrating and/or agitating the flowable waxy particles in the hopper, as it flows or drops from the hopper into the drawer, in the drawer as it is flowing into the drawer, once it is in the drawer, and any combination thereof.

The method includes transferring the flowable waxy particles from the drawer into the form. Transferring the flowable waxy particles from the drawer into the form can be accomplished by the force of gravity. For example, the drawer can be in a position (disposed) above the form. The bottom of the drawer can be configured to slide out or be moved laterally out from under the interior of the drawer. Thus, any flowable waxy particles in the drawer will fall into the form, e.g., the cavity or cavities of the form. The method can include providing the drawer disposed above the form, the drawer including a panel disposed between an interior of the drawer and the form. The method can include laterally moving the panel to a position not between the interior of the drawer and the form. Accordingly, the flowable waxy particles drops into the form.

The method can include vibrating the flowable waxy particles in the form, as it flows or drops from the drawer into the form, in the form as it is flowing into the form, once it is in the form, or any combination thereof. The method can include pressing the flowable waxy particles in the form (e.g., in the cavity or cavities of the form).

The pressed and/or vibrated flowable waxy particles can be removed from the form by any of a variety of methods. For example, removing the composition from the form can include raising the form with the composition remaining on a pallet that had formed the bottom of the form, or moving the pallet horizontally away from the drawer and form.

In short, the method can employ a drawer and form that are components of a concrete block machine. The concrete block machine can vibrate the flowable waxy particles in the drawer; transfer the flowable waxy particles from the drawer into a form, gently press the flowable waxy particles in the form to produce the solid cleaning composition, vibrate the flowable waxy particles to produce the solid cleaning composition, or combination thereof; and remove the solid cleaning composition from the form (i.e., move the form off of the composition).

Concrete Block Machine

Suitable concrete block machines include those manufactured by, for example, Columbia, Besser, Masa, Omag, or Quadra and having model numbers such as Columbia Model 15, 21, or 22; Besser SuperPac, BescoPac, or VibraPac; or Masa Extra-Large XL 6.0. These machines can produce, for example, 6-10 blocks of solid cleaning composition each weighing 1.5-3 kg in a single operation.

Referring now to FIG. 1, a concrete block machine 100 can include a drawer 1 configured to receive the flowable waxy particles and to drop the flowable waxy particles into a form 3. The form 3 can define one or a plurality of cavities 5 configured to provide the desired shape of the solid cleaning composition. For example, the form 3 can define cavity 5 with open top 7, form sides 9, and pallet 11.

Drawer 1 can include drawer sides 13 and bottom panel 15. Bottom panel 15 can be configured to be moved from beneath drawer sides 13. For example, bottom panel 15 can slideably engage drawer sides 13 so that bottom panel 15 be slid our from under drawer interior 17 defined by drawer sides 13. Concrete block machine 100 can be configured to position drawer 1 containing the present flowable waxy particles (not shown) over form 3. Concrete block machine 100 can be configured to slide bottom panel 15 out from under drawer interior 17. When drawer 1 containing the present flowable waxy particles is positioned over form 3 and bottom panel 15 is slid out from under drawer interior 17, the flowable waxy particles drops into cavity or cavities 5.

Concrete block machine 100 can also include vibration system 19. Vibration system 19 can include drawer vibrator 21. Drawer vibrator 21 can be configured to vibrate drawer 1 and any flowable waxy particles it contains. Drawer vibrator 21 can impart vibrational energy to the flowable waxy particles in the drawer. Drawer vibrator 21 can be configured to vibrate drawer 1 and its contents at a preselected frequency (rpm) and a preselected amplitude (centrifugal force). Vibration system 19 can include form vibrator 23. Form vibrator 23 can be configured to vibrate form 3 and any flowable waxy particles it contains. Form vibrator 23 can impart vibrational energy to the flowable waxy particles in the form. Drawer vibrator 23 can be configured to vibrate form 3 and its contents at a preselected frequency (rpm) and a preselected amplitude (centrifugal force).

Concrete block machine 100 can also include pressing system 25. Pressing system 25 can be configured to press flowable waxy particles in the cavity or cavities 5 of form 3. Pressing system can include, for example, a shoe or shoes 27 configured to be moved down onto flowable waxy particles in cavity or cavities 5. Pressing system 25 can be configured to press upon the flowable waxy particles in the cavity or cavities 5 of form 3 at a preselected pressure (psi).

Concrete block machine 100 can also include optional drawer transport 29 configured to move the drawer 1 with respect to the form 3. For example, drawer transport 29 can be configured to move drawer 1 from under a hopper 31 to over form 3. Alternatively, drawer 1 and hopper 31 can both be positioned over form 3. In such an embodiment, the drawer transport 29 may be absent of may be configured to move drawer 1 from over form 3, for example, for maintenance or other purposes. Hopper 31 can be configured to contain sufficient flowable waxy particles for repeatedly filling the drawer 1 and the cavity or cavities 5.

Concrete block machine 100 can also include form transport 33 configured to move the form 3 with respect to the drawer 1. For example, form transport 33 can be configured to move form 3 from under drawer 1 to a position at the exterior of machine 100. For example, form transport 33 can be configured to raise form sides 9 while leaving the solid composition on pallet 11. Pallet 11 can then be moved to the exterior of the machine 100 so that the solid composition can be removed from the machine.

Turntable Press

Suitable concrete block machines include those manufactured by, for example, Schauer & Haeberle, Masa, or the like and having model names such as Multi-System-Press 970, RECORD Power WP-06 4D, UNI-2000, WKP 1200 S, or the like. These machines can produce, for example, 6-10 blocks of solid cleaning composition each weighing 1.5-3 kg in a single operation.

Figure 2:
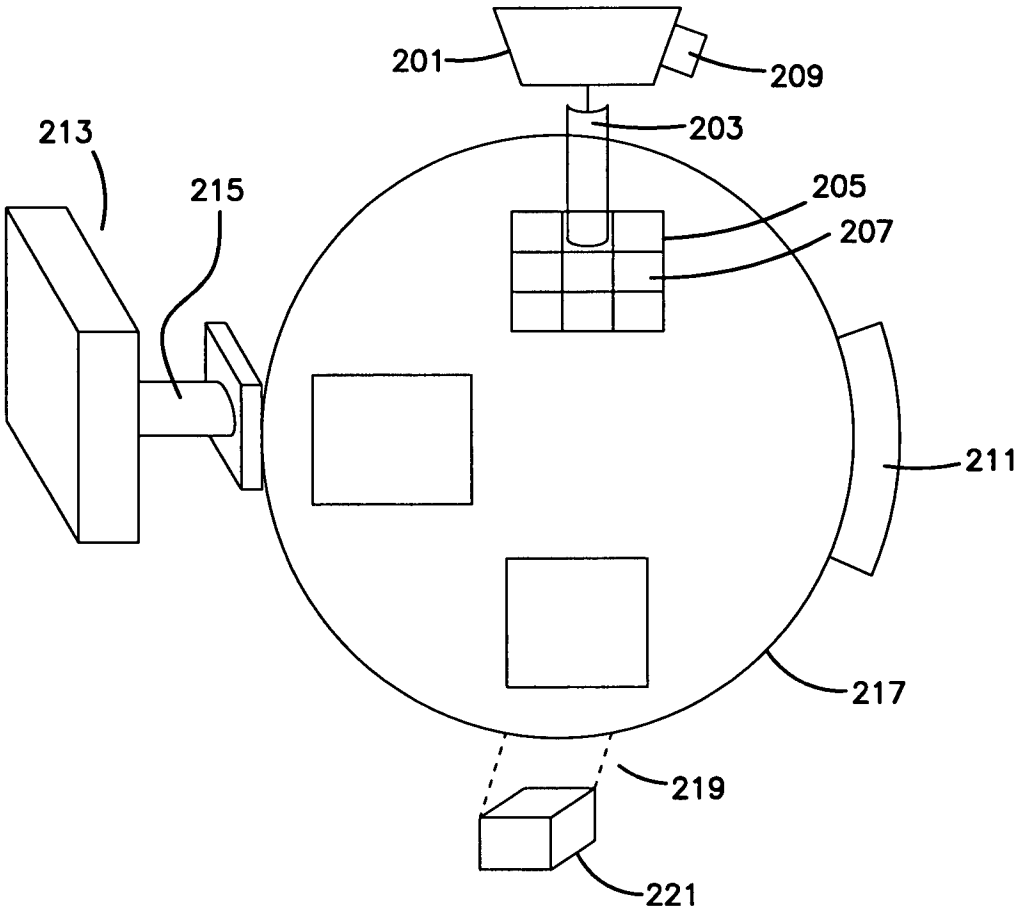
FIG. 2 schematically illustrates an apparatus suitable for gently pressing the present compositions, a turntable press.

Referring now to FIG. 2, a turntable press 200 can include a hopper 201 with chute 203 configured to receive the flowable solid and to drop the flowable solid into a mold 205. The mold 205 can define one or a plurality of chambers 207 configured to provide the desired shape of the solid cleaning composition. Turntable press 200 can include hopper vibrator 209 and/or mold vibrator 211 to vibrate the hopper and/or the mold, respectively, and any flowable solid that they might contain.

Turntable press 200 can impart vibrational energy to the flowable solid in the hopper 201. Hopper vibrator 209 can be configured to vibrate hopper 201 and its contents at a preselected frequency (rpm) and a preselected amplitude (centrifugal force). Mold vibrator 211 can impart vibrational energy to the flowable solid in the mold 205. Mold vibrator 211 can be configured to vibrate mold 205 and its contents at a preselected frequency (rpm) and a preselected amplitude (centrifugal force).

Turntable press 200 can also include press 213. Press 213 can be configured to press flowable solid in the mold 205 and any chamber or chambers 207 that might be in the mold 205. Press 213 can include, for example, a ram 215 configured to be moved down onto flowable solid in mold 205 and any chamber or chambers 207. Press 213 can be configured to press upon the flowable solid in the mold 205 and any chamber or chambers 207 at a preselected pressure (psi).

Turntable press 200 can also include turntable 217 configured to move the mold 205. For example, turntable 217 can be configured to move mold 205 from under chute 203 to a position under ram 215, and then, for example, to a unloading position 219, where the turntable pressed solid 221 can be removed from the apparatus.

In some aspects, the method for making a stable solid cleaning composition includes providing the flowable waxy particles including a solidification agent; and an ingredient selected from the group consisting of alkalinity source, acidulant, stabilized microbial or enzyme composition, surfactant, sequestrant, and mixtures thereof. The flowable waxy particles are transferred to a holding hopper. The holding hopper can include an agitation blade to prevent the waxy particles from solidifying or cementing while remaining in the holding hopper. The flowable waxy particles are then fed from the holding hopper into a run hopper. The run hopper can include an agitation blade to prevent the waxy particles from solidifying or cementing while residing in the run hopper. The flowable waxy particles are then transferred from the run hopper into a cavity on a load cell. Any desired amount of flowable particles can be placed into the cavity. The amount of flowable waxy particles placed into the cavity can be measured by the load cell. The flowable waxy particles are then subjected to gentle pressing, vibration, or a combination of both, in the cavity to produce the stable solid cleaning composition. The stable solid cleaning composition is then removed from the cavity.

Additional Methods for Pressing and/or Vibrating

The present solid composition can be made by an advantageous method of pressing and/or vibrating the solid composition. The method of pressing and/or vibrating the composition includes mixing the desired ingredients in the desired proportions, for example, with a ribbon or other known blender to form the flowable waxy particles. In an embodiment, the method then includes forming the solid cleaning composition from the mixed ingredients by placing the flowable waxy particles in a mold, pressing and/or vibrating the flowable waxy particles in the mold to form a stable solid composition, and recovering the composition from the mold.

Pressing can employ low pressures compared to conventional pressures used to form tablets or other conventional solid cleaning compositions. For example, in an embodiment, the present method employs a pressure on the solid of only less than or equal to about 1000 psi. In certain embodiments, the present method employs pressures of less than or equal to about 300 psi, less than or equal to about 200 psi, or less than or equal to about 100 psi. In certain embodiments, the present method can employ pressures as low as greater than or equal to about 1 psi, greater than or equal to about 2, greater than or equal to about 5 psi, or greater than or equal to about 10 psi. In certain embodiments, the present method can employ pressures of about 1 to about 1000 psi, about 2 to about 300 psi, about 5 psi to about 200 psi, or about 10 psi to about 100 psi. Such pressing is referred to herein as "gentle pressing."

In some embodiments, the solid compositions are formed by a method including vibrating. This embodiment includes forming the solid cleaning composition from the mixed ingredients by placing the flowable waxy particles in a mold, vibrating the mold containing the flowable waxy particles, vibrating the flowable waxy particles in the mold, vibrating the flowable waxy particles before or as it is put into the mold, or combination thereof to form the composition, and recovering the pressed and/or vibrated composition from the mold.

Vibrating can include any of a variety of methods for imparting vibrational energy to the mold of the mixed ingredients. For example, vibrating can include vibrating a plurality of molds containing the mixed ingredients on a platform. For example, vibrating can include inserting a vibrating probe into the mixed ingredients in the mold. For example, vibrating can include placing a vibrating surface or object onto the mixed ingredients in the mold.

Vibrating can also include vibrating the flowable waxy particles before or at substantially the same time as the flowable waxy particles are placed in the mold. The flowable waxy particles can be stored or provided as a quantity sufficient for producing hundreds or thousands of pounds of solid cleaning composition. For example, an amount of flowable waxy particles sufficient to fill several molds or forms can be placed in a container (e.g., a drawer) and vibrated in the container. The flowable waxy particles can be vibrated as it is moved (e.g., dropped) from the container into the mold or form.

Vibrating effective for forming the present solids includes vibrating at about 200 to about 6000 rpm, about 200 to about 300 rpm, about 2500 to about 3000 (e.g., 3100) rpm, about 1500 to about 3000 rpm, or about 3000 to about 6000 rpm.

Vibrating can be conducted for about 1 to about 10 sec or about 1 to about 6 sec. Suitable apparatus for vibrating the composition includes a concrete block machine or concrete products machine.

In certain embodiments, the vibration can be quantified as the amount of vibrational energy—centrifugal force—applied to the flowable waxy particles, mold or form, and moving parts of the apparatus. In certain embodiments, the amount of vibrational force is about 100 lb, about 200 lb, about 300 lb, about 400 lb, about 500 lb, about 600 lb, about 700 lb, about 800 lb, about 900 lb, or about 1,000. In certain embodiments, the amount of vibrational force is about 2,000 lb, about 3,000 lb, about 4,000 lb, about 5,000 lb, about 6,000 lb, about 7,000 lb, about 8,000 lb, about 9,000 lb, about 10,000 lb, about 11,000 lb, about 12,000 lb, about 13,000 lb, about 14,000 lb, or about 15,000 lb. In certain embodiments, the amount of vibrational force is about 100 lb, about 200 lb, about 300 lb, about 400 lb, about 500 lb, about 600 lb, about 700 lb, about 800 lb, about 900 lb, about 1,000, about 1,500 lb, about 2,000 lb, about 3,000 lb, about 4,000 lb, about 5,000 lb, about 6,000 lb, about 7,000 lb, about 8,000 lb, about 9,000 lb, about 10,000 lb, about 11,000 lb, about 12,000 lb, about 13,000 lb, about 14,000 lb, or about 15,000 lb. Employing a concrete products machine, the amount of vibrational force applied to the flowable waxy particles, mold or form, and moving parts of the machine can be about 2000 to about 6,500 lb, about 3000 to about 9000 lb, about 4000 to about 13,000 lb, or about 5000 to about 15,000 lb.

The mold can be coated with a release layer to ease release of the solid composition from the mold.

The method can operate on any of a variety of waxy compositions. The composition can be, for example, a flowable waxy powder or a waxy paste. Suitable flowable waxy powders include a waxy powder and a wetted waxy powder. The method can operate on a waxy composition that can flow or be dropped into and fill the mold.

Solid Cleaning Compositions

In some aspects, the present invention provides solid cleaning compositions including a waxy solidification agent, and other ingredients. Some examples of representative constituent concentrations for embodiments of the present compositions can be found in Table A, in which the values are given in wt-% of the ingredients in reference to the total composition weight. In certain embodiments, the proportions and amounts in Table A can be modified by "about".

TABLE A

| | (wt-%) | | | |
|---|---|---|---|---|
| Ingredient | A | B | C | D |
| Waxy solidification agent | 45 | 45 | 68 | 49-50 |
| Carbonate | | 9.5 | | |
| Citric Acid/Citrate | 35 | | | |
| amino carboxylate | | 20 | | |
| secondary alkalinity | | 0.5 | | |
| Quaternary ammonium antimicrobial agent | | | | 49-50 |
| Bicarbonate salt | | 5 | | |
| Amphoteric surfactant | | | 33 | |
| Nonionic Surfactant | 9.9 | 9.9 | | |
| Fatty acid salt | 9.9 | 9.9 | | |

The waxy solidification agent can be an anionic surfactant such as sodium alkyl benzene sulfonate alone or as a mixture with sodium laurel sulfate and/or sodium laurel ether sulfate. The waxy solidification agent can be urea.

The present solid product can be formulated with ingredients for use as, for example, an air freshener, a urinal block, a drain ring, or a laundry bar.

Solidification Agents

The waxy solid compositions can include a waxy solidification agent. The waxy solidification agent in the present compositions participates in maintaining the compositions in a solid form. Although other components of the solid composition may also be solids, the solidification agent can maintain the overall composition including solid and liquid components in a solid form. A waxy solidification agent can be a compound or system of compounds that significantly contributes to the uniform solidification of the composition. The waxy solidification agent should also be capable of forming a matrix with the cleaning agent and other ingredients when mixed and solidified to provide a uniform dissolution of the cleaning agent from the solid cleaning composition during use. The solidification agent can also provide cleaning power or antimicrobial activity to the composition.

The amount of solidification agent included in the solid cleaning composition will vary according to factors including, but not limited to: the type of solid cleaning composition being prepared, the ingredients of the solid cleaning composition, the intended use of the composition, the quantity of dispensing solution applied to the solid composition over time during use, the temperature of the dispensing solution, the hardness of the dispensing solution, the physical size of the solid cleaning composition, the concentration of the other ingredients, and the concentration of the cleaning agent in the composition. It is preferred that the amount of the solidification agent included in the solid cleaning composition is effective to combine with the cleaning agent and other ingredients of the composition to form a homogeneous mixture under continuous mixing conditions and a temperature at or below the melting temperature of the solidification agent.

The amount of the solidification agent included in the solid cleaning composition is effective to provide a desired hardness and desired rate of controlled solubility of the processed composition when placed in an aqueous medium to achieve a desired rate of dispensing the cleaning agent from the solidified composition during use. In some embodiments, the solidification agent can assist the source of alkalinity in maintaining the solid cleaning composition in solid form. In other embodiments, the solidification agent is compatible with the cleaning agent and other active ingredients of the composition and are capable of providing an effective amount of hardness and/or aqueous solubility to the processed composition.

Suitable waxy solidification agents include, but are not limited to: a solid polyethylene glycol (PEG); anionic surfactants; a solid EO/PO block copolymer, and the like; an amide, such as stearic monoethanolamide, lauric diethanolamide, an alkylamide, or the like; high melt alcohol ethoxylate (e.g., C12-C14 alcohol ethoxylate with 12, 14, 16, 18, or 20 mole ethoxylate, C12-15 alcohol ethoxylate with 20 mole ethoxylate, C14-15 alcohol ethoxylate with 13 mole ethoxylate, C6 alcohol ethoxylate with 20 mole ethoxylate), or the like; waxes, e.g., paraffin; other generally functional or inert materials with high melting points; and the like. Additional suitable solidification agents include EO/PO block copolymers such as those sold under the tradenames Pluronic 108, Pluronic F68; amides such as lauric diethanolamide or cocodiethylene amide; and the like.

Polyethylene Glycol

The waxy solidification agent may be an organic waxy solidification agent. A suitable organic solidification agent is a polyethylene glycol (PEG) compound. The solidification rate of solid cleaning compositions comprising a polyethylene glycol solidification agent will vary, at least in part, according to the amount and the molecular weight of the polyethylene glycol added to the composition. Examples of suitable polyethylene glycols include, but are not limited to: solid polyethylene glycols of the general formula $H(OCH_2CH_2)_nOH$, where n is greater than 15, particularly approximately 30 to approximately 1700. Typically, the polyethylene glycol is a solid in the form of a free-flowing powder or flakes, having a molecular weight of approximately 1,000 to approximately 100,000, particularly having a molecular weight of at least approximately 1,450 to approximately 20,000, more particularly between approximately 1,450 to approximately 8,000.

In some embodiments, the polyethylene glycol is present at a concentration of from approximately 1% to 75% by weight and particularly approximately 3% to approximately 15% by weight. Suitable polyethylene glycol compounds include PEG 4000, PEG 1450, and PEG 8000 among others. Certain embodiments employ PEG 4000 or PEG 8000. An example of a commercially available solid polyethylene glycol includes, but is not limited to: CARBOWAX, available from Union Carbide Corporation, Houston, Tex.

In certain embodiments, the solidification agent includes solid PEG, for example PEG 1500 up to PEG 20,000. In certain embodiments, the PEG includes PEG 1450, PEG 3350, PEG 4500, PEG 8000, PEG 20,000, and the like. In certain embodiments, the solidification agent includes a combination of solidification agents, such as combination of PEG and an EO/PO block copolymer (such as a Pluronic) and combination of PEG and an amide (such as lauric diethanol amide or stearic monoethanol amide).

Anionic Surfactant

The present composition can include an anionic surfactant as solidification agent. Suitable anionic surfactants include organic sulfonate surfactant, organic sulfate surfactant, phosphate ester surfactant, carboxylate surfactant, mixtures thereof, or the like. In an embodiment, the anionic surfactant includes alkyl sulfonate, alkylaryl sulfonate, alkylated diphenyl oxide disulfonate, alkylated naphthalene sulfonate, alcohol alkoxylate carboxylate, sarcosinate, taurate, acyl amino acid, alkanoic ester, phosphate ester, sulfuric acid ester, salt or acid form thereof, or mixture thereof. The particular salts will be suitably selected depending upon the particular formulation and the needs therein.

Suitable anionic surfactants include sulfonic acids (and salts), such as isethionates (e.g. acyl isethionates), alkylaryl sulfonic acids and salts thereof, alkyl sulfonates, and the like.

Examples of suitable synthetic, water soluble anionic cleaning compounds include the ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from about 5 to about 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives or their free acids. Suitable sulfonates include olefin sulfonates, such as long chain alkene sulfonates, long chain hydroxyalkane sulfonates or mixtures of alkenesulfonates and hydroxyalkanesulfonates.

In certain embodiments, the present compositions including an anionic surfactant, such as a normal C8 sulfonate, can be non-foam or low foam compositions. Such compositions can be advantageous for applications such as clean in place, machine warewashing, destaining, and sanitizing, laundry washing, destaining, and sanitizing, etc.

Anionic sulfate surfactants suitable for use in the present compositions include alkyl ether sulfates, alkyl sulfates, the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl)glucamine sulfates, and sulfates of alkylpolysaccharides such as the sulfates of alkylpolyglucoside, and the like. Also included are the alkyl sulfates, alkyl poly(ethyleneoxy)ether sulfates and aromatic poly(ethyleneoxy)sulfates such as the sulfates or condensation products of ethylene oxide and nonyl phenol (usually having 1 to 6 oxyethylene groups per molecule).

Urea

Urea particles can also be employed as solidification agents and/or hardeners in the solid cleaning compositions. The solidification rate of the compositions will vary, at least in part, to factors including, but not limited to: the amount, the particle size, and the shape of the urea added to the composition. For example, a particulate form of urea can be combined with a cleaning agent and other ingredients, and preferably a minor but effective amount of water. The amount and particle size of the urea is effective to combine with the cleaning agent and other ingredients to form a homogeneous mixture without the application of heat from an external source to melt the urea and other ingredients to a molten stage. It is preferred that the amount of urea included in the solid cleaning composition is effective to provide a desired hardness and desired rate of solubility of the composition when placed in an aqueous medium to achieve a desired rate of dispensing the cleaning agent from the solidified composition during use. In some embodiments, the composition includes between approximately 5% to approximately 90% by weight urea, particularly between approximately 8% and approximately 40% by weight urea, and more particularly between approximately 10% and approximately 30% by weight urea.

The urea may be in the form of prilled beads or powder. Prilled urea is generally available from commercial sources as a mixture of particle sizes ranging from about 8-15 U.S. mesh, as for example, from Arcadian Sohio Company, Nitrogen Chemicals Division. A prilled form of urea is preferably milled to reduce the particle size to about 50 U.S. mesh to about 125 U.S. mesh, particularly about 75-100 U.S. mesh, preferably using a wet mill such as a single or twin-screw extruder, a Teledyne mixer, a Ross emulsifier, and the like.

Source of Alkalinity

The solid cleaning composition according to the invention includes an effective amount of one or more alkaline sources to enhance cleaning of a substrate and improve soil removal performance of the composition. In general, an effective amount of one or more alkaline sources should be considered as an amount that provides a use composition having a pH of at least about 8. When the use composition has a pH of between about 8 and about 10, it can be considered mildly alkaline, and when the pH is greater than about 12, the use composition can be considered caustic. In general, it is desirable to provide the use composition as a mildly alkaline cleaning composition because it is considered to be safer than the caustic based use compositions.

The solid cleaning composition can include an alkali metal carbonate and/or an alkali metal hydroxide. Suitable metal carbonates that can be used include, for example, sodium or potassium carbonate, bicarbonate, sesquicarbonate, mixtures thereof. Suitable alkali metal hydroxides that can be used include, for example, sodium, lithium, or potassium hydroxide. An alkali metal hydroxide can be added to the composition in the form of solid beads, dissolved in an aqueous solution, or a combination thereof. Alkali metal hydroxides are commercially available as a solid in the form of prilled solids or beads having a mix of particle sizes ranging from about 12-100 U.S. mesh, or as an aqueous solution, as for example, as a 50 wt-% and a 73 wt-% solution.

The solid cleaning composition can include a sufficient amount of the alkaline source to provide the use composition with a pH of at least about 8. The source of alkalinity is preferably in an amount to enhance the cleaning of a substrate and improve soil removal performance of the composition. In general, it is expected that the concentrate will include the alkaline source in an amount of at least about 5 wt-%, at least about 10 wt-%, or at least about 15 wt-%. The solid cleaning composition can include between about 10 wt-% and about 80 wt-%, preferably between about 15 wt-% and about 70 wt-%, and even more preferably between about 20 wt-% and about 60 wt-% of the source of alkalinity. The source of alkalinity can additionally be provided in an amount to neutralize the anionic surfactant and can be used to assist in the solidification of the composition.

In order to provide sufficient room for other components in the concentrate, the alkaline source can be provided in the concentrate in an amount of less than about 60 wt-%. In addition, the alkaline source can be provided at a level of less than about 40 wt-%, less than about 30 wt-%, or less than about 20 wt-%. In certain embodiments, it is expected that the solid cleaning composition can provide a use composition that is useful at pH levels below about 8. In such compositions, an alkaline source can be omitted, and additional pH adjusting agents can be used to provide the use composition with the desired pH. Accordingly, it should be understood that the source of alkalinity can be characterized as an optional component.

For compositions including carboxylate as a component of the binding agent, the solid cleaning composition can include about 75 wt-%, less than about 60 wt-%, less than about 40 wt-%, less than about 30 wt-%, or less than about 20 wt-%. The alkalinity source may constitute about 0.1 to about 90 wt-%, about 0.5 to about 80 wt-%, or about 1 to about 60 wt-% of the total weight of the solid cleaning composition.

Secondary Alkalinity Sources

In some embodiments, a solid of the present invention can include effective amounts of one or more inorganic detergents or alkaline sources to enhance cleaning of a substrate and improve soil removal performance of the composition. As discussed above, in embodiments including an alkali metal salt, such as alkali metal carbonate, the alkali metal salt can act as an alkalinity source. The composition may include a secondary alkaline source separate from the source of alkalinity, and that secondary source can include about 0 to 75 wt-%, about 0.1 to 70 wt-% of, 1 to 25 wt-%, or about 20 to 60 wt-%, or 30 to 70 wt-% of the total composition.

Additional alkalinity sources can include, for example, inorganic alkalinity sources, such as an alkali metal hydroxide or silicate, or the like. Suitable alkali metal hydroxides include, for example, sodium or potassium hydroxide. An alkali metal hydroxide may be added to the composition in a variety of forms, including for example in the form of solid beads, dissolved in an aqueous solution, or a combination thereof. Alkali metal hydroxides are commercially available as a solid in the form of prilled solids or beads having a mix of particle sizes ranging from about 12-100 U.S. mesh, or as an aqueous solution, as for example, as a 50 wt-% and a 73 wt-% solution.

Examples of useful alkaline metal silicates include sodium or potassium silicate (with a $M_2O:SiO_2$ ratio of 1:2.4 to 5:1, M representing an alkali metal) or metasilicate.

Other sources of alkalinity include a metal borate such as sodium or potassium borate, and the like; ethanolamines and amines; and other like alkaline sources.

Organic Sequestrant

Suitable organic sequestrant includes organic phosphonate, aminocarboxylic acid, or mixtures thereof.

Organic Phosphonate

Appropriate organic phosphonates include those that are suitable for use in forming the solidified composition with the source of alkalinity and water. Organic phosphonates include organic-phosphonic acids, and alkali metal salts thereof. Some examples of suitable organic phosphonates include: 1-hydroxyethane-1,1-diphosphonic acid: $CH_3C(OH)[PO(OH)_2]_2$; aminotri(methylenephosphonic acid): $N[CH_2PO(OH)_2]_3$; aminotri(methylenephosphonate), sodium salt

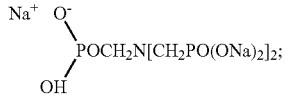

2-hydroxyethyliminobis(methylenephosphonic acid): $HOCH_2CH_2N[CH_2PO(OH)_2]_2$; diethylenetriaminepenta(methylenephosphonic acid): $(HO)_2POCH_2N[CH_2CH_2N[CH_2PO(OH)_2]_2]_2$; diethylenetriaminepenta(methylenephosphonate), sodium salt: $C_9H_{(28-x)}N_3Na_xO_{15}P_5$ (x=7); hexamethylenediamine(tetramethylenephosphonate), potassium salt: $C_{10}H_{(28-x)}N_2K_xO_{12}P_4$ (x=6); bis(hexamethylene)triamine(pentamethylenephosphonic acid): $(HO_2)POCH_2N[(CH_2)_6N[CH_2PO(OH)_2]_2]_2$; and phosphorus acid $H_3PO_3$; and other similar organic phosphonates, and mixtures thereof.

These materials are well known sequestrants, but have not been reported as components in a solidification complex material including an source of alkalinity.

Suitable organic phosphonate combinations include ATMP and DTPMP. A neutralized or alkaline phosphonate, or a combination of the phosphonate with an alkali source prior to being added into the mixture such that there is little or no heat or gas generated by a neutralization reaction when the phosphonate is added is suitable.

Aminocarboxylic Acid

The organic sequestrant can also include aminocarboxylic acid type sequestrant. Appropriate aminocarboxylic acid type sequestrants include those that are suitable for use in forming the solidified composition with the source of alkalinity and water. Aminocarboxylic acid type sequestrant can include the acids, or alkali metal salts thereof. Some examples of aminocarboxylic acid materials include amino acetates and salts thereof. Some examples include the following: N-hydroxyethylaminodiacetic acid; hydroxyethylenediaminetetraacetic acid, nitrilotriacetic acid (NTA); ethylenediaminetetraacetic acid (EDTA); N-hydroxyethyl-ethylenediaminetriacetic acid (HEDTA); diethylenetriaminepentaacetic acid (DTPA); and alanine-N,N-diacetic acid; and the like; and mixtures thereof.

In an embodiment, the organic sequestrant includes a mixture or blend including two or more organophosphonate compounds, or including two or more aminoacetate compounds, or including at least one organophosphonate and an aminoacetate compound.

Useful aminocarboxylic acids include, for example, n-hydroxyethyliminodiacetic acid, nitrilotriacetic acid (NTA), ethylenediaminetetraacetic acid (EDTA), N-hydroxyethyl-ethylenediaminetriacetic acid (HEDTA), diethylenetriaminepentaacetic acid (DTPA), and the like.

Useful aminocarboxylic acid materials containing little or no NTA and no phosphorus include: N-hydroxyethylaminodiacetic acid, ethylenediaminetetraacetic acid (EDTA), hydroxyethylenediaminetetraacetic acid, diethylenetriaminepentaacetic acid, N-hydroxyethyl-ethylenediaminetriacetic acid (HEDTA), diethylenetriaminepentaacetic acid (DTPA), and other similar acids having an amino group with a carboxylic acid substituent.

Examples of suitable biodegradable aminocarboxylates include: ethanoldiglycine, e.g., an alkali metal salt of ethanoldiglycine, such at disodium ethanoldiglycine ($Na_2EDG$); methylgylcinediacetic acid, e.g., an alkali metal salt of methylgylcinediacetic acid, such as trisodium methylgylcinediacetic acid; iminodisuccinic acid, e.g., an alkali metal salt of iminodisuccinic acid, such as iminodisuccinic acid sodium salt; N,N-bis(carboxylatomethyl)-L-glutamic acid (GLDA), e.g., an alkali metal salt of N,N-bis(carboxylatomethyl)-L-glutamic acid, such as iminodisuccinic acid sodium salt ($GLDA\text{-}Na_4$); [S—S]-ethylenediaminedisuccinic acid (EDDS), e.g., an alkali metal salt of [S—S]-ethylenediaminedisuccinic acid, such as a sodium salt of [S—S]-ethylenediaminedisuccinic acid; 3-hydroxy-2,2'-iminodisuccinic acid (HIDS), e.g., an alkali metal salt of 3-hydroxy-2,2'-iminodisuccinic acid, such as tetrasodium 3-hydroxy-2,2'-iminodisuccinate.

Examples of suitable commercially available biodegradable aminocarboxylates include: Versene HEIDA (52%), available from Dow Chemical, Midland, Mich.; Trilon M (40% MGDA), available from BASF Corporation, Charlotte, N.C.; IDS, available from Lanxess, Leverkusen, Germany; Dissolvine GL-38 (38%), available from Akzo Nobel, Tarrytown, N.J.; Octaquest (37%), available from; and HIDS (50%), available from Innospec Performance Chemicals (Octel Performance Chemicals), Edison, N.J.

Acidulant

In an embodiment, the present composition includes an acidulant. The acidulant can be a solid acid. The acidulant can be effective to form a use composition with pH of about 5, about 5 or less, about 4, about 4 or less, about 3, about 3 or less, about 2, about 2 or less, or the like. In an embodiment, the acidulant includes an inorganic acid. Suitable inorganic acids include sulfuric acid, phosphoric acid, nitric acid, hydrochloric acid, sulfamic acid, mixtures thereof, or the like. In an embodiment, the acidulant includes a carboxylic acid with $pK_a$ less than 4. Suitable carboxylic acids with $pK_a$ less than 4 include hydroxyacetic acid, hydroxypropionic acid, other hydroxycarboxylic acids, mixtures thereof, or the like. Additional suitable carboxylic acids include diacids. Suitable organic acids include methane sulfonic acid, ethane sulfonic acid, propane sulfonic acid, butane sulfonic acid, xylene sulfonic acid, benzene sulfonic acid, mixtures thereof, or the like. Suitable organic acids include acetic acid, hydroxyacetic acid, citric acid, tartaric acid and the like. Acidulants found useful include organic and inorganic acids such as citric acid, lactic acid, acetic acid, glycolic acid, adipic acid, tartaric acid, succinic acid, propionic acid, maleic acid, alkane sulfonic acids, cycloalkane sulfonic acids, as well as phosphoric acid and the like or mixtures thereof.

Water

A solid cleaning composition can include water. Water can be independently added to the cleaning composition or can be provided in the composition as a result of its presence in an aqueous material that is added to the composition. Typically, water is introduced into the cleaning composition to provide the cleaning composition with a desired flowability prior to solidification and to provide a desired rate of solidification. In certain embodiments of the solid cleaning composition, water can be present at about 0 to about 10 wt-%, about 0.1 to about 10 wt-%, about 2 to about 10 wt-%, about 1 to about 5 wt-%, or about 2 to about 3 wt-%.

Solid Compositions Including A Stabilized Microbial Preparation and/or Enzyme

The present solid composition can include a borate salt and spores (bacterial or fungal), vegetative bacteria, fungi, or enzyme. The present solid composition can include, for example, solidification agent and stabilized microbial preparation. The present solid composition can include, for example, solidification agent and stabilized enzyme preparation. The present solid composition can include, for example, solidification agent, stabilized microbial preparation, and stabilized enzyme preparation (e.g., stabilized microbial and enzyme preparation). The present composition can also include one or more of surfactant or surfactant blend, chelating agent, sodium carbonate, or other ingredients useful for cleaning. The present invention also includes methods of using these compositions.

The present composition can provide advantageous stability of spores (bacterial or fungal), vegetative bacteria, fungi, or enzyme. In an embodiment, the present solid including borate salt can provide advantageous stability of the spores (bacterial or fungal), vegetative bacteria, fungi, or enzyme in the solid composition. For example, the solid can retain acceptable levels (e.g., ≥70% initial activity) of active/living spores (bacterial or fungal), vegetative bacteria, fungi, or enzyme for one year, two years, or longer.

The present solid composition can include a stabilized microbial preparation including a borate salt and microbe. The microbe can be in the form of spores (bacterial or fungal), vegetative bacteria, or fungi. The microbial preparation can include, for example, spores or spore blend that can digest or degrade soils such as grease, oils (e.g., vegetable oils or animal fat), protein, carbohydrate, or the like. The microbial preparation can also produce enzymes that aid in the degradation of soils such as grease, oil, fat, protein, carbohydrate, or the like. The borate salt can include any of a variety of salts of boric acid, for example, alkali metal salts or alkanol amine salts. The boric acid salt can provide a source of alkalinity for a solid cleaning composition including the stabilized microbial preparation.

In an embodiment, the present stabilized microbial preparation is a component of a cleaning composition. Although not limiting to the present invention, the microbial preparation can be viewed as a source of detersive enzyme in the cleaning composition. Such a cleaning composition can also include additional enzymes, not produced by the microbial preparation in situ. The microbial preparation can produce, for example, enzymes such as proteases, lipases, and/or amylases. The composition can also include other added enzymes, such as, for example, proteases, lipases, and/or amylases. Although not limiting to the present invention, the added enzymes can be viewed as providing immediate cleaning upon application of the cleaning composition, and the microbial preparation can be viewed as providing persistent cleaning as the microbes remain on the article being cleaned, even after rinsing.

Most cleaners can only provide soil removal which is actually just moving the soil from one surface or location (e.g., a floor) to another (e.g., a drain). In certain embodiments, cleaning compositions including the present stabilized microbial preparation can provide both soil removal and persistent soil reduction, through persistent enzymatic breakdown of soils.

The present solid composition can include a stabilized enzyme preparation including a borate salt and enzyme. The enzyme can be a detersive enzyme. The enzyme preparation can include, for example, enzyme or enzyme blend that can digest or degrade soils such as grease, oils (e.g., vegetable oils or animal fat), protein, carbohydrate, or the like. The borate salt can include any of a variety of salts of boric acid, for example, alkali metal salts or alkanol amine salts. The boric acid salt can provide a source of alkalinity for a cleaning composition including the stabilized enzyme preparation.

Solid cleaning compositions including the present stabilized enzyme or microbial preparations can be used for a variety of purposes, including as a floor cleaner, as a grout cleaner, as a combination floor and drain cleaner and degreaser/grease digester, as a grease digester in grease traps, for effluent and/or wastewater treatment (e.g., reduction of fats, oils, and greases), in municipal waste treatment, as a grease digester in rendering plants, or for black and gray water treatment on cruise ships.

Without wishing to be bound by any particular theory, it is thought that the present stable solid cleaning compositions including microbial or enzyme compositions can break down grease or oil on a surface. Breaking down the grease or oil can release other soil stuck in the grease or oil. Accordingly, the present solid composition can clean a surface. In an embodiment, the present invention includes a method including repeating application of the present solid stable microbial or enzyme composition. For example, the present method can include daily application. Application for five to 21 days, or even in certain circumstances 5-14 days, can clean a lightly soiled surface. Application for three to six weeks can clean a heavily soiled surface.

In certain embodiments, the compositions of the present invention can be described by the ingredients and amounts listed in the tables below. The ingredients of the stabilized microbial composition and/or the stabilized enzyme composition are not listed in the tables below, but are described herein. The amounts or ranges in these tables can also be modified by about.

TABLE B

| Embodiments of Solid Composition | | | | |
|---|---|---|---|---|
| Ingredient | wt-% | wt-% | wt-% | wt-% |
| Solidification Agent | 10-50 | 15-30 | 20-25 | 23 |
| Stabilized Microbial or Enzyme Composition | 1-40 | 2-20 | 5-15 | 9 |

TABLE B-continued

| Embodiments of Solid Composition | | | | |
|---|---|---|---|---|
| Ingredient | wt-% | wt-% | wt-% | wt-% |
| Surfactant | 1-70 | 2-60 | 50-55 | 52 |
| Optional Chelating Agent | 1-20 | 1-15 | 2-10 | 5 |

TABLE C

| Embodiments of Solid Composition | | | | | |
|---|---|---|---|---|---|
| Ingredient | wt-% | wt-% | wt-% | wt-% | wt-% |
| Solidification Agent | 5-50 | 10-25 | 15-20 | 18-19 | 18 |
| Stabilized Microbial or Enzyme Composition | 2-40 | 20-40 | 25-35 | 30 | 30 |
| Surfactant | 0.5-70 | 35-60 | 40-55 | 40-41 | 52 |

TABLE D

| Embodiments of Solid Composition | | | |
|---|---|---|---|
| Ingredient | wt-% | wt-% | wt-% |
| Solidification Agent | 20-80 | 50-70 | 55-65 |
| Stabilized Microbial or Enzyme Composition | 1-35 | 10-15 | 13 |
| Surfactant | 0.1-70 | 1-10 | 2-9 |

TABLE E

| Embodiments of Solid Composition | | | | | |
|---|---|---|---|---|---|
| Ingredient | | wt-% | wt-% | wt-% | wt-% |
| Solidification Agent | PEG | 5-25 | 10-15 | 5-10 | 9 |
| | Acid Salt(s) (e.g., sodium acetate, $MgSO_4$) | 5-25 | 10-20 | 10-15 | 14 |
| Stabilized Microbial or Enzyme Composition | Borate | 2-30 | 2-20 | 2-10 | 5 |
| | Alkanol Amine | 1-10 | 1-10 | 2-8 | 4 |
| | Optional Spore | 1-10 | 1-10 | 2-8 | 4 |
| | Enzyme | 2-15 | 2-15 | 5-10 | 6 |
| Surfactant | Nonionic | 1-25 | 5-15 | 5-10 | 15 |
| | Anionic | 1-70 | 30-50 | 35-45 | 41 |
| Chelating Agent | EDTA | 0-20 | 1-15 | 0-10 | 5 |

TABLE F

| Embodiments of Solid Composition | | | | | |
|---|---|---|---|---|---|
| Ingredient | | wt-% | wt-% | wt-% | wt-% |
| Solidification Agent | PEG | 10-30 | 15-20 | 18 | 18 |
| Stabilized Microbial or Enzyme Composition | Borate | 10-25 | 15-20 | 17 | 18 |
| | Alkanol Amine | 1-20 | 5-10 | 6 | 10 |
| | Spore | 1-10 | 2-6 | 3 | 4 |
| | Enzyme | 1-10 | 2-6 | 3 | 8 |
| Surfactant | Nonionic | 10-45 | 20-30 | 24 | 24 |
| | Silicone | 1-20 | 2-10 | 4 | 4 |
| | Amphoteric | 2-20 | 5-10 | 8 | 8 |

Microbial Preparations

Any of a variety of spores (bacterial or fungal), vegetative bacteria, or fungi can be employed in the present solid cleaning compositions including stabilized bacterial compositions. For example, the present solid composition can include any viable microorganism or mixture thereof that can survive the formulation and the intended use environment or that can digest, degrade, or promote the degradation of lipids, proteins, carbohydrates, other organic matter, or the like common to domestic, institutional, and industrial soil or effluent, or the like. Many suitable strains and species are known.

Suitable spores (bacterial or fungal), vegetative bacteria, or fungi include *Bacillus, Pseudomonas, Arthrobacter, Enterobacter, Citrobacter, Corynebacter, Nitrobacter*, mixtures thereof, or the like; *Acinetobacter, Aspergillus, Azospirillum, Burkholderia, Ceriporiopsis, Escherichia, Lactobacillus, Paenebacillus, Paracoccus, Rhodococcus, Syphingomonas, Streptococcus, Thiobacillus, Trichoderma, Xanthomonas, Lactobacillus, Nitrosomonas, Alcaliaens, Klebsiella*, mixtures thereof, or the like; mixtures thereof, or the like.

Suitable *Bacillus* include *Bacillus licheniformis, Bacillus subtilis, Bacillus polymyxa*, mixtures thereof, or the like; *Bacillus methanolicus, Bacillus amyloliquefaciens, Bacillus pasteurii, Bacillus laevolacticus, Bacillus megaterium*, mixtures thereof, or the like; mixtures thereof, or the like. Suitable *Pseudomonas* include *Pseudomonas aeruginosa, Pseudomonas alkanolytica, Pseudomonas dentrificans*, mixtures thereof, or the like. Suitable *Arthrobacter* include *Arthrobacter paraffineus, Arthrobacter petroleophagus, Arthrobacter rubellus, Arthrobacter* sp., mixtures thereof, or the like. Suitable *Enterobacter* include *Enterobacter cloacae, Enterobacter* sp., mixtures thereof, or the like. Suitable *Citrobacter* include *Citrobacter amalonaticus, Citrobacter freundi*, mixtures thereof, or the like. Suitable *Corynebacterium* include *Corynebacterium alkanum, Corynebacterium fujiokense, Corynebacterium hydrocarbooxydano, Corynebacterium* sp. mixtures thereof, or the like.

Suitable spores (bacterial or fungal), vegetative bacteria, or fungi include those with ATCC accession nos. 21417, 21424, 27811, 39326, 6051a, 21228, 21331, 35854, 10401, 12060, 21551, 21993, 21036, 29260, 21034, 13867, 15590, 21494, 21495, 21908, 962, 15337, 27613, 33241, 25405, 25406, 25407, 29935, 21194, 21496, 21767, 53586, 55406, 55405, 55407, 23842, 23843, 23844, 23845, 6452, 6453, 11859, 23492, mixtures thereof, or the like.

Suitable microorganisms that can be used in the present invention include those disclosed in U.S. Pat. Nos. 4,655,794, 5,449,619, and 5,863,882; and U.S. Patent Application Publication Nos. 20020182184, 20030126688, and 20030049832; the disclosures of which are incorporated herein by reference.

Suitable spores (bacterial or fungal), vegetative bacteria, or fungi are commercially available from a variety of sources (e.g., Sybron Chemicals, Inc., Semco Laboratories, Inc., or Novozymes). Tradenames for such products include SPORZYME® 1B, SPORZYME® Ultra Base 2, SPORZYME® EB, SPORZYME® BCC, SPORZYME® WC Wash, SPORZYME® FE, BI-CHEM® MSB, BI-CHEM® Purta Treat, BI-CHEM® BDO, BI-CHEM® SANI-BAC®, BI-CHEM® BIO-SCRUB®, BI-CHEM® GC600L®, BI-CHEM® Bioclean, GREASE GUARD®, or the like.

In an embodiment, the spores (bacterial or fungal), vegetative bacteria, or fungi include strains of *Bacillus* specifically adapted for high production of extracellular enzymes, particularly proteases, amylases and cellulases. Such strains are common in waste treatment products. This mixture can include *Bacillus licheniformis, Bacillus subtilis*, and *Bacillus polymyxa*. By way of further example, *Bacillus pasteurii* can exhibit high levels of lipase production; *Bacillus laevolacticus* can exhibit a faster germination cycle; *Bacillus amyloliquefaciens* can exhibit high levels of protease production.

Suitable concentrations for the spores (bacterial or fungal), vegetative bacteria, or fungi in the formula include about $1\times10^3$ to about $1\times10^9$ CFU/mL, about $1\times10^4$ to $1\times10^8$ CFU/mL, about $1\times10^5$ CFU/mL to $1\times10^7$ CFU/mL, or the like. Commercially available compositions of spores (bacterial or fungal), vegetative bacteria, or fungi can be employed in the present solid compositions at effective cleaning compositions, for example, about 0.5 to about 10 wt-%, about 1 to about 5 (e.g., 4) wt-%, about 2 to about 10 wt-%, about 1 to about 3 wt-%, about 2 wt-%, about 3 wt-%, or about 4 wt-%. The present solid composition can include these amounts or ranges not modified by about.

Enzymes

The present cleaning composition can include one or more enzymes, which can provide desirable activity for removal of protein-based, carbohydrate-based, or triglyceride-based stains from substrates; for cleaning, destaining, and presoaks. Although not limiting to the present invention, enzymes suitable for the present cleaning compositions can act by degrading or altering one or more types of soil residues encountered on a surface or textile thus removing the soil or making the soil more removable by a surfactant or other component of the cleaning composition. Both degradation and alteration of soil residues can improve detergency by reducing the physicochemical forces which bind the soil to the surface or textile being cleaned, i.e. the soil becomes more water soluble. For example, one or more proteases can cleave complex, macromolecular protein structures present in soil residues into simpler short chain molecules which are, of themselves, more readily desorbed from surfaces, solubilized or otherwise more easily removed by detersive solutions containing said proteases.

Suitable enzymes include a protease, an amylase, a lipase, a gluconase, a cellulase, a peroxidase, or a mixture thereof of any suitable origin, such as vegetable, animal, bacterial, fungal or yeast origin. Preferred selections are influenced by factors such as pH-activity and/or stability optima, thermostability, and stability to active detergents, builders and the like. In this respect bacterial or fungal enzymes are preferred, such as bacterial amylases and proteases, and fungal cellulases. Preferably the enzyme is a protease, a lipase, an amylase, or a combination thereof.

"Detersive enzyme", as used herein, means an enzyme having a cleaning, destaining or otherwise beneficial effect as a component of a composition for laundry, textiles, warewashing, cleaning-in-place, drains, floors, carpets, medical or dental instruments, meat cutting tools, hard surfaces, personal care, or the like. Suitable detersive enzymes include a hydrolase such as a protease, an amylase, a lipase, or a combination thereof.

Enzymes are normally incorporated into a composition according to the invention in an amount sufficient to yield effective cleaning during a washing or presoaking procedure. An amount effective for cleaning refers to an amount that produces a clean, sanitary, and, preferably, corrosion free appearance to the material cleaned. An amount effective for cleaning also can refer to an amount that produces a cleaning, stain removal, soil removal, whitening, deodorizing, or freshness improving effect on substrates. Typically such a cleaning effect can be achieved with amounts of enzyme from about 0.1% to about 3% by weight, preferably about 1% to about 3% by weight, of the cleaning composition. Higher active levels may also be desirable in highly concentrated cleaning formulations.

Commercial enzymes, such as alkaline proteases, are obtainable in liquid or dried form, are sold as raw aqueous solutions or in assorted purified, processed and compounded forms, and include about 2% to about 80% by weight active enzyme generally in combination with stabilizers, buffers, cofactors, impurities and inert vehicles. The actual active enzyme content depends upon the method of manufacture and is not critical, assuming the composition has the desired enzymatic activity. The particular enzyme chosen for use in the process and products of this invention depends upon the conditions of final utility, including the physical product form, use pH, use temperature, and soil types to be digested, degraded, or altered. The enzyme can be chosen to provide optimum activity and stability for any given set of utility conditions.

The compositions of the present invention preferably include at least a protease. The composition of the invention has further been found, surprisingly, not only to stabilize protease for a substantially extended shelf life, but also to significantly enhance protease activity toward digesting proteins and enhancing soil removal. Further, enhanced protease activity occurs in the presence of one or more additional enzymes, such as amylase, cellulase, lipase, peroxidase, endoglucanase enzymes and mixtures thereof, preferably lipase or amylase enzymes.

The enzyme can be selected for the type of soil targeted by the cleaning composition or present at the site or surface to be cleaned. Although not limiting to the present invention, it is believed that amylase can be advantageous for cleaning soils containing starch, such as potato, pasta, oatmeal, baby food, gravy, chocolate, or the like. Although not limiting to the present invention, it is believed that protease can be advantageous for cleaning soils containing protein, such as blood, cutaneous scales, mucus, grass, food (e.g., egg, milk, spinach, meat residue, tomato sauce), or the like. Although not limiting to the present invention, it is believed that lipase can be advantageous for cleaning soils containing fat, oil, or wax, such as animal or vegetable fat, oil, or wax (e.g., salad dressing, butter, lard, chocolate, lipstick). Although not limiting to the present invention, it is believed that cellulase can be advantageous for cleaning soils containing cellulose or containing cellulose fibers that serve as attachment points for other soil.

The enzyme can include detersive enzyme. The detersive enzyme can include protease, amylase, lipase, cellulase, peroxidase, gluconase, or mixtures thereof. The detersive enzyme can include alkaline protease, lipase, amylase, or mixtures thereof.

A valuable reference on enzymes is "Industrial Enzymes", Scott, D., in *Kirk-Othmer Encyclopedia of Chemical Technology,* 3rd Edition, (editors Grayson, M. and EcKroth, D.) Vol. 9, pp. 173-224, John Wiley & Sons, New York, 1980.

Protease

A protease suitable for the composition of the present invention can be derived from a plant, an animal, or a microorganism. Preferably the protease is derived from a microorganism, such as a yeast, a mold, or a bacterium. Preferred proteases include serine proteases active at alkaline pH, preferably derived from a strain of *Bacillus* such as *Bacillus subtilis* or *Bacillus licheniformis*; these preferred proteases include native and recombinant subtilisins. The protease can be purified or a component of a microbial extract, and either wild type or variant (either chemical or recombinant). A preferred protease is neither inhibited by a metal chelating agent (sequestrant) or a thiol poison nor activated by metal ions or reducing agents, has a broad substrate specificity, is inhibited by diisopropylfluorophosphate (DFP), is an endopeptidase, has a molecular weight in the range of about 20,000 to about 40,000, and is active at a pH of about 6 to about 12 and at temperatures in a range from about 20° C. to about 80° C.

Examples of proteolytic enzymes which can be employed in the composition of the invention include (with trade names) Savinase®; a protease derived from *Bacillus lentus* type, such as Maxacal®, Opticlean®, Durazym®, and Properase®; a protease derived from *Bacillus licheniformis*, such as Alcalase® and Maxatase®; and a protease derived from *Bacillus amyloliquefaciens*, such as Primase®. Preferred commercially available protease enzymes include those sold under the trade names Alcalase®, Savinase®, Primase®, Durazym®, or Esperase® by Novo Industries A/S (Denmark); those sold under the trade names Maxatase®, Maxacal®, or Maxapem® by Gist-Brocades (Netherlands); those sold under the trade names Purafect®, Purafect OX, and Properase by Genencor International; those sold under the trade names Opticlean® or Optimase® by Solvay Enzymes; and the like. A mixture of such proteases can also be used. For example, Purafect® is a preferred alkaline protease (a subtilisin) for use in cleaning compositions of this invention having application in lower temperature cleaning programs, from about 30° C. to about 65° C.; whereas, Esperase® is an alkaline protease of choice for higher temperature detersive solutions, from about 50° C. to about 85° C. Suitable detersive proteases are described in patent publications including: GB 1,243,784, WO 9203529 A (enzyme/inhibitor system), WO 9318140 A, and WO 9425583 (recombinant trypsin-like protease) to Novo; WO 9510591 A, WO 9507791 (a protease having decreased adsorption and increased hydrolysis), WO 95/30010, WO 95/30011, WO 95/29979, to Procter & Gamble; WO 95/10615 (*Bacillus amyloliquefaciens* subtilisin) to Genencor International; EP 130,756 A (protease A); EP 303,761 A (protease B); and EP 130,756 A. A variant protease employed in the present solid compositions is preferably at least 80% homologous, preferably having at least 80% sequence identity, with the amino acid sequences of the proteases in these references.

In some embodiments, the amount of commercial alkaline protease present in the composition of the invention ranges from about 0.1% by weight of detersive solution to about 3% by weight, preferably about 1% to about 3% by weight, preferably about 2% by weight, of solution of the commercial enzyme product. Typical commercially available detersive enzymes include about 5-10% of active enzyme.

Whereas establishing the percentage by weight of commercial alkaline protease required is of practical convenience for manufacturing embodiments of the present teaching, variance in commercial protease concentrates and in-situ environmental additive and negative effects upon protease activity require a more discerning analytical technique for protease assay to quantify enzyme activity and establish correlations to soil residue removal performance and to enzyme stability within the preferred embodiment; and, if a concentrate, to use-dilution solutions. The activity of the proteases for use in the present invention are readily expressed in terms of activity units—more specifically, Kilo-Novo Protease Units (KNPU) which are azocasein assay activity units well known to the art. A more detailed discussion of the azocasein assay procedure can be found in the publication entitled "The Use of Azoalbumin as a Substrate in the Colorimetric Determination of Peptic and Tryptic Activity", Tomarelli, R. M., Charney, J., and Harding, M. L., *J. Lab. Clin. Chem.* 34, 428 (1949).

In some embodiments, the activity of proteases present in the use-solution ranges from about $1\times10^{-5}$ KNPU/gm solution to about $4\times10^{-3}$ KNPU/gm solution.

Mixtures of different proteolytic enzymes may be incorporated into this invention. While various specific enzymes have been described above, it is to be understood that any protease which can confer the desired proteolytic activity to the composition may be used and this embodiment of this invention is not limited in any way by specific choice of proteolytic enzyme.

Amylase

An amylase suitable for the composition of the present invention can be derived from a plant, an animal, or a microorganism. Preferably the amylase is derived from a microorganism, such as a yeast, a mold, or a bacterium. Preferred amylases include those derived from a *Bacillus*, such as *B. licheniformis, B. amyloliquefaciens, B. subtilis*, or *B. stearothermophilus*. The amylase can be purified or a component of a microbial extract, and either wild type or variant (either chemical or recombinant), preferably a variant that is more stable under washing or presoak conditions than a wild type amylase.

Examples of amylase enzymes that can be employed in the composition of the invention include those sold under the trade name Rapidase by Gist-Brocades® (Netherlands); those sold under the trade names Termamyl®, Fungamyl® or Duramyl® by Novo; Purastar STL or Purastar OXAM by Genencor; and the like. Preferred commercially available amylase enzymes include the stability enhanced variant amylase sold under the trade name Duramyl® by Novo. A mixture of amylases can also be used.

Amylases suitable for the compositions of the present invention include: α-amylases described in WO 95/26397, PCT/DK96/00056, and GB 1,296,839 to Novo; and stability enhanced amylases described in J. Biol. Chem., 260(11): 6518-6521 (1985); WO 9510603 A, WO 9509909 A and WO 9402597 to Novo; references disclosed in WO 9402597; and WO 9418314 to Genencor International. A variant α-amylase employed in the present solid compositions can be at least 80% homologous, preferably having at least 80% sequence identity, with the amino acid sequences of the proteins of these references.

Suitable amylases for use in the compositions of the present invention have enhanced stability compared to certain amylases, such as Termamyl®. Enhanced stability refers to a significant or measurable improvement in one or more of: oxidative stability, e.g., to hydrogen peroxide/tetraacetylethylenediamine in buffered solution at pH 9-10; thermal stability, e.g., at common wash temperatures such as about 60° C.; and/or alkaline stability, e.g., at a pH from about 8 to about 11; each compared to a suitable control amylase, such as Termamyl®. Stability can be measured by methods known to those of skill in the art. Suitable enhanced stability amylases for use in the compositions of the present invention have a specific activity at least 25% higher than the specific activity of Termamyl® at a temperature in a range of 25° C. to 55° C. and at a pH in a range of about 8 to about 10. Amylase activity for such comparisons can be measured by assays known to those of skill in the art and/or commercially available, such as the Phadebas® I-amylase assay.

In some embodiments, the amount of commercial amylase present in the composition of the invention ranges from about 0.1% by weight of detersive solution to about 3% by weight, preferably about 1% to about 3% by weight, preferably about 2% by weight, of solution of the commercial enzyme product. Typical commercially available detersive enzymes include about 0.25-5% of active amylase.

Whereas establishing the percentage by weight of amylase required is of practical convenience for manufacturing embodiments of the present teaching, variance in commercial amylase concentrates and in-situ environmental additive and negative effects upon amylase activity may require a more discerning analytical technique for amylase assay to quantify enzyme activity and establish correlations to soil residue removal performance and to enzyme stability within the embodiment; and, if a concentrate, to use-dilution solutions. The activity of the amylases for use in the present invention can be expressed in known units or through known amylase assays and/or commercially available assays, such as the Phadebas® α-amylase assay.

Mixtures of different amylase enzymes can be incorporated into this invention. While various specific enzymes have been described above, it is to be understood that any amylase which can confer the desired amylase activity to the composition can be used and this embodiment of this invention is not limited in any way by specific choice of amylase enzyme.

Cellulases

A cellulase suitable for the composition of the present invention can be derived from a plant, an animal, or a microorganism. The cellulase can be derived from a microorganism, such as a fungus or a bacterium. Suitable cellulases include those derived from a fungus, such as *Humicola insolens, Humicola* strain DSM1800, or a cellulase 212-producing fungus belonging to the genus *Aeromonas* and those extracted from the hepatopancreas of a marine mollusk, *Dolabella Auricula Solander*. The cellulase can be purified or a component of an extract, and either wild type or variant (either chemical or recombinant).

Examples of cellulase enzymes that can be employed in the composition of the invention include those sold under the trade names Carezyme® or Celluzyme® by Novo, or Cellulase by Genencor; and the like. A mixture of cellulases can also be used. Suitable cellulases are described in patent documents including: U.S. Pat. No. 4,435,307, GB-A-2.075.028, GB-A-2.095.275, DE-OS-2.247.832, WO 9117243, and WO 9414951 A (stabilized cellulases) to Novo.

In some embodiments, the amount of commercial cellulase present in the composition of the invention ranges from about 0.1% by weight of detersive solution to about 3% by weight, preferably about 1% to about 3% by weight, of solution of the commercial enzyme product. Typical commercially available detersive enzymes include about 5-10 percent of active enzyme.

Whereas establishing the percentage by weight of cellulase required is of practical convenience for manufacturing embodiments of the present teaching, variance in commercial cellulase concentrates and in-situ environmental additive and negative effects upon cellulase activity may require a more discerning analytical technique for cellulase assay to quantify enzyme activity and establish correlations to soil residue removal performance and to enzyme stability within the embodiment; and, if a concentrate, to use-dilution solutions. The activity of the cellulases for use in the present invention can be expressed in known units or through known or commercially available cellulase assays.

Mixtures of different cellulase enzymes can be incorporated into this invention. While various specific enzymes have been described above, it is to be understood that any cellulase which can confer the desired cellulase activity to the composition can be used and this embodiment of this invention is not limited in any way by specific choice of cellulase enzyme.

Lipases

A lipase suitable for the composition of the present invention can be derived from a plant, an animal, or a microorganism. In an embodiment, the lipase is derived from a microorganism, such as a fungus or a bacterium. Suitable lipases include those derived from a *Pseudomonas*, such as *Pseudomonas stutzeri* ATCC 19.154, or from a *Humicola*, such as *Humicola lanuginosa* (typically produced recombinantly in *Aspergillus oryzae*). The lipase can be purified or a component of an extract, and either wild type or variant (either chemical or recombinant).

Examples of lipase enzymes that can be employed in the composition of the invention include those sold under the trade names Lipase P "Amano" or "Amano-P" by Amano Pharmaceutical Co. Ltd., Nagoya, Japan or under the trade name Lipolase® by Novo, and the like. Other commercially available lipases that can be employed in the present solid compositions include Amano-CES, lipases derived from *Chromobacter viscosum*, e.g. *Chromobacter viscosum* var. *lipolyticum* NRRLB 3673 from Toyo Jozo Co., Tagata, Japan; *Chromobacter viscosum* lipases from U.S. Biochemical Corp., U.S.A. and Disoynth Co., and lipases derived from *Pseudomonas gladioli* or from *Humicola lanuginosa*.

A suitable lipase is sold under the trade name Lipolase® by Novo. Suitable lipases are described in patent documents including: WO 9414951 A (stabilized lipases) to Novo, WO 9205249, RD 94359044, GB 1,372,034, Japanese Patent Application 53,20487, laid open Feb. 24, 1978 to Amano Pharmaceutical Co. Ltd., and EP 341,947.

In an embodiment, the amount of commercial lipase present in the composition of the invention ranges from about 0.1% by weight of detersive solution to about 3% by weight, preferably about 1% to about 3% by weight, of solution of the commercial enzyme product. Typical commercially available detersive enzymes include about 5-10 percent of active enzyme.

Whereas establishing the percentage by weight of lipase required is of practical convenience for manufacturing embodiments of the present teaching, variance in commercial lipase concentrates and in-situ environmental additive and negative effects upon lipase activity may require a more discerning analytical technique for lipase assay to quantify enzyme activity and establish correlations to soil residue removal performance and to enzyme stability within the embodiment; and, if a concentrate, to use-dilution solutions. The activity of the lipases for use in the present invention can be expressed in known units or through known or commercially available lipase assays.

Mixtures of different lipase enzymes can be incorporated into this invention. While various specific enzymes have been described above, it is to be understood that any lipase which can confer the desired lipase activity to the composition can be used and this embodiment of this invention is not limited in any way by specific choice of lipase enzyme.

Additional Enzymes

Additional enzymes suitable for use in the present solid compositions include a cutinase, a peroxidase, a gluconase, and the like. Suitable cutinase enzymes are described in WO 8809367 A to Genencor. Known peroxidases include horseradish peroxidase, ligninase, and haloperoxidases such as chloro- or bromo-peroxidase. Peroxidases suitable for compositions are disclosed in WO 89099813 A and WO 8909813 A to Novo. Peroxidase enzymes can be used in combination with oxygen sources, e.g., percarbonate, perborate, hydrogen peroxide, and the like. Additional enzymes suitable for incorporation into the present solid composition are disclosed in WO 9307263 A and WO 9307260 A to Genencor International, WO 8908694 A to Novo, and U.S. Pat. No. 3,553,139 to McCarty et al., U.S. Pat. No. 4,101,457 to Place et al., U.S. Pat. No. 4,507,219 to Hughes and U.S. Pat. No. 4,261,868 to Hora et al.

An additional enzyme, such as a cutinase or peroxidase, suitable for the composition of the present invention can be derived from a plant, an animal, or a microorganism. Preferably the enzyme is derived from a microorganism. The enzyme can be purified or a component of an extract, and either wild type or variant (either chemical or recombinant). In preferred embodiments of this invention, the amount of commercial additional enzyme, such as a cutinase or peroxidase, present in the composition of the invention ranges from about 0.1% by weight of detersive solution to about 3% by weight, preferably about 1% to about 3% by weight, of solution of the commercial enzyme product. Typical commercially available detersive enzymes include about 5-10 percent of active enzyme.

Whereas establishing the percentage by weight of additional enzyme, such as a cutinase or peroxidase, required is of practical convenience for manufacturing embodiments of the present teaching, variance in commercial additional enzyme concentrates and in-situ environmental additive and negative effects upon their activity may require a more discerning analytical technique for the enzyme assay to quantify enzyme activity and establish correlations to soil residue removal performance and to enzyme stability within the embodiment; and, if a concentrate, to use-dilution solutions. The activity of the additional enzyme, such as a cutinase or peroxidase, for use in the present invention can be expressed in known units or through known or commercially available assays.

Naturally, mixtures of different additional enzymes can be incorporated into this invention. While various specific enzymes have been described above, it is to be understood that any additional enzyme which can confer the desired enzyme activity to the composition can be used and this embodiment of this invention is not limited in any way by specific choice of enzyme.

Enzyme Stabilizing System

The present solid compositions can also include ingredients to stabilize one or more enzymes. For example, the cleaning composition of the invention can include a water-soluble source of calcium and/or magnesium ions. Calcium ions are generally more effective than magnesium ions and are preferred herein if only one type of cation is being used. Compositions, especially liquids, can include from about 1 to about 30, preferably from about 2 to about 20, more preferably from about 8 to about 12 millimoles of calcium ion per liter of finished composition, though variation is possible depending on factors including the multiplicity, type and levels of enzymes incorporated. Preferably water-soluble calcium or magnesium salts are employed, including for example calcium chloride, calcium hydroxide, calcium formate, calcium malate, calcium maleate, calcium hydroxide and calcium acetate; more generally, calcium sulfate or magnesium salts corresponding to the listed calcium salts may be used. Further increased levels of calcium and/or magnesium may of course be useful, for example for promoting the grease-cutting action of certain types of surfactant.

Stabilizing systems of certain cleaning compositions, for example warewashing compositions, may further include from 0 to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme, for example during warewashing, can be relatively large; accordingly, enzyme stability to chlorine in-use can be problematic.

Suitable chlorine scavenger anions are widely known and readily available, and, if used, can be salts containing ammonium cations with sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used. Likewise, special enzyme inhibition systems can be incorporated such that different enzymes have maximum compatibility. Other conventional scavengers such as bisulfate, nitrate, chloride, sources of hydrogen peroxide such as sodium perborate tetrahydrate, sodium perborate monohydrate and sodium percarbonate, as well as phosphate, condensed phosphate, acetate, benzoate, citrate, formate, lactate, malate, tartrate, salicylate, etc., and mixtures thereof can be used if desired.

In general, since the chlorine scavenger function can be performed by ingredients separately listed under better recognized functions, there is no requirement to add a separate chlorine scavenger unless a compound performing that function to the desired extent is absent from an enzyme-containing embodiment of the invention; even then, the scavenger is added only for optimum results. Moreover, the formulator will exercise a chemist's normal skill in avoiding the use of any enzyme scavenger or stabilizer which is unacceptably incompatible, as formulated, with other reactive ingredients. In relation to the use of ammonium salts, such salts can be simply admixed with the composition but are prone to adsorb water and/or liberate ammonia during storage. Accordingly, such materials, if present, are desirably protected in a particle such as that described in U.S. Pat. No. 4,652,392, Baginski et al.

Boric Acid Salts

In some embodiments, the present invention relates to a solid cleaning composition including stable microbial cleaning compositions that employ one or more boric acid salts to provide improved stability of the microbial preparation, even at basic pH or in an aqueous concentrate prepared from the solid composition. Suitable boric acid salts can provide alkalinity. Such salts include alkali metal boric acid salts; amine boric acid salts, preferably alkanolamine boric acid salts; and the like; or a combination thereof. In certain embodiments, the boric acid salt includes potassium borate, monoethanolammonium borate, diethanolammonium borate, triethanolammonium borate, and the like, or a combination thereof. In an embodiment, the boric acid salt includes monoethanolamine borate.

The boric acid salt, e.g. potassium or monoethanolamine borate, can be obtained by any of a variety of routes. For example, commercially available boric acid salt, e.g. potassium borate, can be added to the composition. Alternatively, the boric acid salt, e.g. potassium or monoethanolamine borate, can be obtained by neutralizing boric acid with a base, e.g. a potassium containing base such as potassium hydroxide or a base such as monoethanolamine.

In certain embodiments, the boric acid salt is soluble in an aqueous concentrate prepared from the solid composition at concentrations in excess of 5 or 10 wt-%, e.g., in excess of 11, 12, 13, 14, 15, 16, 17, 18, 19, or 20 wt-%. In certain embodiments, the boric acid salt can be soluble in an aqueous concentrate prepared from the solid composition at concentrations up to 35 wt-%, e.g., up to 25, 30, or 35 wt-%. In certain embodiments, the boric acid salt can be soluble at 12-35 wt-%, 15-30 wt-%, or 20-25 wt-%, e.g., 20-25 wt-%. The present solid compositions can also include any of the quantities or ranges of boric acid salt modified by the term "about".

In some embodiments, alkanol amine borates, such as monoethanolamine borate, are soluble at concentrations larger than other boric acid salts, particularly sodium borate. Alkanol amine borates, such as monoethanolamine borate, can be employed and soluble in an aqueous concentrate prepared from the solid composition at concentrations listed above, preferably up to about 30 weight percent, preferably about 20 to about 25 weight percent. In an embodiment, this high solubility can be obtained at alkaline pH, such as pH about 9 to about 10.5.

In some embodiments, potassium borate is soluble at concentrations larger than other metal boric acid salts, particularly other alkali metal boric acid salts, particularly sodium borate. Potassium borate can be employed and soluble in an aqueous concentrate prepared from the solid composition at concentrations listed above, preferably up to about 25 weight percent, preferably about 15 to about 25 weight percent. In an embodiment, this high solubility can be obtained at alkaline pH, such as pH about 9 to about 10.5.

The boric acid salt can provide desirable increases in microbial preparation stability at basic pH compared to other buffer systems suitable for maintaining a pH above about 7, above about 8, about 8 to about 11, or about 9 to about 10.5. Maintaining alkaline pH can provide greater cleaning power.

In an embodiment, the present cleaning composition includes spore, bacteria, or fungi; and alkanol amine borate. In an embodiment, the composition can include ingredients that when dissolved as a use composition or concentrate composition provide a composition with pH greater than or equal to 9, e.g., about 9 to about 10.5. In an embodiment, the use or concentrate composition can have pH greater than or equal to 8, e.g., about 8 to about 9.5.

In certain embodiments, the present solid composition includes boric acid salt (e.g., alkanolamine borate, e.g., monoethanolamine borate or sodium borate) at about 2 wt-% to about 10 wt-%, at about 5 to about 35 wt-%, at about 5 wt-% to about 20 wt-%, at about 5 wt-% to about 15 wt-%, about 10 wt-% to about 30 wt-%, at about 10 to about 20 wt-%, or at about 25 wt-% to about 30 wt-%. In certain embodiments, borate salt is present at about 5 wt-%, at about 10 wt-%, at about 15 wt-%, at about 20 wt-%, at about 25 wt-%, or at about 30 wt-% of the composition. The present solid compositions can also include any of the quantities or ranges of monoethanolamine borate not modified by the term "about".

Additional Ingredients

Solid cleaning compositions made according to the invention may further include additional functional materials or additives that provide a beneficial property, for example, to the composition in solid form or when dispersed or dissolved in an aqueous solution, e.g., for a particular use. Examples of conventional additives include one or more of each of salt, alkalinity source, surfactant, detersive polymer, cleaning agent, rinse aid composition, softener, pH modifier, source of acidity, anti-corrosion agent, secondary hardening agent, solubility modifier, detergent builder, detergent filler, defoamer, anti-redeposition agent, antimicrobial, rinse aid composition, threshold agent or system, aesthetic enhancing agent (i.e., dye, odorant, perfume), optical brightener, lubricant composition, bleaching agent or additional bleaching agent, enzyme, effervescent agent, activator for the source of alkalinity, other such additives or functional ingredients, and the like, and mixtures thereof. The present solid product can be formulated with ingredients for use as, for example, an air freshener, a urinal block, a drain ring, or a laundry bar.

Adjuvants and other additive ingredients will vary according to the type of composition being manufactured, and the intended end use of the composition. In certain embodiments, the composition includes as an additive one or more of source of alkalinity, surfactant, detergent builder, cleaning enzyme, detersive polymer, antimicrobial, activators for the source of alkalinity, or mixtures thereof.

In embodiments including a stabilized microbial preparations suitable additional ingredients can include hydrotrope, chelating agent, divalent cation, polyol, antimicrobial agent, aesthetic enhancing agent, preservative, or the like. In certain embodiments, the composition can also include an effective amount of one or more antimicrobials; an effective amount of one or more chelating agents; or mixtures thereof. The composition can include about 0.1 to 30 wt-% of chelating agent. The chelating agent can include small or polymeric compound having carboxyl group, or mixtures thereof. In certain embodiments, the composition can also include source of calcium ions, polyol, builder, dye, or a combination or mixture thereof.

Divalent Ion

The cleaning compositions of the invention can contain a divalent ion, such as calcium and magnesium ions, at a level of from 0.05% to 5% by weight, from 0.1% to 1% by weight, or about 0.25% by weight of the composition. In an embodiment, calcium ions can be included in the present solid compositions. The calcium ions can, for example, be added as a chloride, hydroxide, oxide, formate or acetate, or nitrate, preferably chloride, salt.

In some embodiments, the cleaning compositions include magnesium ions. The magnesium ion source can be a water insoluble magnesium ion source, a water soluble magnesium ion source, and combinations thereof. Exemplary cleaning compositions including soluble and insoluble magnesium ion sources are described for example, in U.S. patent application Ser. Nos. 12/114,327; 12/114,385; 12/114,355; 12/114,486; 12/114,513; 12/114,342; 12/114,329; and 12/114,364, each of which is hereby incorporated by reference.

Polyol

The solid cleaning compositions can also include a polyol. The polyol can, for example, provide additional stability and hydrotrophic properties to the composition. Suitable polyols include glycerin; glycols, such as ethylene glycol, propylene glycol, or hexylene glycol; sorbitol; alkyl polyglycosides; and mixtures thereof. In some embodiments, the polyol includes propylene glycol.

Suitable alkyl polyglycosides for use as polyols according to the invention include those with the formula:

$$(G)_x\text{-O—R}$$

in which G is a moiety derived from reducing saccharide containing 5 or 6 carbon atoms, e.g., pentose or hexose, R is a fatty aliphatic group containing 6 to 20 carbon atoms, and x is the degree of polymerization (DP) of the polyglycoside representing the number of monosaccharide repeating units in the polyglycoside. Preferably, x is about 0.5 to about 10. In an embodiment, R contains 10-16 carbon atoms and x is 0.5 to 3.

In some embodiments, the polyol can be in the form of a polyether. Suitable polyethers include polyethylene glycols. Suitable polyethers include those listed below as solvent or co-solvent.

In certain embodiments, the present solid composition includes about 2 to about 30 wt-% polyol, about 2 to about 10 wt-% polyol, about 5 to about 20 wt-% polyol, about 5 to about 10 wt-% polyol, or about 10 to about 20 wt-% polyol. In certain embodiments, the present stabilized microbial preparations include about 2 to about 40 wt-% polyol, about 2 to about 20 wt-% polyol, about 2 to about 15 wt-% polyol, about 2 to about 10 wt-% polyol, about 3 to about 10 wt-% polyol, about 4 to about 15 wt-% polyol, or about 4 to about 8 wt-% polyol, about 4 wt-% polyol, about 8 wt-% polyol, or about 12 wt-% polyol. The composition can include any of these ranges or amounts not modified by about.

Metal Protecting Silicate

An effective amount of an alkaline metal silicate or hydrate thereof can be employed in the compositions and processes of the invention to form a stable solid cleaning composition that can have metal protecting capacity. The silicates employed in the compositions of the invention are those that have conventionally been used in warewashing formulations. For example, typical alkali metal silicates are those waxy powdered, particulate or granular silicates which are either anhydrous or preferably which contain water of hydration (5 to 25 wt %, preferably 15 to 20 wt % water of hydration). These silicates can be sodium silicates and have a $Na_2O:SiO_2$ ratio of about 1:1 to about 1:5, respectively, and typically contain available bound water in the amount of from 5 to about 25 wt %. In general, the silicates of the present invention have a $Na_2O:SiO_2$ ratio of 1:1 to about 1:3.75, preferably about 1:1.5 to about 1:3.75 and most preferably about 1:1.5 to about 1:2.5. A silicate with a $Na_2O:SiO_2$ ratio of about 1:2 and about 16 to 22 wt % water of hydration is suitable.

For example, such silicates are available in waxy powder form as GD Silicate and in granular form as Britesil H-20, from PQ Corporation. These ratios may be obtained with single silicate compositions or combinations of silicates which upon combination result in the preferred ratio. The hydrated silicates at preferred ratios, a $Na_2O:SiO_2$ ratio of about 1:1.5 to about 1:2.5 have been found to provide the optimum metal protection and rapidly forming solid block cleaning. The amount of silicate used in forming the compositions of the invention tend to vary between 10 and 30 wt %, preferably about 15 to 30 wt % depending on degree of hydration. Hydrated silicates are preferred.

Suitable silicates for use in the present compositions include sodium silicate, anhydrous sodium metasilicate, and anhydrous sodium silicate.

Salt

In some embodiments, salts, for example acidic salts, can be included as pH modifiers, sources of acidity, effervescing aids, or other like uses. Some examples of salts for use in such applications include sodium bisulfate, sodium acetate, sodium bicarbonate, citric acid salts, and the like and mixtures thereof. The composition can include in the range of 0.1 to 50 wt-% such material. It should be understood that agents other than salts that act as pH modifiers, sources of acidity, effervescing aids, or like, can also be used in conjunction with the invention.

Exemplary salts for use in the composition include, but are not limited to, sodium acetate, sodium sulfate, magnesium sulfate anhydrous, magnesium sulfate heptahydrate, sodium citrate dehydrate, and magnesium chloride.

Active Oxygen Compounds

The active oxygen compound acts to provide a source of active oxygen, but can also act to form at least a portion of the solidification or binding agent. The active oxygen compound can be inorganic or organic, and can be a mixture thereof. Some examples of active oxygen compound include peroxygen compounds, and peroxygen compound adducts that are suitable for use in forming the binding agent.

Many active oxygen compounds are peroxygen compounds. Any peroxygen compound generally known and that can function, for example, as part of the binding agent can be used. Examples of suitable peroxygen compounds include inorganic and organic peroxygen compounds, or mixtures thereof.

Inorganic Active Oxygen Compound

Examples of inorganic active oxygen compounds include the following types of compounds or sources of these compounds, or alkali metal salts including these types of compounds, or forming an adduct therewith: hydrogen peroxide; group 1 (IA) active oxygen compounds, for example lithium peroxide, sodium peroxide, and the like; group 2 (IIA) active oxygen compounds, for example magnesium peroxide, calcium peroxide, strontium peroxide, barium peroxide, and the like; group 12 (IIB) active oxygen compounds, for example zinc peroxide, and the like; group 13 (IIIA) active oxygen compounds, for example boron compounds, such as perborates, for example sodium perborate hexahydrate of the formula $Na_2[Br_2(O_2)_2(OH)_4].6H_2O$ (also called sodium perborate tetrahydrate and formerly written as $NaBO_3.4H_2O$); sodium peroxyborate tetrahydrate of the formula $Na_2Br_2(O_2)_2[(OH)_4].4H_2O$ (also called sodium perborate trihydrate, and formerly written as $NaBO_3.3H_2O$); sodium peroxyborate of the formula $Na_2[B_2(O_2)_2(OH)_4]$ (also called sodium perborate monohydrate and formerly written as $NaBO_3.H_2O$); and the like; e.g., perborate; group 14 (IVA) active oxygen compounds, for example persilicates and peroxycarbonates, which are also called percarbonates, such as persilicates or peroxycarbonates of alkali metals; and the like; e.g., percarbonate, e.g., persilicate; group 15 (VA) active oxygen compounds, for example peroxynitrous acid and its salts; peroxyphosphoric acids and their salts, for example, perphosphates; and the like; e.g., perphosphate; group 16 (VIA) active oxygen compounds, for example peroxysulfuric acids and their salts, such as peroxymonosulfuric and peroxydisulfuric acids, and their salts, such as persulfates, for example, sodium persulfate; and the like; e.g., persulfate; group VIIa active oxygen compounds such as sodium periodate, potassium perchlorate and the like.

Other active inorganic oxygen compounds can include transition metal peroxides; and other such peroxygen compounds, and mixtures thereof.

In certain embodiments, the compositions and methods of the present invention employ certain of the inorganic active oxygen compounds listed above. Suitable inorganic active oxygen compounds include hydrogen peroxide, hydrogen peroxide adduct, group IIIA active oxygen compounds, group VIA active oxygen compound, group VA active oxygen compound, group VIIA active oxygen compound, or mixtures thereof. Examples of such inorganic active oxygen compounds include percarbonate, perborate, persulfate, perphosphate, persilicate, or mixtures thereof. Hydrogen peroxide presents an example of an inorganic active oxygen compound. Hydrogen peroxide can be formulated as a mixture of hydrogen peroxide and water, e.g., as liquid hydrogen peroxide in an aqueous solution. The mixture of solution can include about 5 to about 40 wt-% hydrogen peroxide or 5 to 50 wt-% hydrogen peroxide.

In an embodiment, the inorganic active oxygen compounds include hydrogen peroxide adduct. For example, the inorganic active oxygen compounds can include hydrogen peroxide, hydrogen peroxide adduct, or mixtures thereof. Any of a variety of hydrogen peroxide adducts are suitable for use in the present compositions and methods. For example, suitable hydrogen peroxide adducts include percarbonate salt, urea peroxide, peracetyl borate, an adduct of $H_2O_2$ and polyvinyl pyrrolidone, sodium percarbonate, potassium percarbonate, mixtures thereof, or the like. Suitable hydrogen peroxide adducts include percarbonate salt, urea peroxide, peracetyl borate, an adduct of $H_2O_2$ and polyvinyl pyrrolidone, or mixtures thereof. Suitable hydrogen peroxide adducts include sodium percarbonate, potassium percarbonate, or mixtures thereof, e.g., sodium percarbonate.

Organic Active Oxygen Compound

Any of a variety of organic active oxygen compounds can be employed in the compositions and methods of the present invention. For example, the organic s active oxygen compound can be a peroxycarboxylic acid, such as a mono- or di-peroxycarboxylic acid, an alkali metal salt including these types of compounds, or an adduct of such a compound. Suitable peroxycarboxylic acids include $C_1$-$C_{24}$ peroxycarboxylic acid, salt of $C_1$-$C_{24}$ peroxycarboxylic acid, ester of $C_1$-$C_{24}$ peroxycarboxylic acid, diperoxycarboxylic acid, salt of diperoxycarboxylic acid, ester of diperoxycarboxylic acid, or mixtures thereof.

Suitable peroxycarboxylic acids include $C_1$-$C_{10}$ aliphatic peroxycarboxylic acid, salt of $C_1$-$C_{10}$ aliphatic peroxycarboxylic acid, ester of $C_1$-$C_{10}$ aliphatic peroxycarboxylic acid, or mixtures thereof; e.g., salt of or adduct of peroxyacetic acid; e.g., peroxyacetyl borate. Suitable diperoxycarboxylic acids include $C_4$-$C_{10}$ aliphatic diperoxycarboxylic acid, salt of $C_4$-$C_{10}$ aliphatic diperoxycarboxylic acid, or ester of $C_4$-$C_{10}$ aliphatic diperoxycarboxylic acid, or mixtures thereof; e.g., a sodium salt of perglutaric acid, of persuccinic acid, of peradipic acid, or mixtures thereof.

Organic active oxygen compounds include other acids including an organic moiety. Suitable organic active oxygen compounds include perphosphonic acids, perphosphonic acid salts, perphosphonic acid esters, or mixtures or combinations thereof.

Active Oxygen Compound Adducts

Active oxygen compound adducts include any generally known and that can function, for example, as a source of active oxygen and as part of the solidified composition. Hydrogen peroxide adducts, or peroxyhydrates, are suitable. Some examples of source of alkalinity adducts include the following: alkali metal percarbonates, for example sodium percarbonate (sodium carbonate peroxyhydrate), potassium percarbonate, rubidium percarbonate, cesium percarbonate, and the like; ammonium carbonate peroxyhydrate, and the like; urea peroxyhydrate, peroxyacetyl borate; an adduct of $H_2O_2$ polyvinyl pyrrolidone, and the like, and mixtures of any of the above.

Chelating/Sequestering Agents

Chelating/sequestering agents can be added to the composition and are useful for their sequestering properties. In general, a chelating/sequestering agent is a molecule capable of coordinating (i.e., binding) the metal ions commonly found in natural water to prevent the metal ions from interfering with the action of the other detersive ingredients of a cleaning composition. The chelating/sequestering agent may also function as a threshold agent when included in an effective amount. In certain embodiments, a cleaning composition includes about 0.1-70 wt-% or about 5-60 wt-%, of a chelating/sequestering agent. Examples of chelating/sequestering agents include aminocarboxylic acids, condensed phosphates, polymeric polycarboxylates, and the like.

Examples of condensed phosphates include sodium and potassium orthophosphate, sodium and potassium pyrophosphate, sodium and potassium tripolyphosphate, sodium hexametaphosphate, and the like. A condensed phosphate may also assist, to a limited extent, in solidification of the composition by fixing the free water present in the composition as water of hydration.

Water conditioning polymers can be used as non-phosphorus containing builders. Suitable water conditioning polymers include, but are not limited to: polycarboxylates. Suitable polycarboxylates that can be used as builders and/or water conditioning polymers include, but are not limited to: those having pendant carboxylate ($—CO_2^-$) groups such as polyacrylic acid, maleic acid, maleic/olefin copolymer, sulfonated copolymer or terpolymer, acrylic/maleic copolymer, polymethacrylic acid, acrylic acid-methacrylic acid copolymers, hydrolyzed polyacrylamide, hydrolyzed polymethacrylamide, hydrolyzed polyamide-methacrylamide copolymers, hydrolyzed polyacrylonitrile, hydrolyzed polymethacrylonitrile, and hydrolyzed acrylonitrile-methacrylonitrile copolymers. For a further discussion of chelating agents/sequestrants, see Kirk-Othmer, Encyclopedia of Chemical Technology, Third Edition, volume 5, pages 339-366 and volume 23, pages 319-320, the disclosure of which is incorporated by reference herein. These materials may also be used at substoichiometric levels to function as crystal modifiers In an embodiment, organic sequestrants include amino tri(methylene phosphonic) acid, 1-hydroxyethylidene-1,1-diphosphonic acid, diethylenetriaminepenta(methylene phosphonic) acid, alanine-N,N-diacetic acid, diethylenetriaminepentaacetic acid, or alkali metal salts thereof, or mixtures thereof. In this embodiment, alkali metal salts include sodium, potassium, calcium, magnesium, or mixtures thereof. The organic sequestrant can include one or more of 1-hydroxyethylidene-1,1-diphosphonic acid; or diethylenetriaminepenta(methylene phosphonic) acid; or alanine-N,N-diacetic acid; or diethylenetriaminepentaacetic acid.

For compositions including a carboxylate as a component of the binding agent, suitable levels of addition for builders that can also be chelating or sequestering agents are about 0.1 to about 70 wt-%, about 1 to about 60 wt-%, or about 1.5 to about 50 wt-%. The solid detergent can include about 1 to about 60 wt-%, about 3 to about 50 wt-%, or about 6 to about 45 wt-% of the builders. Additional ranges of the builders include about 3 to about 20 wt-%, about 6 to about 15 wt-%, about 25 to about 50 wt-%, or about 35 to about 45 wt-%.

Glass and Metal Corrosion Inhibitors

The solid cleaning composition can include a metal corrosion inhibitor in an amount up to about 50 wt-%, about 1 to about 40 wt-%, or about 3 to about 30 wt-%. The corrosion inhibitor is included in the solid cleaning composition in an amount sufficient to provide a use solution that exhibits a rate of corrosion and/or etching of glass that is less than the rate of corrosion and/or etching of glass for an otherwise identical use solution except for the absence of the corrosion inhibitor. The use solution will include at least about 6 parts per million (ppm) of the corrosion inhibitor to provide desired corrosion inhibition properties. Larger amounts of corrosion inhibitor can be used in the use solution without deleterious effects. However, at a certain point, the additive effect of increased corrosion and/or etching resistance with increasing corrosion inhibitor concentration will be lost, and additional corrosion inhibitor will simply increase the cost of using the solid cleaning composition. The use solution can include about 6 ppm to about 300 ppm of the corrosion inhibitor or about 20 ppm to about 200 ppm of the corrosion inhibitor. Examples of suitable corrosion inhibitors include, but are not limited to: a combination of a source of aluminum ion and a source of zinc ion, as well as an alkaline metal silicate or hydrate thereof.

The corrosion inhibitor can refer to the combination of a source of aluminum ion and a source of zinc ion. The source of aluminum ion and the source of zinc ion provide aluminum ion and zinc ion, respectively, when the solid cleaning composition is provided in the form of a use solution. The amount of the corrosion inhibitor is calculated based upon the combined amount of the source of aluminum ion and the source of zinc ion. Anything that provides an aluminum ion in a use solution can be referred to as a source of aluminum ion, and anything that provides a zinc ion when provided in a use solution can be referred to as a source of zinc ion. It is not necessary for the source of aluminum ion and/or the source of zinc ion to react to form the aluminum ion and/or the zinc ion. Aluminum ions can be considered a source of aluminum ion, and zinc ions can be considered a source of zinc ion. The source of aluminum ion and the source of zinc ion can be provided as organic salts, inorganic salts, and mixtures thereof. Suitable sources of aluminum ion include, but are not limited to: aluminum salts such as sodium aluminate, aluminum bromide, aluminum chlorate, aluminum chloride, aluminum iodide, aluminum nitrate, aluminum sulfate, aluminum acetate, aluminum formate, aluminum tartrate, aluminum lactate, aluminum oleate, aluminum bromate, aluminum borate, aluminum potassium sulfate, aluminum zinc sulfate, and aluminum phosphate. Suitable sources of zinc ion include, but are not limited to: zinc salts such as zinc chloride, zinc sulfate, zinc nitrate, zinc iodide, zinc thiocyanate, zinc fluorosilicate, zinc dichromate, zinc chlorate, sodium zincate, zinc gluconate, zinc acetate, zinc benzoate, zinc citrate, zinc lactate, zinc formate, zinc bromate, zinc bromide, zinc fluoride, zinc fluorosilicate, and zinc salicylate.

Controlling the ratio of the aluminum ion to the zinc ion in the use solution, it is possible to provide reduced corrosion and/or etching of glassware and ceramics compared with the use of either component alone. That is, the combination of the aluminum ion and the zinc ion can provide a synergy in the reduction of corrosion and/or etching. The ratio of the source of aluminum ion to the source of zinc ion can be controlled to provide a synergistic effect. In general, the weight ratio of aluminum ion to zinc ion in the use solution can be at least about 6:1, can be less than about 1:20, and can be about 2:1 and about 1:15.

An effective amount of an alkaline metal silicate or hydrate thereof can be employed in the compositions and processes of the invention to form a stable solid cleaning composition having metal protecting capacity. The silicates employed in the compositions of the invention are those that have conventionally been used in solid cleaning formulations. For example, typical alkali metal silicates are those waxy powdered, particulate or granular silicates which are either anhydrous or preferably which contain water of hydration (about 5% to about 25 wt-%, about 15% to about 20 wt-% water of hydration). These silicates are preferably sodium silicates and have a $Na_2O:SiO_2$ ratio of about 1:1 to about 1:5, respectively, and typically contain available water in the amount of from about 5% to about 25 wt-%. In general, the silicates have a $Na_2O:SiO_2$ ratio of about 1:1 to about 1:3.75, about 1:1.5 to about 1:3.75 and most about 1:1.5 to about 1:2.5. A silicate with a $Na_2O:SiO_2$ ratio of about 1:2 and about 16% to about 22 wt-% water of hydration, is most preferred. For example, such silicates are available in waxy powder form as GD Silicate and in granular form as Britesil H-20, available from PQ Corporation, Valley Forge, Pa. These ratios may be obtained with single silicate compositions or combinations of silicates which upon combination result in the preferred ratio. The hydrated silicates at preferred ratios, a $Na_2O:SiO_2$ ratio of about 1:1.5 to about 1:2.5, have been found to provide the optimum metal protection and rapidly form a solid cleaning agent. Hydrated silicates are preferred.

Silicates can be included in the solid detergent composition to provide for metal protection but are additionally known to provide alkalinity and additionally function as anti-redeposition agents. Suitable silicates include, but are not limited to: sodium silicate and potassium silicate. The solid cleaning composition can be provided without silicates, but when silicates are included, they can be included in amounts that provide for desired metal protection. The composition can include silicates in amounts of at least about 1 wt-%, at least about 5 wt-%, at least about 10 wt-%, and at least about 15 wt-%. In addition, in order to provide sufficient room for other components in the composition, the silicate component can be provided at a level of less than about 35 wt-%, less than about 25 wt-%, less than about 20 wt-%, or less than about 15 wt-%.

Antimicrobial Agent

Antimicrobial agents are chemical compositions that can be used in a solid functional material that alone, or in combination with other components, act to reduce or prevent microbial contamination and deterioration of commercial products material systems, surfaces, etc. In some aspects, these materials fall in specific classes including phenolics, halogen compounds, quaternary ammonium compounds, metal derivatives, amines, alkanol amines, nitro derivatives, analides, organosulfur and sulfur-nitrogen compounds and miscellaneous compounds.

In certain embodiments, the present composition can include antimicrobial agent. For example, a composition including an enzyme can include any of a variety of antimicrobial agents compatible with the enzyme and enzyme activity. For example, a composition including a spore can include any of a variety of antimicrobial agents compatible with the spore. The antimicrobial agent can be selected to persist for a shorter time than the spore. After the antimicrobial agent is sufficiently gone, the spore can germinate to form microbes without the microbe being killed or inhibited by the antimicrobial agent. For example, a composition including a microbe can include an antimicrobial agent ineffective against that microbe.

Any of a variety of suitable antimicrobial agents can be employed at effective antimicrobial concentration. Antimicrobial agents include active oxygen compounds (e.g., hydrogen peroxide, percarbonate, perborate, and the like), halogen containing compounds, amine or quaternary ammonium compounds, or the like. Suitable antimicrobial agents include aliphatic amine, ether amine or diamine. Common antimicrobial agents include phenolic antimicrobials such as pentachlorophenol, orthophenylphenol, a chloro-p-benzylphenol, p-chloro-m-xylenol. Halogen containing antibacterial agents include sodium trichloroisocyanurate, sodium dichloro isocyanate (anhydrous or dihydrate), iodine-poly (vinylpyrolidinone) complexes, bromine compounds such as 2-bromo-2-nitropropane-1,3-diol, and quaternary antimicrobial agents such as benzalkonium chloride, didecyldimethyl ammonium chloride, choline diiodochloride, tetramethyl phosphonium tribromide. Other antimicrobial compositions such as hexahydro-1,3,5-tris(2-hydroxyethyl)-s-triazine, dithiocarbamates such as sodium dimethyldithiocarbamate, and a variety of other materials are known in the art for their anti-microbial properties. In some embodiments, an antimicrobial component, such as TAED can be included in the range of 0.001 to 75 wt-% of the composition, about 0.01 to 20 wt-%, or about 0.05 to about 10 wt-%.

In an embodiment, the present composition can include an effective amount (e.g., antimicrobial amount) of ether amine of Formula 1:

$$R_1—O—R_2—NH_2;$$

of Formula 2:

$$R_1—O—R_2—NH—R_3—NH_2;$$

or mixtures thereof. In Formula 1 and Formula 2 (independently) $R_1$ can be a linear saturated or unsaturated $C_6$-$C_{18}$ alkyl, $R_2$ can be a linear or branched $C_1$-$C_8$ alkyl, and $R_3$ can be a linear or branched $C_1$-$C_8$ alkyl. In an embodiment, $R_1$ is a linear $C_{12}$-$C_{16}$ alkyl; $R_2$ is a $C_2$-$C_6$ linear or branched alkyl; and $R_3$ is a $C_2$-$C_6$ linear or branched alkyl. In an embodiment, the present composition includes a linear alkyl ether diamine compound of Formula 2 in which $R_1$ is $C_{12}$-$C_{16}$, $R_2$ is $C_3$, and $R_3$ is $C_3$. In an embodiment, R1 is either a linear alkyl $C_{12}$-$C_{16}$ or a mixture of linear alkyl $C_{10}$-$C_{12}$ and $C_{14}$-$C_{16}$. Suitable ether amines are commercially available from Tomah Products Incorporated as PA-19, PA-1618, PA-1816, DA-18, DA-19, DA-1618, DA-1816, and the like.

In an embodiment, the antimicrobial agent can include or be a diamine, such as a diamine acetate. Suitable diamines, shown as the acetates, include those having the formulas:

$$[(R^1)NH(R^2)NH_3]^+(CH_3COO)^-$$

or $$[(R^1)NH_2(R^2)NH_3^{++}](CH_3COO)_2^-$$

in which $R^1$ can be C10-C18 aliphatic group or an ether group having the formula $R^{10}OR^{11}$ in which $R^{10}$ is a C10-C18 aliphatic group and $R^{11}$ is a C1-C5 alkyl group; and $R^2$ is a C1-C5 alkylene group. Suitable diamine acetates include those in which $R^1$ is a C10-C18 aliphatic group derived from a fatty acid and $R^2$ is propylene. The diamine can have a counter ion other than acetate.

Representative examples of useful diamines include N-coco-1,3-propylene diamine, N-oleyl-1,3-propylene diamine, N-tallow-1,3-propylene diamine, and mixtures thereof. Such N-alkyl-1,3-propylene diamines are available from Akzo Chemie America, Armak Chemicals under the trademark Duomeen.

The amount of the amine compound in the composition can be about 0.1 wt-% to 90 wt-%, about 0.25 wt-% to 75 wt-%, or about 0.5 wt-% to 50 wt-%. The amount of the amine compound in use compositions can be about 10 ppm to 10000 ppm, about 20 ppm to 7500 ppm, and about 40 ppm to 5000 ppm.

In an embodiment, the present composition can provide greater than 3 $\log_{10}$ reduction of bacteria within a 5 minute contact time. In an embodiment, the present composition can provide in excess of 5 $\log_{10}$ reduction of microorganisms. This can be advantageous in food preparation and food processing and other areas where triglyceride fats and lipids are soil components.

In certain embodiments, the antimicrobial agent can be at about 0.01 to about 30 wt-% of the composition, 0.05 to about 10 wt-%, or about 0.1 to about 5 wt-%. In a use solution the additional antimicrobial agent can be about 0.001 to about 5 wt-% of the composition, about 0.01 to about 2 wt-%, or about 0.05 to about 0.5 wt-%.

Activators

In some embodiments, the antimicrobial activity or bleaching activity of the composition can be enhanced by the addition of a material which, when the composition is placed in use, reacts with the active oxygen to form an activated component. For example, in some embodiments, a peracid or a peracid salt is formed. For example, in some embodiments, tetraacetylethylene diamine can be included within the composition to react with the active oxygen and form a peracid or a peracid salt that acts as an antimicrobial agent. Other examples of active oxygen activators include transition metals and their compounds, compounds that contain a carboxylic, nitrile, or ester moiety, or other such compounds known in the art. In an embodiment, the activator includes tetraacetylethylene diamine; transition metal; compound that includes carboxylic, nitrile, amine, or ester moiety; or mixtures thereof.

In some embodiments, an activator component can include in the range of 0.001 to 75% by wt. of the composition, about 0.01 to about 20, or about 0.05 to about 10% by wt of the composition.

In other embodiments, the activator for the source of alkalinity combines with the active oxygen to form an antimicrobial agent.

The solid composition typically remains stable even in the presence of activator of the source of alkalinity. In many compositions would be expected to react with and destabilize or change the form of the source of alkalinity. In contrast, in an embodiment of the present invention, the composition remains solid; it does not swell, crack, or enlarge as it would if the source of alkalinity were reacting with the activator.

In some embodiments, the composition includes a solid block, and an activator material for the active oxygen is coupled to the solid block. The activator can be coupled to the solid block by any of a variety of methods for coupling one solid cleaning composition to another. For example, the activator can be in the form of a solid that is bound, affixed, glued or otherwise adhered to the solid block. Alternatively, the solid activator can be formed around and encasing the block. By way of further example, the solid activator can be coupled to the solid block by the container or package for the cleaning composition, such as by a plastic or shrink wrap or film.

Rinse Aid Functional Materials

Functional materials for use in the compositions of the invention can include a formulated rinse aid composition containing a wetting or sheeting agent combined with other optional ingredients in a solid made using the complex of the invention. The rinse aid component of the present invention can include a water soluble or dispersible low foaming organic material capable of reducing the surface tension of the rinse water to promote sheeting action and to prevent spotting or streaking caused by beaded water after rinsing is completed. This is often used in warewashing processes. Such sheeting agents are typically organic surfactant-like materials having a characteristic cloud point. The cloud point of the surfactant rinse or sheeting agent is defined as the temperature at which a 1 wt-% aqueous solution of the surfactant turns cloudy when warmed.

There are two general types of rinse cycles in commercial warewashing machines, a first type generally considered a sanitizing rinse cycle uses rinse water at a temperature of about 180° F., about 80° C. or higher. A second type of non-sanitizing machines uses a lower temperature non-sanitizing rinse, typically at a temperature of about 125° F., about 50° C. or higher. Surfactants useful in these applications are aqueous rinses having a cloud point greater than the available hot service water. Accordingly, the lowest useful cloud point measured for the surfactants of the invention is approximately 40° C. The cloud point can also be 60° C. or higher, 70° C. or higher, 80° C. or higher, etc., depending on the use locus hot water temperature and the temperature and type of rinse cycle.

Suitable sheeting agents, typically include a polyether compound prepared from ethylene oxide, propylene oxide, or a mixture in a homopolymer or block or heteric copolymer structure. Such polyether compounds are known as polyalkylene oxide polymers, polyoxyalkylene polymers or polyalkylene glycol polymers. Such sheeting agents require a region of relative hydrophobicity and a region of relative hydrophilicity to provide surfactant properties to the molecule. Such sheeting agents have a molecular weight in the range of about 500 to 15,000. Certain types of (PO)(EO) polymeric rinse aids have been found to be useful containing at least one block of poly(PO) and at least one block of poly(EO) in the polymer molecule. Additional blocks of poly(EO), poly PO or random polymerized regions can be formed in the molecule.

Particularly useful polyoxypropylene polyoxyethylene block copolymers are those including a center block of polyoxypropylene units and blocks of polyoxyethylene units to each side of the center block. Such polymers have the formula shown below:

$$(EO)_n—(PO)_m\text{-}(EO)_n$$

wherein n is an integer of 20 to 60, each end is independently an integer of 10 to 130. Another useful block copolymer are block copolymers having a center block of polyoxyethylene units and blocks of polyoxypropylene to each side of the center block. Such copolymers have the formula:

$$(PO)_n\text{-}(EO)_m—(PO)_n$$

wherein m is an integer of 15 to 175 and each end are independently integers of about 10 to 30. The solid functional materials of the invention can often use a hydrotrope to aid in maintaining the solubility of sheeting or wetting agents. Hydrotropes can be used to modify the aqueous solution creating increased solubility for the organic material. Suitable hydrotropes are low molecular weight aromatic sulfonate materials such as xylene sulfonates and dialkyldiphenyl oxide sulfonate materials.

In some embodiments, compositions according to the present invention provide desirable rinsing properties in ware washing without employing a separate rinse agent in the rinse cycle. For example, good rinsing occurs using such compositions in the wash cycle when rinsing employs just soft water.

Additional Bleaching Agents

Additional bleaching agents for use in inventive formulations for lightening or whitening a substrate, include bleaching compounds capable of liberating an active halogen species, such as $Cl_2$, $Br_2$, $I_2$, $ClO_2$, $BrO_2$, $IO_2$, —$OCl^-$, —$OBr^-$ and/or, —$OI^-$, under conditions typically encountered during the cleansing process. Suitable bleaching agents for use in the present cleaning compositions include, for example, chlorine-containing compounds such as a chlorite, a hypochlorite, chloramine. Suitable halogen-releasing compounds include the alkali metal dichloroisocyanurates, chlorinated trisodium phosphate, the alkali metal hypochlorites, alkali metal chlorites, monochloramine and dichloramine, and the like, and mixtures thereof. Encapsulated chlorine sources may also be used to enhance the stability of the chlorine source in the composition (see, for example, U.S. Pat. Nos. 4,618,914 and 4,830,773, the disclosure of which is incorporated by reference herein). A bleaching agent may also be an additional peroxygen or active oxygen source such as hydrogen peroxide, perborates, for example sodium perborate mono and tetrahydrate, sodium carbonate peroxyhydrate, phosphate peroxyhydrates, and potassium permonosulfate, with and without activators such as tetraacetylethylene diamine, and the like, as discussed above.

A cleaning composition may include a minor but effective additional amount of a bleaching agent above that already available from the stabilized source of alkalinity, e.g., about 0.1-10 wt-% or about 1-6 wt-%. The present solid compositions can include bleaching agent in an amount of about 0.1 to about 60 wt-%, about 1 to about 20 wt-%, about 3 to about 8 wt-%, or about 3 to about 6 wt-%.

Secondary Hardening Agents/Solubility Modifiers.

The present compositions may include a minor but effective amount of a secondary hardening agent, as for example, an amide such stearic monoethanolamide or lauric diethanolamide, or an alkylamide, and the like; a solid polyethylene glycol, or a solid EO/PO block copolymer, and the like; starches that have been made water-soluble through an acid or alkaline treatment process; various inorganics that impart solidifying properties to a heated composition upon cooling, and the like. Such compounds may also vary the solubility of the composition in an aqueous medium during use such that the cleaning agent and/or other active ingredients may be dispensed from the solid composition over an extended period of time. The composition may include a secondary hardening agent in an amount of about 5-20 wt-% or about 10-15 wt-%.

Detergent Fillers

A cleaning composition may include an effective amount of one or more of a detergent filler which does not perform as a cleaning agent per se, but cooperates with the cleaning agent to enhance the overall processability of the composition. Examples of fillers suitable for use in the present cleaning compositions include sodium sulfate, sodium chloride, starch, sugars, $C_1$-$C_{10}$ alkylene glycols such as propylene glycol, and the like. A filler such as a sugar (e.g. sucrose) can aid dissolution of a solid composition by acting as a disintegrant. A detergent filler can be included in an amount up to about 50 wt-%, of about 1 to about 20 wt-%, about 3 to about 15 wt-%, about 1 to about 30 wt-%, or about 1.5 to about 25 wt-%.

Defoaming Agents

An effective amount of a defoaming agent for reducing the stability of foam may also be included in the present cleaning compositions. The cleaning composition can include about 0.0001-5 wt-% of a defoaming agent, e.g., about 0.01-3 wt-%. The defoaming agent can be provided in an amount of about 0.0001% to about 10 wt-%, about 0.001% to about 5 wt-%, or about 0.01% to about 1.0 wt-%.

Examples of defoaming agents suitable for use in the present compositions include silicone compounds such as silica dispersed in polydimethylsiloxane, EO/PO block copolymers, alcohol alkoxylates, fatty amides, hydrocarbon waxes, fatty acids, fatty esters, fatty alcohols, fatty acid soaps, ethoxylates, mineral oils, polyethylene glycol esters, alkyl phosphate esters such as monostearyl phosphate, and the like. A discussion of defoaming agents may be found, for example, in U.S. Pat. No. 3,048,548 to Martin et al., U.S. Pat. No. 3,334,147 to Brunelle et al., and U.S. Pat. No. 3,442,242 to Rue et al., the disclosures of which are incorporated by reference herein.

Anti-Redeposition Agents

A cleaning composition may also include an anti-redeposition agent capable of facilitating sustained suspension of soils in a cleaning solution and preventing the removed soils from being redeposited onto the substrate being cleaned. Examples of suitable anti-redeposition agents include fatty acid amides, fluorocarbon surfactants, complex phosphate esters, styrene maleic anhydride copolymers, and cellulosic derivatives such as hydroxyethyl cellulose, hydroxypropyl cellulose, and the like. A cleaning composition may include about 0.5 to about 10 wt-%, e.g., about 1 to about 5 wt-%, of an anti-redeposition agent.

Optical Brighteners

Optical brightener is also referred to as fluorescent whitening agents or fluorescent brightening agents provide optical compensation for the yellow cast in fabric substrates. With optical brighteners yellowing is replaced by light emitted from optical brighteners present in the area commensurate in scope with yellow color. The violet to blue light supplied by the optical brighteners combines with other light reflected from the location to provide a substantially complete or enhanced bright white appearance. This additional light is produced by the brightener through fluorescence. Optical brighteners absorb light in the ultraviolet range 275 through 400 nm. and emit light in the ultraviolet blue spectrum 400-500 nm.

Fluorescent compounds belonging to the optical brightener family are typically aromatic or aromatic heterocyclic materials often containing condensed ring system. An important feature of these compounds is the presence of an uninterrupted chain of conjugated double bonds associated with an aromatic ring. The number of such conjugated double bonds is dependent on substituents as well as the planarity of the fluorescent part of the molecule. Most brightener compounds are derivatives of stilbene or 4,4'-diamino stilbene, biphenyl, five membered heterocycles (triazoles, oxazoles, imidazoles, etc.) or six membered heterocycles (cumarins, naphthalamides, triazines, etc.). The choice of optical brighteners for use in cleaning compositions will depend upon a number of factors, such as the type of detergent, the nature of other components present in the cleaning composition, the temperature of the wash water, the degree of agitation, and the ratio of the material washed to the tub size. The brightener selection is also dependent upon the type of material to be cleaned, e.g., cottons, synthetics, etc. Since most laundry cleaning products are used to clean a variety of fabrics, the cleaning compositions should contain a mixture of brighteners which are effective for a variety of fabrics. It is of course necessary that the individual components of such a brightener mixture be compatible.

Optical brighteners useful in the present invention are commercially available and will be appreciated by those skilled in the art. Commercial optical brighteners which may be useful in the present invention can be classified into subgroups, which include, but are not necessarily limited to, derivatives of stilbene, pyrazoline, coumarin, carboxylic acid, methinecyanines, dibenzothiophene-5,5-dioxide, azoles, 5- and 6-membered-ring heterocycles and other miscellaneous agents. Examples of these types of brighteners are disclosed in "The Production and Application of Fluorescent Brightening Agents", M. Zahradnik, Published by John Wiley & Sons, New York (1982), the disclosure of which is incorporated herein by reference.

Stilbene derivatives which may be useful in the present invention include, but are not necessarily limited to, derivatives of bis(triazinyl)amino-stilbene; bisacylamino derivatives of stilbene; triazole derivatives of stilbene; oxadiazole derivatives of stilbene; oxazole derivatives of stilbene; and styryl derivatives of stilbene.

For laundry cleaning or sanitizing compositions, suitable optical brighteners include stilbene derivatives, which can be employed at concentrations of up to 1 wt-%.

Stabilizing Agents

The solid cleaning composition may also include a stabilizing agent. Examples of suitable stabilizing agents include, but are not limited to: borate, calcium/magnesium ions, propylene glycol, and mixtures thereof. The composition need not include a stabilizing agent, but when the composition includes a stabilizing agent, it can be included in an amount that provides the desired level of stability of the composition. Suitable ranges of the stabilizing agent include up to about 20 wt-%, about 0.5 to about 15 wt-%, or about 2 to about 10 wt-%.

Dispersants

The solid cleaning composition may also include a dispersant. Examples of suitable dispersants that can be used in the solid cleaning composition include, but are not limited to: maleic acid/olefin copolymers, polyacrylic acid, and mixtures thereof. The composition need not include a dispersant, but when a dispersant is included it can be included in an amount that provides the desired dispersant properties. Suitable ranges of the dispersant in the composition can be up to about 20 wt-%, about 0.5 to about 15 wt-%, or about 2 to about 9 wt-%.

Thickeners

The solid cleaning compositions can include a rheology modifier or a thickener. The rheology modifier may provide the following functions: increasing the viscosity of the compositions; increasing the particle size of liquid use solutions when dispensed through a spray nozzle; providing the use solutions with vertical cling to surfaces; providing particle suspension within the use solutions; or reducing the evaporation rate of the use solutions.

The rheology modifier may provide a use composition that is pseudo plastic, in other words the use composition or material when left undisturbed (in a shear mode), retains a high viscosity. However, when sheared, the viscosity of the material is substantially but reversibly reduced. After the shear action is removed, the viscosity returns. These properties permit the application of the material through a spray head. When sprayed through a nozzle, the material undergoes shear as it is drawn up a feed tube into a spray head under the influence of pressure and is sheared by the action of a pump in a pump action sprayer. In either case, the viscosity can drop to a point such that substantial quantities of the material can be applied using the spray devices used to apply the material to a soiled surface. However, once the material comes to rest on a soiled surface, the materials can regain high viscosity to ensure that the material remains in place on the soil. Preferably, the material can be applied to a surface resulting in a substantial coating of the material that provides the cleaning components in sufficient concentration to result in lifting and removal of the hardened or baked-on soil. While in contact with the soil on vertical or inclined surfaces, the thickeners in conjunction with the other components of the cleaner minimize dripping, sagging, slumping or other movement of the material under the effects of gravity. The material should be formulated such that the viscosity of the material is adequate to maintain contact substantial quantities of the film of the material with the soil for at least a minute, five minutes or more.

Examples of suitable thickeners or rheology modifiers are polymeric thickeners including, but not limited to: polymers or natural polymers or gums derived from plant or animal sources. Such materials may be polysaccharides such as large polysaccharide molecules having substantial thickening capacity. Thickeners or rheology modifiers also include clays.

A substantially soluble polymeric thickener can be used to provide increased viscosity or increased conductivity to the use compositions. Examples of polymeric thickeners for the aqueous compositions of the invention include, but are not limited to: carboxylated vinyl polymers such as polyacrylic acids and sodium salts thereof, ethoxylated cellulose, polyacrylamide thickeners, cross-linked, xanthan compositions, sodium alginate and algin products, hydroxypropyl cellulose, hydroxyethyl cellulose, and other similar aqueous thickeners that have some substantial proportion of water solubility. Examples of suitable commercially available thickeners include, but are not limited to: Acusol, available from Rohm & Haas Company, Philadelphia, Pa.; and Carbopol, available from B.F. Goodrich, Charlotte, N.C.

Examples of suitable polymeric thickeners include, but not limited to: polysaccharides. An example of a suitable commercially available polysaccharide includes, but is not limited to, Diutan, available from Kelco Division of Merck, San Diego, Calif. Thickeners for use in the solid cleaning compositions further include polyvinyl alcohol thickeners, such as, fully hydrolyzed (greater than 98.5 mol acetate replaced with the —OH function).

An example of a suitable polysaccharide includes, but is not limited to, xanthans. Such xanthan polymers are preferred due to their high water solubility, and great thickening power. Xanthan is an extracellular polysaccharide of *Xanthomonas campestras*. Xanthan may be made by fermentation based on corn sugar or other corn sweetener by-products. Xanthan includes a poly beta-(1-4)-D-Glucopyranosyl backbone chain, similar to that found in cellulose. Aqueous dispersions of xanthan gum and its derivatives exhibit novel and remarkable rheological properties. Low concentrations of the gum have relatively high viscosities which permit it to be used economically. Xanthan gum solutions exhibit high pseudo plasticity, i.e. over a wide range of concentrations, rapid shear thinning occurs that is generally understood to be instantaneously reversible. Non-sheared materials have viscosities that appear to be independent of the pH and independent of temperature over wide ranges. Preferred xanthan materials include crosslinked xanthan materials. Xanthan polymers can be crosslinked with a variety of known covalent reacting crosslinking agents reactive with the hydroxyl functionality of large polysaccharide molecules and can also be crosslinked using divalent, trivalent or polyvalent metal ions. Such crosslinked xanthan gels are disclosed in U.S. Pat. No. 4,782,901, which is herein incorporated by reference. Suitable crosslinking agents for xanthan materials include, but are not limited to: metal cations such as A1+3, Fe+3, Sb+3, Zr+4 and other transition metals. Examples of suitable commercially available xanthans include, but are not limited to: KELTROL®, KELZAN® AR, KELZAN® D35, KELZAN® S, KELZAN® XZ, available from Kelco Division of Merck, San Diego, Calif. Known organic crosslinking agents can also be used. A preferred crosslinked xanthan is KELZAN® AR, which provides a pseudo plastic use solution that can produce large particle size mist or aerosol when sprayed.

Dyes/Odorants

Various dyes, odorants including perfumes, and other aesthetic enhancing agents may also be included in the composition. Dyes may be included to alter the appearance of the composition, as for example, Direct Blue 86 (Miles), Fastusol Blue (Mobay Chemical Corp.), Acid Orange 7 (American Cyanamid), Basic Violet 10 (Sandoz), Acid Yellow 23 (GAF), Acid Yellow 17 (Sigma Chemical), Sap Green (Keyston Analine and Chemical), Metanil Yellow (Keystone Analine and Chemical), Acid Blue 9 (Hilton Davis), Sandolan Blue/Acid Blue 182 (Sandoz), Hisol Fast Red (Capitol Color and Chemical), Fluorescein (Capitol Color and Chemical), Acid Green 25 (Ciba-Geigy), and the like.

Fragrances or perfumes that may be included in the compositions include, for example, terpenoids such as citronellol, aldehydes such as amyl cinnamaldehyde, a jasmine such as C1S-jasmine or jasmal, vanillin, and the like.

Surfactants

The cleaning compositions of the invention can include a surfactant or surfactant admixture. Surfactants suitable for use in the compositions can be selected from water soluble or water dispersible nonionic, semi-polar nonionic, anionic, cationic, amphoteric, or zwitterionic surface-active agents; or any combination thereof. The particular surfactant or surfactant mixture chosen for use in the process and products of this invention can depend on the conditions of final utility, including method of manufacture, physical product form, use pH, use temperature, foam control, and soil type.

Surfactants incorporated into the cleaning compositions of the present invention can be enzyme compatible, not substrates for enzymes in the composition, and not inhibitors or inactivators of any enzyme present. For example, when proteases and amylases are employed in the present solid compositions, the surfactant is preferably free of peptide and glycosidic bonds. In addition, certain cationic surfactants are known to decrease enzyme effectiveness.

Generally, the concentration of surfactant or surfactant mixture useful in cleaning compositions of the present invention fall in the range of from about 0.5% to about 40% by weight of the composition, preferably about 2% to about 10%, preferably about 5% to about 8%. These percentages can refer to percentages of the commercially available surfactant composition, which can contain solvents, dyes, odorants, and the like in addition to the actual surfactant. In this case, the percentage of the actual surfactant chemical can be less than the percentages listed. These percentages can refer to the percentage of the actual surfactant chemical.

Anionic Surfactants

Also useful in the present invention are surface active substances which are categorized as anionics because the charge on the hydrophobe is negative; or surfactants in which the hydrophobic section of the molecule carries no charge unless the pH is elevated to neutrality or above (e.g. carboxylic acids). Carboxylate, sulfonate, sulfate and phosphate are the polar (hydrophilic) solubilizing groups found in anionic surfactants. Of the cations (counter ions) associated with these polar groups, sodium, lithium and potassium impart water solubility; ammonium and substituted ammonium ions provide both water and oil solubility; and, calcium, barium, and magnesium promote oil solubility.

Anionics are excellent detersive surfactants and are therefore, favored additions to heavy duty cleaning compositions. Generally, however, anionics have high foam profiles which limit their use alone or at high concentration levels in cleaning systems such as CIP circuits that require strict foam control. Further, anionic surface active compounds can impart special chemical or physical properties other than detergency within the composition. Anionics can be employed as gelling agents or as part of a gelling or thickening system. Anionics are excellent solubilizers and can be used for hydrotropic effect and cloud point control.

The majority of large volume commercial anionic surfactants can be subdivided into five major chemical classes and additional sub-groups, which are described in "Surfactant Encyclopedia", *Cosmetics & Toiletries*, Vol. 104 (2) 71-86 (1989). The first class includes acylamino acids (and salts), such as acylgluamates, acyl peptides, sarcosinates (e.g. N-acyl sarcosinates), taurates (e.g. N-acyl taurates and fatty acid amides of methyl tauride), and the like. The second class includes carboxylic acids (and salts), such as alkanoic acids (and alkanoates), ester carboxylic acids (e.g. alkyl succinates), ether carboxylic acids, and the like. The third class includes phosphoric acid esters and their salts. The fourth class includes sulfonic acids (and salts), such as isethionates (e.g. acyl isethionates), alkylaryl sulfonates, alkyl sulfonates, sulfosuccinates (e.g. monoesters and diesters of sulfosuccinate), and the like. The fifth class includes sulfuric acid esters (and salts), such as alkyl ether sulfates, alkyl sulfates, and the like. Although each of these classes of anionic surfactants can be employed in the present solid compositions, it should be noted that certain of these anionic surfactants may be incompatible with the enzymes. For example, the acyl-amino acids and salts may be incompatible with proteolytic enzymes because of their peptide structure.

Anionic sulfate surfactants suitable for use in the present solid compositions include the linear and branched primary and secondary alkyl sulfates, alkyl ethoxysulfates, fatty oleyl glycerol sulfates, alkyl phenol ethylene oxide ether sulfates, the $C_5$-$C_{17}$ acyl-N—($C_1$-$C_4$ alkyl) and —N—($C_1$-$C_2$ hydroxyalkyl)glucamine sulfates, and sulfates of alkylpolysaccharides such as the sulfates of alkylpolyglucoside (the nonionic nonsulfated compounds being described herein).

Examples of suitable synthetic, water soluble anionic detergent compounds include the ammonium and substituted ammonium (such as mono-, di- and triethanolamine) and alkali metal (such as sodium, lithium and potassium) salts of the alkyl mononuclear aromatic sulfonates such as the alkyl benzene sulfonates containing from about 5 to about 18 carbon atoms in the alkyl group in a straight or branched chain, e.g., the salts of alkyl benzene sulfonates or of alkyl toluene, xylene, cumene and phenol sulfonates; alkyl naphthalene sulfonate, diamyl naphthalene sulfonate, and dinonyl naphthalene sulfonate and alkoxylated derivatives.

Anionic carboxylate surfactants suitable for use in the present solid compositions include the alkyl ethoxy carboxylates, the alkyl polyethoxy polycarboxylate surfactants and the soaps (e.g. alkyl carboxyls). Secondary soap surfactants (e.g. alkyl carboxyl surfactants) useful in the present solid compositions include those which contain a carboxyl unit connected to a secondary carbon. The secondary carbon can be in a ring structure, e.g. as in p-octyl benzoic acid, or as in alkyl-substituted cyclohexyl carboxylates. The secondary soap surfactants typically contain no ether linkages, no ester linkages and no hydroxyl groups. Further, they typically lack nitrogen atoms in the head-group (amphiphilic portion). Suitable secondary soap surfactants typically contain 11-13 total carbon atoms, although more carbons atoms (e.g., up to 16) can be present.

Other anionic detergents suitable for use in the present solid compositions include olefin sulfonates, such as long chain alkene sulfonates, long chain hydroxyalkane sulfonates or mixtures of alkenesulfonates and hydroxyalkane-sulfonates. Also included are the alkyl sulfates, alkyl poly(ethyleneoxy)ether sulfates and aromatic poly(ethyleneoxy)sulfates such as the sulfates or condensation products of ethylene oxide and nonyl phenol (usually having 1 to 6 oxyethylene groups per molecule. Resin acids and hydrogenated resin acids are also suitable, such as rosin, hydrogenated rosin, and resin acids and hydrogenated resin acids present in or derived from tallow oil.

The particular salts will be suitably selected depending upon the particular formulation and the needs therein.

Further examples of suitable anionic surfactants are given in "Surface Active Agents and Detergents" (Vol. I and II by Schwartz, Perry and Berch). A variety of such surfactants are also generally disclosed in U.S. Pat. No. 3,929,678, issued Dec. 30, 1975 to Laughlin, et al. at Column 23, line 58 through Column 29, line 23.

In some embodiments, the present solid composition includes alkyl or alkyl aryl sulfonates or substituted sulfates and sulfated products. In certain embodiments, the present solid composition includes linear alkane sulfonate, linear alkylbenzene sulfonates, alphaolefin sulfonates, alkyl sulfates, secondary alkane sulfates or sulfonates, or sulfosuccinates.

In certain embodiments, the composition can include about 0.003 to about 35 wt-% anionic surfactant, for example, about 5 to about 30 wt-% anionic surfactant. The anionic surfactant can include linear alkyl benzene sulfonate; alpha olefin sulfonate; alkyl sulfate; secondary alkane sulfonate; sulfosuccinate; or mixtures thereof. The anionic surfactant can include alkanol ammonium alkyl benzene sulfonate. The anionic surfactant can include monoethanol ammonium alkyl benzene sulfonate.

Nonionic Surfactant

Nonionic surfactants useful in the invention are generally characterized by the presence of an organic hydrophobic group and an organic hydrophilic group and are typically produced by the condensation of an organic aliphatic, alkyl aromatic or polyoxyalkylene hydrophobic compound with a hydrophilic alkaline oxide moiety which in common practice is ethylene oxide or a polyhydration product thereof, polyethylene glycol. Practically any hydrophobic compound having a hydroxyl, carboxyl, amino, or amido group with a reactive hydrogen atom can be condensed with ethylene oxide, or its polyhydration adducts, or its mixtures with alkoxylenes such as propylene oxide to form a nonionic surface-active agent. The length of the hydrophilic polyoxyalkylene moiety which is condensed with any particular hydrophobic compound can be readily adjusted to yield a water dispersible or water soluble compound having the desired degree of balance between hydrophilic and hydrophobic properties.

In an embodiment, the present cleaning composition includes solidification agent; spore, bacteria or fungus; and boric acid salt, e.g., alkanol amine borate. In certain embodiments, the composition can also include about 0.003 to about 35 wt-% nonionic surfactant, for example, about 5 to about 20 wt-% nonionic surfactant. The nonionic surfactant can include nonionic block copolymer comprising of at least $(EO)_y(PO)_z$, wherein y and z are independently between 2 and 100; $C_{6-24}$ alkyl phenol alkoxylate having 2 to 15 moles of ethylene oxide; $C_{6-24}$ alcohol alkoxylate having 2 to 15 moles of ethylene oxide; alkoxylated amine having 2-20 moles of ethylene oxide; or mixtures thereof.

EO/PO Nonionic Surfactant

An example of useful nonionic surfactants used with the silicone surfactants are polyether compounds prepared from ethylene oxide, propylene oxide, in a graft moiety homopolymer or a block or heteric copolymer. Such polyether compounds are known as polyalkylene oxide polymers, polyoxyalkylene polymers, or polyalkylene glycol polymers. Such nonionic surfactants have a molecular weight in the range of about 500 to about 15,000. Certain types of polyoxypropylene-polyoxyethylene glycol polymer nonionic surfactants have been found to be particularly useful. Surfactants including at least one block of a polyoxypropylene and having at least one other block of polyoxyethylene attached to the polyoxypropylene block can be used. Additional blocks of polyoxyethylene or polyoxypropylene can be present in a molecule. These materials having an average molecular weight in the range of about 500 to about 15,000 are commonly available as PLURONIC® manufactured by the BASF Corporation and available under a variety of other trademarks of their chemical suppliers. In addition PLURONIC® R (reverse PLURONIC structure) are also useful in the compositions of the invention. Additionally, alkylene oxide groups used with an alcohol and an alkyl phenol, a fatty acid or other such group can be useful. A useful surfactant can include a capped polyalkoxylated $C_{6-24}$ linear alcohol. The surfactants can be made with polyoxyethylene or polyoxypropylene units and can be capped with common agents forming an ether end group. A useful species of this surfactant is a $(PO)_x$ compound or benzyl ether compound polyethoxylated $C_{12-14}$ linear alcohol; see U.S. Pat. No. 3,444,247. Particularly useful polyoxypropylene polyoxyethylene block polymers are those including a center block of polyoxypropylene units and blocks of polyoxyethylene units to each side of the center block.

These copolymers have the formula shown below:

$$(EO)_n—(PO)_m\text{-}(EO)_n$$

wherein m is an integer of 21 to 54; n is an integer of 7 to 128. Additional useful block copolymers are block polymers having a center block of polyoxyethylene units and blocks of polyoxypropylene units to each side of the center block. The copolymers have the formula as shown below:

$$(PO)_n\text{-}(EO)_m—(PO)_n$$

wherein m is an integer of 14 to 164 and n is an integer of 9 to 22.

One suitable nonionic surfactant for use in the compositions of the invention include an alkyl phenol alkoxylate of the formula:

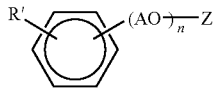

wherein R' includes a $C_{2-24}$ aliphatic group and AO represents an ethylene oxide group, a propylene oxide group, an heteric mixed EOPO group or a block EO—PO, PO-EO, EOPOEO or POEOPO group, and Z represents H or an (AO), Benzyl or other cap. A suitable nonionic surfactant includes an alkyl phenol ethoxylate of the formula:

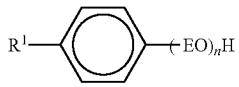

wherein $R^1$ includes a $C_{6-18}$ aliphatic group, preferably a $C_{6-12}$ aliphatic group and n is an integer of about 2 to about 24. A primary example of such a surfactant is a nonyl phenol ethoxylate having 2.5 to 14.5 moles of EO in the ethoxylate group. The ethoxylate group can be capped with a $(PO)_x$ group when x is 2.5 to 12.5 or a benzyl moiety.

Alkoxylated Amines

The present solid compositions can include any of a variety of alkoxylated amines. In an embodiment, the alkoxylated amine has general Formula I: $N(R_1)(R_2)(R_3)(R_4)$, in which at least one of $R_1$, $R_2$, or $R_3$ includes an alkoxylate or ether moiety. $R_4$ can be hydrogen, straight or branched alkyl, or straight or branched alkyl aryl. The alkoxylated amine can be a primary, secondary, or tertiary amine. In an embodiment, the alkoxylated amine is a tertiary amine. In certain embodiments, each of $R_2$ and $R_3$ includes an alkoxylate moiety, e.g., one or more ethoxylate moieties, one or more propoxylate moieties, or combinations thereof, and $R_4$ is hydrogen. For example, one of $R_1$, $R_2$, or $R_3$ can include an ether moiety and the other two can include one or more ethoxylate moieties, one or more propoxylate moieties, or combinations thereof.

By way of further example, an alkoxylated amine can be represented by general Formulae IIa, IIb, or IIc, respectively:

$$R^5—(PO)_sN\text{-}(EO)_tH, \qquad \text{IIa}$$

$$R^5—(PO)_xN\text{-}(EO)_tH(EO)_uH, \text{ and} \qquad \text{IIb}$$

$$R^5—N(EO)_tH; \qquad \text{IIc}$$

in which $R^5$ can be an alkyl, alkenyl or other aliphatic group, or an alkyl-aryl group of from 8 to 20 or from 12 to 14 carbon atoms, EO is oxyethylene, PO is oxypropylene, s is 1-20, 2-12, or 2 to 5, t is 1-20, 1-10, 2-12, or 2-5, and u is 1-20, 1-10, 2-12, or 2-5. Other variations on the scope of these compounds can be represented by formula IId:

$$R^5—(PO)_v—N[(EO)_wH][(EO)_zH]$$

in which $R^5$ is as defined above, v is 1 to 20 (e.g., 1, 2, 3, or 4 or, in an embodiment, 2), and w and z are independently 1-20, 1-10, 2-12, or 2-5.

In some embodiments, the alkoxylated amine is an ether amine alkoxylate. An ether amine alkoxylate can have Formula III:

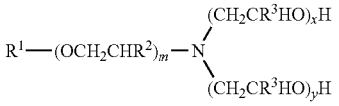

In Formula III, $R^1$ can be a straight or branched alkyl or alkylaryl; $R^2$ can independently in each occurrence be hydrogen or alkyl from 1 to 6 carbons; $R^3$ can independently in each occurrence be hydrogen or alkyl of from 1 to 6 carbons; m can average from about 1 to about 20; x and y can each independently average from 1 to about 20; and x+y can average from about 2 to about 40.

In some embodiments, in Formula III, $R^1$ can be: alkyl of from 8 to 24 carbon atoms, alkylaryl and contain from about 7 to about 30 carbon atoms, or alkylaryl (e.g., alkylaryl disubstituted with alkyl groups); $R^2$ can contain 1 or 2 carbon atoms or can be hydrogen; $R^3$ can be hydrogen, alkyl containing 1 or 2 carbons; and x+y can range from about 1 to about 3.

Such ether amine alkoxylates are described in U.S. Pat. Nos. 6,060,625 and 6,063,145.

In some embodiments, in Formula III, $R^1$ can be: alkyl of from 6 to 24 carbon atoms, alkylaryl and contain from about 7 to about 30 carbon atoms, or alkylaryl (e.g., alkylaryl disubstituted with alkyl groups); $R^2$ can contain 1 or 2 carbon atoms or can be hydrogen; $R^3$ can be hydrogen, alkyl containing 1 or 2 carbons; and x+y can range from about 1 to about 20.

In some embodiments, in Formula III, m can be 0 to about 20 and x and y can each independently average from 0 to about 20. In certain embodiments, the alkoxy moieties can be capped or terminated with ethylene oxide, propylene oxide, or butylene oxide units.

In some embodiments, in Formula III, $R^1$ can be $C_6$-$C_{20}$ alkyl or $C_9$-$C_{13}$ alkyl, e.g., linear alkyl; $R^2$ can be $CH_3$; m can be about 1 to about 10; $R^3$ can be hydrogen; and x+y can range from about 5 to about 12.

In some embodiments, in Formula III, $R^1$ can be $C_6$-$C_{14}$ alkyl or $C_7$-$C_{14}$ alkyl, e.g., linear alkyl; $R^2$ can be $CH_3$; m can be about 1 to about 10; $R^3$ can be hydrogen; and x+y can range from about 2 to about 12. In an embodiment, such an ether amine alkoxylate can include alkoxylate moieties terminated with propylene oxide or butylene oxide units, which can provide low foam compositions.

In some embodiments, in Formula III, $R^1$ can be $C_6$-$C_{14}$ alkyl, e.g., linear alkyl; $R^2$ can be $CH_3$; m can be about 1 to about 10; $R^3$ can be hydrogen; and x+y can range from about 2 to about 20.

In some embodiments, the alkoxylated amine can be a $C_{12}$ to $C_{14}$ propoxy amine ethoxylate in which, in Formula III, $R^1$ can be $C_{12}$-$C_{14}$ alkyl, e.g., linear alkyl; $R^2$ can be $CH_3$; m can be about 10; $R^3$ can be hydrogen; x can be about 2.5, and y can be about 2.5.

In some embodiments, the alkoxylated amine can be a $C_{12}$ to $C_{14}$ propoxy amine ethoxylate in which, in Formula III, $R^1$ can be $C_{12}$-$C_{14}$ alkyl, e.g., linear alkyl; $R^2$ can be $CH_3$; m can be about 5; $R^3$ can be hydrogen; x can be about 2.5, and y can be about 2.5.

In some embodiments, the alkoxylated amine can be a $C_{12}$ to $C_{14}$ propoxy amine ethoxylate in which, in Formula III, $R^1$ can be $C_{12}$-$C_{14}$ alkyl, e.g., linear alkyl; $R^2$ can be $CH_3$; m can be about 2; $R^3$ can be hydrogen; x can be about 2.5, and y can be about 2.5.

In some embodiments, in Formula III, $R^1$ can be branched $C_{10}$ alkyl; $R^2$ can be $CH_2$; m can be 1; $R^3$ can be hydrogen; and x+y can be about 5. Such an alkoxylated amine can be a tertiary ethoxylated amine known as poly (5) oxyethylene isodecyloxypropylamine.

In some embodiments, the alkoxylated amine can be a secondary ethoxylated amine that can be described by the formula: R—(PO)—N-$(EO)_x$ where x=1 to 7 moles of ethylene oxide.

In some embodiments, the alkoxylated amine can be a diamine that can be described by the formula R—O—CH2CH2CH2N(H)(CH2CH2CH2NH2) in which R is, for example, branched $C_{10}$ alkyl.

In some embodiments, the ether amine alkoxylate of Formula III is an ether amine ethoxylate propoxylate of Formula IV:

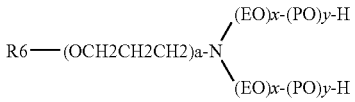

In Formula IV, $R^6$ can be a straight or branched alkyl or alkylaryl; a can average from about 1 to about 20; x and y can each independently average from 0 to about 10; and x+y can average from about 1 to about 20. Such an ether amine alkoxylate can be referred to as an ether amine ethoxylate propoxylate. In certain embodiments, the alkoxy moieties can be capped or terminated with ethylene oxide, propylene oxide, or butylene oxide units.

In some embodiments, the alkoxylated amine can be a $C_{12}$ to $C_{14}$ propoxy amine ethoxylate that can be described by the formula: R—$(PO)_2N[EO]_{2.5}$—$H[EO]_{2.5}$—H. In an embodiment, the alkoxylated amine can be a $C_{12}$ to $C_{14}$ propoxy amine ethoxylate that can be described by the formula: R—$(PO)_{10}N[EO]_{2.5}$—$H[EO]_{2.5}$—H. In an embodiment, the alkoxylated amine can be a $C_{12}$ to $C_{14}$ propoxy amine ethoxylate that can be described by the formula: R—$(PO)_5N[EO]_{2.5}$—$H[EO]_{2.5}$—H. In an embodiment, the alkoxylated amine can be a tertiary ethoxylated amine known as poly (5) oxyethylene isodecyloxypropylamine, which has a branched $C_{10}H_{21}$ alkyl group off the ether oxygen. In an embodiment, the alkoxylated amine can be a diamine that can be described by the formula R—O—CH2CH2CH2N(H)(CH2CH2CH2NH2) in which R is branched $C_{10}$ alkyl. In an embodiment, the alkoxylated amine can be a tertiary ethoxylated amine known as iso-(2-hydroxyethyl)isodecyloxypropylamine, which has a branched $C_{10}H_{21}$ alkyl group off the ether oxygen.

Ether amine alkoxylates are commercially available, for example, under tradenames such as Surfonic (Huntsman Chemical) or Tomah Ether or Ethoxylated Amines.

In some embodiments, the alkoxylated amine is an alkyl amine alkoxylate. A suitable alkyl amine alkoxylate can have Formula V:

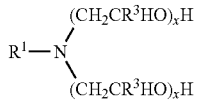

In Formula V, $R^1$ can be a straight or branched alkyl or alkylaryl; $R^3$ can independently in each occurrence be hydrogen or alkyl of from 1 to 6 carbons; x and y can each independently average from 0 to about 25; and x+y can average from about 1 to about 50. In an embodiment, in Formula V, x and y can each independently average from 0 to about 10; and x+y can average from about 1 to about 20. In an embodiment, the alkoxy moieties can be capped or terminated with ethylene oxide, propylene oxide, or butylene oxide units.

In some embodiments, the alkyl amine alkoxylate of Formula V is an alkyl amine ethoxylate propoxylate of Formula VI:

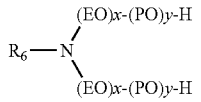

In Formula VI, $R^6$ can be a straight or branched alkyl or alkylaryl (e.g., C18 alkyl); x and y can each independently average from 0 to about 25; and x+y can average from about 1 to about 50. In an embodiment, in Formula VI, x and y can each independently average from 0 to about 10 or 20; and x+y can average from about 1 to about 20 or 40. Such an ether amine alkoxylate can be referred to as an amine ethoxylate propoxylate.

One such alkyl amine ethoxylate propoxylate can be described by the chemical names N,N-bis-2(omega-hydroxypolyoxyethylene/polyoxypropylene)ethyl alkylamine or N,N-Bis(polyoxyethylene/propylene)tallowalkylamine, by CAS number 68213-26-3, and/or by chemical formula $C_{64}H_{130}O_{18}$.

Alkyl amine alkoxylates are commercially available, for example, under tradenames such as Armoblen (Akzo Nobel). Armoblen 600 is called an alkylamine ethoxylate propoxylate.

In some embodiments, the alkoxylated amine is an ether amine. Suitable ether amines can have general Formula VII: $N(R_1)(R_2)(R_3)$, in which at least one of $R_1$, $R_2$, or $R_3$ includes an ether moiety. In an embodiment, $R_1$ includes an ether moiety and $R_2$, and $R_3$ are hydrogen. Such an ether amine can have Formula VIII:

$$R_4O(R_5)NH_2$$

In Formula VIII, $R_4$ can be $C_1$ to $C_{13}$ arylalkyl or alkyl, straight or branched chain and $R_5$ can be $C_1$ to $C_6$ alkyl, straight or branched chain.

Ether amines are commercially available, for example, from Tomah[3] Products.

Suitable alkoxylated amines can include amines known as ethoxylated amine, propoxylated amine, ethoxylated propoxylated amine, alkoxylated alkyl amine, ethoxylated alkyl amine, propoxylated alkyl amine, ethoxylated propoxylated alkyl amine, ethoxylated propoxylated quaternary ammonium compound, ether amine (primary, secondary, or tertiary), ether amine alkoxylate, ether amine ethoxylate, ether amine propoxylate, alkoxylated ether amine, alkyl ether amine alkoxylate, alkyl propoxyamine alkoxylate, alkylalkoxy ether amine alkoxylate, and the like.

Additional Nonionic Surfactants

Additional useful nonionic surfactants in the present invention include:

Condensation products of one mole of saturated or unsaturated, straight or branched chain carboxylic acid having from about 8 to about 18 carbon atoms with from about 6 to about 50 moles of ethylene oxide. The acid moiety can consist of mixtures of acids in the above defined carbon atoms range or it can consist of an acid having a specific number of carbon atoms within the range. Examples of commercial compounds of this chemistry are available on the market under the trade names Nopalcol® manufactured by Henkel Corporation and Lipopeg® manufactured by Lipo Chemicals, Inc.

In addition to ethoxylated carboxylic acids, commonly called polyethylene glycol esters, other alkanoic acid esters formed by reaction with glycerides, glycerin, and polyhydric (saccharide or sorbitan/sorbitol) alcohols have application in this invention for specialized embodiments, particularly indirect food additive applications. All of these ester moieties have one or more reactive hydrogen sites on their molecule which can undergo further acylation or ethylene oxide (alkoxide) addition to control the hydrophilicity of these substances. Care must be exercised when adding these fatty ester or acylated carbohydrates to compositions of the present invention containing amylase and/or lipase enzymes because of potential incompatibility.

Examples of nonionic low foaming surfactants include nonionic surfactants described above that are modified by "capping" or "end blocking" the terminal hydroxy group or groups (of multi-functional moieties) to reduce foaming by reaction with a small hydrophobic molecule such as propylene oxide, butylene oxide, benzyl chloride; and, short chain fatty acids, alcohols or alkyl halides containing from 1 to about 5 carbon atoms; and mixtures thereof. Also included are reactants such as thionyl chloride which convert terminal hydroxy groups to a chloride group. Such modifications to the terminal hydroxy group may lead to all-block, block-heteric, heteric-block or all-heteric nonionics.

Polyhydroxy fatty acid amide surfactants suitable for use in the present solid compositions include those having the structural formula $R^2CONR^1Z$ in which: R1 is H, $C_1$-$C_4$ hydrocarbyl, 2-hydroxy ethyl, 2-hydroxy propyl, ethoxy, propoxy group, or a mixture thereof; $R_2$ is a $C_5$-$C_{31}$ hydrocarbyl, which can be straight-chain; and Z is a polyhydroxyhydrocarbyl having a linear hydrocarbyl chain with at least 3 hydroxyls directly connected to the chain, or an alkoxylated derivative (preferably ethoxylated or propoxylated) thereof. Z can be derived from a reducing sugar in a reductive amination reaction; such as a glycityl moiety.

Suitable nonionic alkylpolysaccharide surfactants, particularly for use in the present solid compositions include those disclosed in U.S. Pat. No. 4,565,647, Llenado, issued Jan. 21, 1986. These surfactants include a hydrophobic group containing from about 6 to about 30 carbon atoms and a polysaccharide, e.g., a polyglycoside, hydrophilic group containing from about 1.3 to about 10 saccharide units. Any reducing saccharide containing 5 or 6 carbon atoms can be used, e.g., glucose, galactose and galactosyl moieties can be substituted for the glucosyl moieties. (Optionally the hydrophobic group is attached at the 2-, 3-, 4-, etc. positions thus giving a glucose or galactose as opposed to a glucoside or galactoside.) The intersaccharide bonds can be, e.g., between the one position of the additional saccharide units and the 2-, 3-, 4-, and/or 6-positions on the preceding saccharide units.

Fatty acid amide surfactants suitable for use the present solid compositions include those having the formula: $R^6CON(R^7)_2$ in which $R^6$ is an alkyl group containing from 7 to 21 carbon atoms and each $R^7$ is independently hydrogen, $C_1$-$C_4$ alkyl, $C_1$-$C_4$ hydroxyalkyl, or —$(C_2H_4O)_xH$, where x is in the range of from 1 to 3.

The treatise *Nonionic Surfactants*, edited by Schick, M. J., Vol. 1 of the Surfactant Science Series, Marcel Dekker, Inc., New York, 1983 is an excellent reference on the wide variety of nonionic compounds generally employed in the practice of the present invention. A typical listing of nonionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Semi-Polar Nonionic Surfactants

The semi-polar type of nonionic surface active agents are another class of nonionic surfactant useful in compositions of the present invention. Generally, semi-polar nonionics are high foamers and foam stabilizers, which can limit their application in CIP systems. However, within compositional embodiments of this invention designed for high foam cleaning methodology, semi-polar nonionics would have immediate utility. The semi-polar nonionic surfactants include the amine oxides, phosphine oxides, sulfoxides and their alkoxylated derivatives.

Amine oxides are tertiary amine oxides corresponding to the general formula:

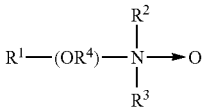

wherein the arrow is a conventional representation of a semi-polar bond; and, $R^1$, $R^2$, and $R^3$ may be aliphatic, aromatic, heterocyclic, alicyclic, or combinations thereof. Generally, for amine oxides of detergent interest, $R^1$ is an alkyl radical of from about 8 to about 24 carbon atoms; $R^2$ and $R^3$ are alkyl or hydroxyalkyl of 1-3 carbon atoms or a mixture thereof; $R^2$ and $R^3$ can be attached to each other, e.g. through an oxygen or nitrogen atom, to form a ring structure; $R^4$ is an alkaline or a hydroxyalkylene group containing 2 to 3 carbon atoms; and n ranges from 0 to about 20.

Useful water soluble amine oxide surfactants are selected from the coconut or tallow alkyl di-(lower alkyl)amine oxides, specific examples of which are dodecyldimethylamine oxide, tridecyldimethylamine oxide, etradecyldimethylamine oxide, pentadecyldimethylamine oxide, hexadecyldimethylamine oxide, heptadecyldimethylamine oxide, octadecyldimethylaine oxide, dodecyldipropylamine oxide, tetradecyldipropylamine oxide, hexadecyldipropylamine oxide, tetradecyldibutylamine oxide, octadecyldibutylamine oxide, bis(2-hydroxyethyl)dodecylamine oxide, bis(2-hydroxyethyl)-3-dodecoxy-1-hydroxypropylamine oxide, dimethyl-(2-hydroxydodecyl)amine oxide, 3,6,9-trioctadecyldimethylamine oxide and 3-dodecoxy-2-hydroxypropyldi-(2-hydroxyethyl)amine oxide.

Useful semi-polar nonionic surfactants also include the water soluble phosphine oxides having the following structure:

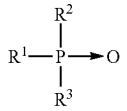

wherein the arrow is a conventional representation of a semi-polar bond; and, $R^1$ is an alkyl, alkenyl or hydroxyalkyl moiety ranging from 10 to about 24 carbon atoms in chain length; and, $R^2$ and $R^3$ are each alkyl moieties separately selected from alkyl or hydroxyalkyl groups containing 1 to 3 carbon atoms.

Examples of useful phosphine oxides include dimethyldecylphosphine oxide, dimethyltetradecylphosphine oxide, methylethyltetradecylphosphone oxide, dimethylhexadecylphosphine oxide, diethyl-2-hydroxyoctyldecylphosphine oxide, bis(2-hydroxyethyl)dodecylphosphine oxide, and bis(hydroxymethyl)tetradecylphosphine oxide.

Semi-polar nonionic surfactants useful herein also include the water soluble sulfoxide compounds which have the structure:

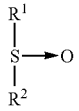

wherein the arrow is a conventional representation of a semi-polar bond; and, $R^1$ is an alkyl or hydroxyalkyl moiety of about 8 to about 28 carbon atoms, from 0 to about 5 ether linkages and from 0 to about 2 hydroxyl substituents; and $R^2$ is an alkyl moiety consisting of alkyl and hydroxyalkyl groups having 1 to 3 carbon atoms.

Useful examples of these sulfoxides include dodecyl methyl sulfoxide; 3-hydroxy tridecyl methyl sulfoxide; 3-methoxy tridecyl methyl sulfoxide; and 3-hydroxy-4-dodecoxybutyl methyl sulfoxide.

Preferred semi-polar nonionic surfactants for the compositions of the invention include dimethyl amine oxides, such as lauryl dimethyl amine oxide, myristyl dimethyl amine oxide, cetyl dimethyl amine oxide, combinations thereof, and the like.

Silicone Surfactant

The silicone surfactant can include a modified dialkyl, e.g., a dimethyl polysiloxane. The polysiloxane hydrophobic group can be modified with one or more pendent hydrophilic polyalkylene oxide group or groups. Such surfactants can provide low surface tension, high wetting, high spreading, antifoaming and excellent stain removal. The silicone surfactants of the invention include a polydialkyl siloxane, e.g., a polydimethyl siloxane to which polyether, typically polyalkylene oxide, groups have been grafted through a hydrosilation reaction. The process results in an alkyl pendent (AP type) copolymer, in which the polyalkylene oxide groups are attached along the siloxane backbone through a series of hydrolytically stable Si—C bond.

These nonionic substituted poly dialkyl siloxane products have the following generic formula:

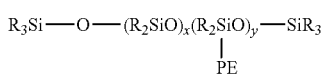

wherein PE represents a nonionic group, e.g., —$CH_2$—$(CH_2)_p$—O-$(EO)_m(PO)_n$—Z, with EO representing ethylene oxide, PO representing propylene oxide, x is a number that ranges from about 0 to about 100, y is a number that ranges from about 1 to 100, m, n and p are numbers that range from about 0 to about 50, m+n≥1 and Z represents hydrogen or R wherein each R independently represents a lower ($C_{1-6}$) straight or branched alkyl. Such surfactants have a molecular weight ($M_n$) of about 500 to 20,000.

Other silicone nonionic surfactants have the formula:

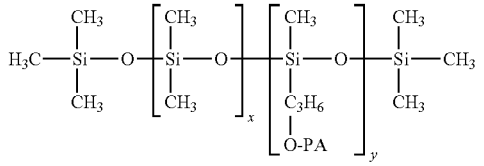

PA = —$(C_2H_4O)_a(C_3H_6O)_bR$ or

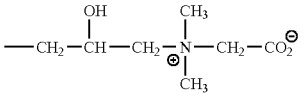

wherein x represent a number that ranges from about 0 to about 100, y represent a number that ranges from about 1 to about 100, a and b represent numbers that independently range from about 0 to about 60, a+b≥1, and each R is independently H or a lower straight or branched ($C_{1-6}$) alkyl. A second class of nonionic silicone surfactants is an alkoxy-end-blocked (AEB type) that are less preferred because the Si—O— bond offers limited resistance to hydrolysis under neutral or slightly alkaline conditions, but breaks down quickly in acidic environments.

Suitable surfactants are sold under the SILWET® tradename, the TEGOPREN® trademark or under the ABIL® B trademark. One useful surfactant, SILWET® L77, has the formula:

$$(CH_3)_3Si—O(CH_3)Si(R^1)O—Si(CH_3)_3$$

wherein $R^1$=—$CH_2CH_2CH_2$—O—$[CH_2CH_2O]_zCH_3$; wherein z is 4 to 16 preferably 4 to 12, most preferably 7-9.

Other useful surfactants include TEGOPREN 5840®, ABIL B-8843®, ABIL B-8852® and ABIL B-8863®.

In certain embodiments, the composition can also include about 0.0005 to about 35 wt-% silicone surfactant, for example, about 1 to about 20 wt-% silicone surfactant. The silicone surfactant can include a silicone backbone and at least 1 pendant alkylene oxide group having from about 2 to 100 moles of alkylene oxide. The pendant alkylene oxide group can include $(EO)_n$ wherein n is 3 to 75.

Cationic Surfactants

Surface active substances are classified as cationic if the charge on the hydrotrope portion of the molecule is positive. Surfactants in which the hydrotrope carries no charge unless the pH is lowered close to neutrality or lower, but which are then cationic (e.g. alkyl amines), are also included in this group. In theory, cationic surfactants may be synthesized from any combination of elements containing an "onium" structure RnX+Y− and could include compounds other than nitrogen (ammonium) such as phosphorus (phosphonium) and sulfur (sulfonium). In practice, the cationic surfactant field is dominated by nitrogen containing compounds, probably because synthetic routes to nitrogenous cationics are simple and straightforward and give high yields of product, which can make them less expensive.

Cationic surfactants preferably include, more preferably refer to, compounds containing at least one long carbon chain hydrophobic group and at least one positively charged nitrogen. The long carbon chain group may be attached directly to the nitrogen atom by simple substitution; or more preferably indirectly by a bridging functional group or groups in so-called interrupted alkylamines and amido amines. Such functional groups can make the molecule more hydrophilic and/or more water dispersible, more easily water solubilized by co-surfactant mixtures, and/or water soluble. For increased water solubility, additional primary, secondary or tertiary amino groups can be introduced or the amino nitrogen can be quaternized with low molecular weight alkyl groups. Further, the nitrogen can be a part of branched or straight chain moiety of varying degrees of unsaturation or of a saturated or unsaturated heterocyclic ring. In addition, cationic surfactants may contain complex linkages having more than one cationic nitrogen atom.

The surfactant compounds classified as amine oxides, amphoterics and zwitterions are themselves typically cationic in near neutral to acidic pH solutions and can overlap surfactant classifications. Polyoxyethylated cationic surfactants generally behave like nonionic surfactants in alkaline solution and like cationic surfactants in acidic solution.

The simplest cationic amines, amine salts and quaternary ammonium compounds can be schematically drawn thus:

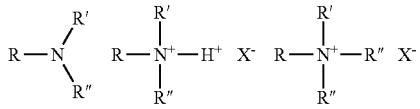

in which, R represents a long alkyl chain, R', R", and R'" may be either long alkyl chains or smaller alkyl or aryl groups or hydrogen and X represents an anion. The amine salts and quaternary ammonium compounds can be useful due to their high degree of water solubility.

The majority of large volume commercial cationic surfactants can be subdivided into four major classes and additional sub-groups known to those or skill in the art and described in "Surfactant Encyclopedia", *Cosmetics & Toiletries*, Vol. 104 (2) 86-96 (1989). The first class includes alkylamines and their salts. The second class includes alkyl imidazolines. The third class includes ethoxylated amines. The fourth class includes quaternaries, such as alkylbenzyldimethylammonium salts, alkyl benzene salts, heterocyclic ammonium salts, tetra alkylammonium salts, and the like. Cationic surfactants are known to have a variety of properties that can be beneficial in the present solid compositions. These desirable properties can include detergency in compositions of or below neutral pH, antimicrobial efficacy, thickening or gelling in cooperation with other agents, and the like.

Cationic surfactants useful in the compositions of the present invention include those having the formula $R^1{}_mR^2{}_xY_LZ$ wherein each $R^1$ is an organic group containing a straight or branched alkyl or alkenyl group optionally substituted with up to three phenyl or hydroxy groups and optionally interrupted by up to four of the following structures:

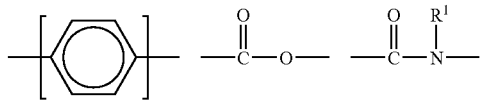

-continued

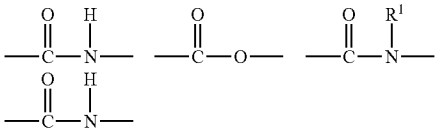

or an isomer or mixture of these structures, and which contains from about 8 to 22 carbon atoms. The $R^1$ groups can additionally contain up to 12 ethoxy groups. m is a number from 1 to 3. Preferably, no more than one $R^1$ group in a molecule has 16 or more carbon atoms when m is 2 or more than 12 carbon atoms when m is 3. Each $R^2$ is an alkyl or hydroxyalkyl group containing from 1 to 4 carbon atoms or a benzyl group with no more than one $R^2$ in a molecule being benzyl, and x is a number from 0 to 11, preferably from 0 to 6. The remainder of any carbon atom positions on the Y group are filled by hydrogens.

Y is can be a group including, but not limited to:

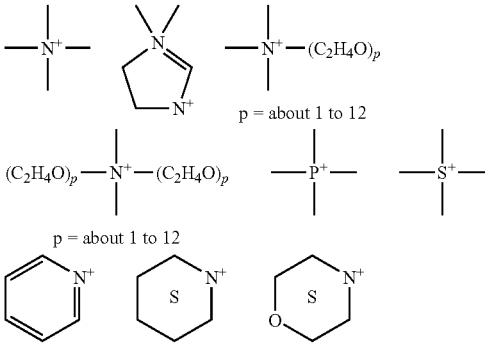

or a mixture thereof. Preferably, L is 1 or 2, with the Y groups being separated by a moiety selected from $R^1$ and $R^2$ analogs (preferably alkylene or alkenylene) having from 1 to about 22 carbon atoms and two free carbon single bonds when L is 2. Z is a water soluble anion, such as a halide, sulfate, methylsulfate, hydroxide, or nitrate anion, particularly preferred being chloride, bromide, iodide, sulfate or methyl sulfate anions, in a number to give electrical neutrality of the cationic component.

Amphoteric Surfactants

Amphoteric, or ampholytic, surfactants contain both a basic and an acidic hydrophilic group and an organic hydrophobic group. These ionic entities may be any of anionic or cationic groups described herein for other types of surfactants. A basic nitrogen and an acidic carboxylate group are the typical functional groups employed as the basic and acidic hydrophilic groups. In a few surfactants, sulfonate, sulfate, phosphonate or phosphate provide the negative charge.

Amphoteric surfactants can be broadly described as derivatives of aliphatic secondary and tertiary amines, in which the aliphatic radical may be straight chain or branched and wherein one of the aliphatic substituents contains from about 8 to 18 carbon atoms and one contains an anionic water solubilizing group, e.g., carboxy, sulfo, sulfato, phosphato, or phosphono. Amphoteric surfactants are subdivided into two major classes known to those of skill in the art and described in "Surfactant Encyclopedia" *Cosmetics & Toiletries*, Vol. 104 (2) 69-71 (1989). The first class includes acyl/dialkyl ethylenediamine derivatives (e.g. 2-alkyl hydroxyethyl imidazoline derivatives) and their salts. The second class includes N-alkylamino acids and their salts. Some amphoteric surfactants can be envisioned as fitting into both classes.

Amphoteric surfactants can be synthesized by methods known to those of skill in the art. For example, 2-alkyl hydroxyethyl imidazoline is synthesized by condensation and ring closure of a long chain carboxylic acid (or a derivative) with dialkyl ethylenediamine. Commercial amphoteric surfactants are derivatized by subsequent hydrolysis and ring-opening of the imidazoline ring by alkylation—for example with chloroacetic acid or ethyl acetate. During alkylation, one or two carboxy-alkyl groups react to form a tertiary amine and an ether linkage with differing alkylating agents yielding different tertiary amines.

Long chain imidazole derivatives having application in the present invention generally have the general formula:

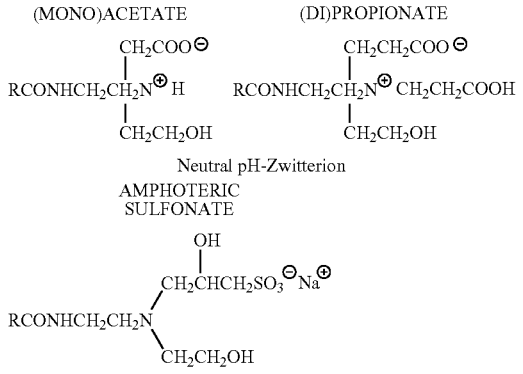

wherein R is an acyclic hydrophobic group containing from about 8 to 18 carbon atoms and M is a cation to neutralize the charge of the anion, generally sodium. Commercially prominent imidazoline-derived amphoterics that can be employed in the present solid compositions include for example: Cocoamphopropionate, Cocoamphocarboxy-propionate, Cocoamphoglycinate, Cocoamphocarboxy-glycinate, Cocoamphopropyl-sulfonate, and Cocoamphocarboxy-propionic acid. Preferred amphocarboxylic acids are produced from fatty imidazolines in which the dicarboxylic acid functionality of the amphodicarboxylic acid is diacetic acid and/or dipropionic acid.

The carboxymethylated compounds (glycinates) described herein above frequently are called betaines. Betaines are a special class of amphoteric discussed herein below in the section entitled, Zwitterion Surfactants.

Long chain N-alkylamino acids are readily prepared by reaction $RNH_2$, in which R═$C_8$-$C_{18}$ straight or branched chain alkyl, fatty amines with halogenated carboxylic acids. Alkylation of the primary amino groups of an amino acid leads to secondary and tertiary amines. Alkyl substituents may have additional amino groups that provide more than one reactive nitrogen center. Most commercial N-alkylamine acids are alkyl derivatives of beta-alanine or beta-N(2-carboxyethyl) alanine. Examples of commercial N-alkylamino acid ampholytes having application in this invention include alkyl beta-amino dipropionates, $RN(C_2H_4COOM)_2$ and $RNHC_2H_4COOM$. In these R is preferably an acyclic hydrophobic group containing from about 8 to about 18 carbon atoms, and M is a cation to neutralize the charge of the anion.

Preferred amphoteric surfactants include those derived from coconut products such as coconut oil or coconut fatty acid. The more preferred of these coconut derived surfactants include as part of their structure an ethylenediamine moiety, an alkanolamide moiety, an amino acid moiety, preferably glycine, or a combination thereof; and an aliphatic substituent of from about 8 to 18 (preferably 12) carbon atoms. Such a surfactant can also be considered an alkyl amphodicarboxylic acid. Disodium cocoampho dipropionate is one most preferred amphoteric surfactant and is commercially available under the tradename Miranol™ FBS from Rhodia Inc., Cranbury, N.J. Another most preferred coconut derived amphoteric surfactant with the chemical name disodium cocoampho diacetate is sold under the tradename Miranol™ C2M-SF Conc., also from Rhodia Inc., Cranbury, N.J.

A typical listing of amphoteric classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Zwitterionic Surfactants

Zwitterionic surfactants can be thought of as a subset of the amphoteric surfactants. Zwitterionic surfactants can be broadly described as derivatives of secondary and tertiary amines, derivatives of heterocyclic secondary and tertiary amines, or derivatives of quaternary ammonium, quaternary phosphonium or tertiary sulfonium compounds. Typically, a zwitterionic surfactant includes a positive charged quaternary ammonium or, in some cases, a sulfonium or phosphonium ion; a negative charged carboxyl group; and an alkyl group. Zwitterionics generally contain cationic and anionic groups which ionize to a nearly equal degree in the isoelectric region of the molecule and which can develop strong "inner-salt" attraction between positive-negative charge centers. Examples of such zwitterionic synthetic surfactants include derivatives of aliphatic quaternary ammonium, phosphonium, and sulfonium compounds, in which the aliphatic radicals can be straight chain or branched, and wherein one of the aliphatic substituents contains from 8 to 18 carbon atoms and one contains an anionic water solubilizing group, e.g., carboxy, sulfonate, sulfate, phosphate, or phosphonate. Betaine and sultaine surfactants are exemplary zwitterionic surfactants for use herein.

A general formula for these compounds is:

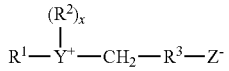

wherein $R^1$ contains an alkyl, alkenyl, or hydroxyalkyl radical of from 8 to 18 carbon atoms having from 0 to 10 ethylene oxide moieties and from 0 to 1 glyceryl moiety; Y is selected from the group consisting of nitrogen, phosphorus, and sulfur atoms; $R^2$ is an alkyl or monohydroxy alkyl group containing 1 to 3 carbon atoms; x is 1 when Y is a sulfur atom and 2 when Y is a nitrogen or phosphorus atom, $R^3$ is an alkylene or hydroxy alkylene or hydroxy alkylene of from 1 to 4 carbon atoms and Z is a radical selected from the group consisting of carboxylate, sulfonate, sulfate, phosphonate, and phosphate groups.

Examples of zwitterionic surfactants having the structures listed above include: 4-[N,N-di(2-hydroxyethyl)-N-octadecylammonio]-butane-1-carboxylate; 5-[S-3-hydroxypropyl-S-hexadecylsulfonio]-3-hydroxypentane-1-sulfate; 3-[P,P-diethyl-P-3,6,9-trioxatetracosanephosphonio]-2-hydroxypropane-1-phosphate; 3-[N,N-dipropyl-N-3-dodecoxy-2-hydroxypropyl-ammonio]-propane-1-phosphonate; 3-(N,N-dimethyl-N-hexadecylammonio)-propane-1-sulfonate; 3-(N,N-dimethyl-N-hexadecylammonio)-2-hydroxy-propane-1-sulfonate; 4-[N,N-di(2(2-hydroxyethyl)-N(2-hydroxydodecyl)ammonio]-butane-1-carboxylate; 3-[S-ethyl-S-(3-dodecoxy-2-hydroxypropyl)sulfonio]-propane-1-phosphate; 3-[P,P-dimethyl-P-dodecylphosphonio]-propane-1-phosphonate; and S[N,N-di(3-hydroxypropyl)-N-hexadecylammonio]-2-hydroxy-pentane-1-sulfate. The alkyl groups contained in said detergent surfactants can be straight or branched and saturated or unsaturated.

The zwitterionic surfactant suitable for use in the present solid compositions includes a betaine of the general structure:

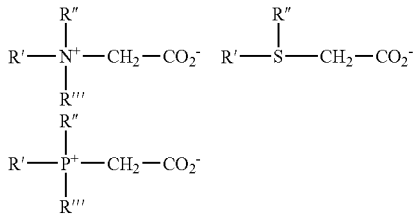

These surfactant betaines typically do not exhibit strong cationic or anionic characters at pH extremes nor do they show reduced water solubility in their isoelectric range. Unlike "external" quaternary ammonium salts, betaines are compatible with anionics. Examples of suitable betaines include coconut acylamidopropyldimethyl betaine; hexadecyl dimethyl betaine; $C_{12-14}$ acylamidopropylbetaine; $C_{8-14}$ acylamidohexyldiethyl betaine; 4-$C_{14-16}$ acylmethylamidodiethylammonio-1-carboxybutane; $C_{16-18}$ acylamidodimethylbetaine; $C_{12-16}$ acylamidopentanediethylbetaine; and $C_{12-16}$ acylmethylamidodimethylbetaine.

Sultaines useful in the present invention include those compounds having the formula $(R(R^1)_2N^+R^2SO^{3-}$, in which R is a $C_6$-$C_{18}$ hydrocarbyl group, each $R^1$ is typically independently $C_1$-$C_3$ alkyl, e.g. methyl, and $R^2$ is a $C_1$-$C_6$ hydrocarbyl group, e.g. a $C_1$-$C_3$ alkylene or hydroxyalkylene group.

A typical listing of zwitterionic classes, and species of these surfactants, is given in U.S. Pat. No. 3,929,678 issued to Laughlin and Heuring on Dec. 30, 1975. Further examples are given in "Surface Active Agents and Detergents" (Vol. I and II by Schwartz, Perry and Berch).

Surfactant Compositions

The surfactants described hereinabove can be used singly or in combination in the practice and utility of the present invention. In particular, the nonionics and anionics can be used in combination. The semi-polar nonionic, cationic, amphoteric and zwitterionic surfactants can be employed in combination with nonionics or anionics. The above examples are merely specific illustrations of the numerous surfactants which can find application within the scope of this invention. The foregoing organic surfactant compounds can be formulated into any of the several commercially desirable composition forms of this invention having disclosed utility. Said compositions include washing treatments for soiled surfaces in concentrated form which, when dispensed or dissolved in water, properly diluted by a proportionating device, and delivered to the target surfaces as a solution, gel or foam will provide cleaning. Said cleaning treatments consisting of one product; or, involving a two product system wherein proportions of each are utilized. Said product is typically a concentrate of liquid or emulsion.

A solid cleaning composition as used in the present disclosure encompasses a variety of forms including, for example, solids, pellets, blocks, and tablets, but not waxy powders. It should be understood that the term "solid" refers to the state of the cleaning composition under the expected conditions of storage and use of the solid cleaning composition. In general, it is expected that the cleaning composition will remain a solid when provided at a temperature of up to about 100° F. or greater than 120° F.

In certain embodiments, the solid cleaning composition is provided in the form of a unit dose. A unit dose refers to a solid cleaning composition unit sized so that the entire unit is used during a single washing cycle. When the solid cleaning composition is provided as a unit dose, it can have a mass of about 1 g to about 50 g. In other embodiments, the composition can be a solid, a pellet, or a tablet having a size of about 50 g to 250 g, of about 100 g or greater, or about 40 g to about 11,000 g.

In other embodiments, the solid cleaning composition is provided in the form of a multiple-use solid, such as, a block or a plurality of pellets, and can be repeatedly used to generate aqueous cleaning compositions for multiple washing cycles. In certain embodiments, the solid cleaning composition is provided as a cast solid, an extruded block, or a tablet having a mass of about 5 g to 10 kg. In certain embodiments, a multiple-use form of the solid cleaning composition has a mass of about 1 to 10 kg. In further embodiments, a multiple-use form of the solid cleaning composition has a mass of about 5 kg to about 8 kg. In other embodiments, a multiple-use form of the solid cleaning composition has a mass of about 5 g to about 1 kg, or about 5 g and to 500 g.

In some embodiments, the solids formed by the methods described herein comprise a multi-part system. The solids can be a two-part, three-part, or four-part system for example. In some embodiments, each part will include the same composition. In other embodiments, each part will include different compositions. In still yet other embodiments, some parts can include equivalent compositions and some parts can include different compositions, e.g., a three part system where two of the parts include the same composition and one of the parts includes a different composition.

The parts can be formed to provide the solid with a variety of desired characteristics including, for example: multiple cleaning formulations (e.g., one part includes an acidic cleaner, one part includes an alkaline cleaner, and a third optional part includes a buffer, wherein the third part can be positioned between the first and second parts); or solids designed to have different parts with different dissolution rates (e.g., one part contains a fast dissolving solid, and one part contains a slower dissolving solid).

Packaging System

In some embodiments, the solid composition can be packaged. The packaging receptacle or container may be rigid or flexible, and composed of any material suitable for containing the compositions produced according to the invention, as for example glass, metal, plastic film or sheet, cardboard, cardboard composites, paper, and the like.

Advantageously, since the composition is processed at or near ambient temperatures, the temperature of the processed mixture is low enough so that the mixture may be formed directly in the container or other packaging system without structurally damaging the material. As a result, a wider variety of materials may be used to manufacture the container than those used for compositions that processed and dispensed under molten conditions.

Suitable packaging used to contain the compositions is manufactured from a flexible, easy opening film material.

In some embodiments, a solid composition formed according to the methods of the present invention is packaged directly upon formation. That is, a solid composition is formed in the packaging from which it will be stored or dispensed. In some embodiments, the solid will be formed directly into a thin film plastic or a shrink wrapper. The solid may be formed in an packaging suitable for storage and/or dispensing of the solid.

Dispensing the Compositions

The cleaning composition made according to the present invention can be dispensed in any suitable method generally known. The cleaning composition can be dispensed from a spray-type dispenser such as that disclosed in U.S. Pat. Nos. 4,826,661, 4,690,305, 4,687,121, 4,426,362 and in U.S. Pat. Nos. Re 32,763 and 32,818, the disclosures of which are incorporated by reference herein. Briefly, a spray-type dispenser functions by impinging a water spray upon an exposed surface of the solid composition to dissolve a portion of the composition, and then immediately directing the concentrate solution including the composition out of the dispenser to a storage reservoir or directly to a point of use. When used, the product is removed from the package (e.g.) film and is inserted into the dispenser. The spray of water can be made by a nozzle in a shape that conforms to the solid shape. The dispenser enclosure can also closely fit the cleaning composition shape in a dispensing system that prevents the introduction and dispensing of an incorrect cleaning composition. The aqueous concentrate is generally directed to a use locus.

In some embodiments, the compositions hereof will be formulated such that during use in aqueous cleaning operations the wash water will have a pH of between about 1 and about 14, about 6.5 to about 11, or 7-10.5. Techniques for controlling pH at recommended usage levels include the use of buffers, alkali, acids, etc., and are well known to those skilled in the art.

In an embodiment, the present composition can be dispensed by immersing either intermittently or continuously in water. The composition can then dissolve, for example, at a controlled or predetermined rate. The rate can be effective to maintain a concentration of dissolved cleaning agent that is effective for cleaning.

In an embodiment, the present composition can be dispensed by scraping solid from the solid composition and contacting the scrapings with water. The scrapings can be added to water to provide a concentration of dissolved cleaning agent that is effective for cleaning.

Methods Employing the Solid Compositions

It is contemplated that the cleaning compositions of the invention can be used in a broad variety of industrial, household, health care, vehicle care, and other such applications. Some examples include surface disinfectant, ware cleaning, laundry cleaning, laundry cleaning or sanitizing, vehicle cleaning, floor cleaning, surface cleaning, pre-soaks, clean in place, and a broad variety of other such applications. The present solid product can be configured, for example, as an air freshener, a urinal block, a drain ring, or a laundry bar.

In some embodiments, an aqueous dispersion of the present solid composition is directly applied to a heavy soil deposit, permitted to soften and promote soil removal. Once the composition has been permitted to enhance the removability of the soil, the cleaner and removed soil can be readily removed with a rinse step. Liquid containing the compositions of the invention including an anionic surfactant can be directly contacted with the hard surface for the removal of organic, oily or greasy soils. Depending on substrate, such a composition can additionally include a chelating agent to have a final formulation including an anionic surfactant and a chelating agent. These compositions can be used on substantially non-corrosive surfaces such as plastics, wood, coated wood, stainless steels, composite materials, fabrics, cement, and others.

In some embodiments, the present method includes a method of cleaning a hard surface. The method can include applying to the surface a cleaning composition including spore, bacteria, or enzyme; borate salt; and anionic surfactant. The method can include applying the composition to a floor, a drain, or a combination thereof. In an embodiment, the method omits rinsing. That is, an aqueous dispersion of the present solid composition can be applied and the surface is not rinsed.

In some embodiments, the present method includes a method of cleaning a floor. Such a method can include increasing the coefficient of friction of the floor. Such a method can include cleaning the grout of a tile floor. Cleaning grout can include allowing more of its natural color to show. The method includes applying a stabilized spore composition according to the present invention to the floor. In some embodiments, the method does not include (e.g., omits) rinsing. In some embodiments, the present method can include effectively removing from flooring (e.g., tile) a slippery-when-wet film. The method can include cleaning the flooring and increasing its coefficient of friction.

In some embodiments, the present method of cleaning a hard surface can include applying a liquid dispersion of the present solid composition to a bathroom surface, such as a wall, floor, or fixture. The bathroom surface can be a shower wall or surface. The bathroom surface can be a tiled wall. A composition for use on a vertical surface can include a thickener, humectant, or foaming surfactant. Applying the composition to the vertical surface can include foaming the composition. In some embodiments, the present solid composition includes a thickener or humectant, which can assist in retaining the composition on a horizontal or vertical surface. In other embodiments, the present method of cleaning a hard surface can include applying a liquid dispersion of the present solid composition to ware.

In some embodiments, the present method can include applying a liquid dispersion of the present solid composition to a surface that has grease or oil on it. Such surfaces include a floor, a parking lot, a drive through pad, a garage floor, a parking ramp floor, and the like.

In some embodiments, the present method includes spraying or misting a surface with a liquid dispersion of the present solid composition.

In some embodiments, the present method includes applying the stabilized microbial composition to a surface and keeping the surface moist for an extended period, such as one or two hours up to about eight to about 16 hours. Keeping the surface moist can be accomplished by repeated application of the composition, such as by misting. Keeping the surface moist can be accomplished by contacting the surface with a sponge, rag, or mop wet with the composition for an extended period. Keeping the surface moist can be accomplished by applying a persistent stable microbial composition. A persistent stable microbial composition can remain on the surface and keep the surface moist. For example, a thickened composition and certain foamed compositions can remain on the surface and keep the surface moist. Extended presence of the present solid composition can provide more rapid cleaning compared to a composition that dries or evaporates.

Foaming

In an embodiment, the present solid composition can be mixed with diluent to form a use composition that is used in a roamer. Foaming application can be accomplished, for example, using a foam application device such as a tank roamer or an aspirated wall mounted foamer, e.g., employing a foamer nozzle of a trigger sprayer. Foaming application can be accomplished by placing the use composition in a fifteen gallon foam application pressure vessel, such as a fifteen gallon capacity stainless steel pressure vessel with mix propeller. The foaming composition can then be dispensed through a foaming trigger sprayer. A wall mounted roamer can use air to expel foam from a tank or line. In an embodiment, compressed air can be injected into the mixture, then applied to the object through a foam application device such as a tank roamer or an aspirated wall mounted foamer.

Mechanical foaming heads that can be used according to the invention to provide foam generation include those heads that cause air and the foaming composition to mix and create a foamed composition. That is, the mechanical foaming head causes air and the foaming composition to mix in a mixing chamber and then pass through an opening to create a foam.

Suitable mechanical foaming heads that can be used according to the invention include those available from Airspray International, Inc. of Pompano Beach, Fla., and from Zeller Plastik, a division of Crown Cork and Seal Co. Suitable mechanical foaming heads that can be used according to the invention are described in, for example, U.S. Pat. No. D-452,822; U.S. Pat. No. D-452,653; U.S. Pat. No. D-456,260; and U.S. Pat. No. 6,053,364. Mechanical foaming heads that can be used according to the invention includes those heads that are actuated or intended to be actuated by application of finger pressure to a trigger that causes the foaming composition and air to mix and create a foam. That is, a person's finger pressure can cause the trigger to depress thereby drawing the foaming composition and air into the head and causing the foaming composition and air to mix and create a foam.

The present invention can be better understood with reference to the following examples. These examples are intended to be representative of specific embodiments of the invention, and are not intended as limiting the scope of the invention.

EXAMPLES

Example 1

Making Pressed Solid Compositions

The following waxy solid composition were made by pressing the mixed ingredients manually in a cup with a solid object sufficient to fill the cross section of the cup and with a bench top press employing gentle pressing.

The waxy solidification agent is anionic surfactant in each of the compositions. Compositions A and B include sodium alkyl benzene sulfonate as waxy solidification agent. Composition C includes sodium alkyl benzene sulfonate, sodium laurel sulfate, sodium laurel ether sulfate as waxy solidification agent.

| | (wt-%) | | | |
|---|---|---|---|---|
| Ingredient | A | B | C | D |
| Waxy solidification agent | 45 | 45 | 68 | 49-50 |
| Carbonate | | 9.5 | | |
| Citric Acid/Citrate | 35 | | | |
| amino carboxylate | | 20 | | |
| secondary alkalinity | | 0.5 | | |
| Quaternary ammonium antimicrobial agent | | | | 49-50 |
| Bicarbonate salt | | 5 | | |
| Amphoteric surfactant | | | 33 | |

-continued

| Ingredient | (wt-%) A | B | C | D |
|---|---|---|---|---|
| Nonionic Surfactant | 9.9 | 9.9 | | |
| Fatty acid salt | 9.9 | 9.9 | | |

The following solid compositions were also made. A sanitizer, acid floor cleaner, alkaline floor cleaner and a rinse aid, were each made by pressing the mixed ingredients. Urea was included as a waxy solidification agent in the acid floor cleaner. The quaternary ammonium antimicrobial agent in the sanitizer composition acted as both an antimicrobial agent and a waxy solidification agent, as the antimicrobial agent was prepared on urea.

The Acid Floor Cleaner included urea, sodium alkyl benzene sulfonate and a high melt alcohol ethoxylate as the waxy solidification agent. The Alkaline Floor Cleaner included sodium alkyl benzene sulfonate, a high melt alcohol ethoxylate, and an EO/PO polymer as the waxy solidification agent. For the rinse aid the waxy solidification agent included a mixture of amide compounds, a polyethylene glycol compound, sodium alkyl benzene sulfonate, alkyl polyglycoside and sodium sulfate, and sodium lauryl ether sulfate.

| Ingredient | Sanitizer | Acid Floor Cleaner | Alkaline Floor Cleaner | Rinse Aid |
|---|---|---|---|---|
| Waxy solidification agent | | 65 | 55 | 85 |
| Carbonate | | | 5 | |
| Citric Acid/Citrate | | 35 | | |
| amino carboxylate | | | 20 | |
| Bicarbonate salt | | | 5 | |
| Water | 5 | | | |
| Salt | | | 14 | 14 |
| Metasilicate salt | | | 1 | |
| Antifoaming agent | | | | .02 |
| Quaternary ammonium antimicrobial agent | 95 | | | |

It should be noted that, as used in this specification and the appended claims, the singular forms "a," "an," and "the" include plural referents unless the content clearly dictates otherwise. Thus, for example, reference to a composition containing "a compound" includes a mixture of two or more compounds. It should also be noted that the term "or" is generally employed in its sense including "and/or" unless the content clearly dictates otherwise.

The invention has been described with reference to various specific and preferred embodiments and techniques. However, it should be understood that many variations and modifications may be made while remaining within the spirit and scope of the invention.

We claim:

1. A method of making a stable solid cleaning composition comprising:

providing flowable waxy particles comprising about 40 to about 75 wt % of a solidification agent selected from the group consisting of a polyethylene glycol, an anionic surfactant, urea, and mixtures thereof; and an ingredient selected from the group consisting of alkalinity source, acidulant, stabilized microbial or enzyme composition, surfactant, sequestrant, and mixtures thereof;

putting the flowable waxy particles in a drawer;

vibrating the flowable waxy particles in the drawer;

transferring the flowable waxy particles from the drawer into a form;

gently pressing the flowable waxy particles in the form at ambient temperature, with a force of about 1 to about 1000 psi to produce the stable solid cleaning composition, vibrating the flowable waxy particles in the form to produce the stable solid cleaning composition, or combination thereof; and removing the solid cleaning composition from the form, wherein the solid composition is a block having a mass of about 1 to about 10 kg and the method does not employ extruding the flowable waxy particles, or a melt and a solidification of the flowable waxy particles to form the solid block.

2. The method of claim 1, wherein putting the flowable waxy particles in a drawer comprises flowing the flowable waxy particles from a hopper into the drawer.

3. The method of claim 2, wherein vibrating the flowable waxy particles in the drawer comprises vibrating while the flowable waxy particles is flowing into the drawer.

4. The method of claim 1, wherein transferring the flowable waxy particles from the drawer into the form comprises:

providing the drawer disposed above the form, the drawer comprising a panel disposed between an interior of the drawer and the form;

laterally moving the panel to a position not between the interior of the drawer and the form;

whereby the flowable waxy particles drops into the form.

5. The method of claim 4, wherein the form comprises a plurality of cavities each cavity configured to produce a solid cleaning composition.

6. The method of claim 1, comprising pressing and vibrating.

7. The method of claim 1, wherein removing the composition from the form comprises raising the form with the composition remaining on a pallet that had formed the bottom of the form.

8. The method of claim 7, further comprising moving the pallet horizontally away from the drawer and form.

9. The method of claim 1, wherein the drawer and form are components of a concrete block machine; and the concrete block machine:

vibrates the flowable waxy particles in the drawer;

transfers the flowable waxy particles from the drawer into a form;

gently presses the flowable waxy particles in the form to produce the solid cleaning composition, vibrates the flowable waxy particles to produce the solid cleaning composition, or combination thereof; and removes the solid cleaning composition from the form.

10. The method of claim 1, comprising vibrating the drawer containing flowable waxy particles for about 1 to about 10 sec at about 200 to about 6,000 rpm.

11. The method of claim 1, comprising vibrating the form containing flowable waxy particles for about 1 to about 10 sec at about 200 to about 6,000 rpm.

12. The method of claim 9, comprising pressing on the flowable waxy particles in the form with a weight of about 100 to about 2000 lb.

13. The method of claim 1, further comprising mixing the waxy solidification agent; and alkalinity source, acidulant, stabilized microbial or enzyme composition, surfactant, sequestrant, or mixture thereof to produce the flowable waxy particles.

14. The method of claim 13, wherein mixing employs a ribbon blender.

15. The method of claim 1, wherein the composition comprises an alkali metal carbonate, an aminocarboxylate, citric acid, amphoteric surfactant, nonionic surfactant, or a mixture thereof.

16. The method of claim 1, wherein the composition comprises less than about 0.5% phosphorous.

17. The method of claim 1, wherein the composition comprises less than about 0.5% nitrilotriacetic acid.

18. The method of claim 1, wherein the solid composition expands less than about 3% in any dimension when heated to 120° F. for one day.

19. The method of claim 1, wherein gently pressing, vibrating, or combination thereof produces the solid composition, the solid composition comprising the flowable waxy particles compressed to provide sufficient surface contact between particles making up the flowable waxy particles that the solid composition solidifies into a stable solid cleaning composition.

20. The method of claim 1, wherein the flowable waxy particles comprise waxy powder.

21. The method of claim 1, wherein flowable waxy particles further comprises additional cleaning agents.

22. The method of claim 1, wherein the stable solid cleaning composition is a multi-part cleaning composition.

23. The method of claim 1, wherein the flowable waxy particles further comprise:

spore, bacteria, fungi, or enzyme;

alkanol amine borate; and surfactant.

* * * * *